US008764972B2

(12) United States Patent
Bhan et al.

(10) Patent No.: US 8,764,972 B2
(45) **Date of Patent: *Jul. 1, 2014**

(54) SYSTEMS, METHODS, AND CATALYSTS FOR PRODUCING A CRUDE PRODUCT

(75) Inventors: Opinder Kishan Bhan, Katy, TX (US); Scott Lee Wellington, Bellaire, TX (US)

(73) Assignee: Shell Oil Company, Houston, TX (US)

( * ) Notice: Subject to any disclaimer, the term of this patent is extended or adjusted under 35 U.S.C. 154(b) by 947 days.

This patent is subject to a terminal disclaimer.

(21) Appl. No.: 12/512,673

(22) Filed: Jul. 30, 2009

(65) Prior Publication Data

US 2009/0288989 A1 Nov. 26, 2009

Related U.S. Application Data

(62) Division of application No. 11/013,576, filed on Dec. 16, 2004, now Pat. No. 7,588,681.

(60) Provisional application No. 60/531,503, filed on Dec. 19, 2003, provisional application No. 60/618,681, filed on Oct. 14, 2004.

(51) Int. Cl.
*C10G 49/02* (2006.01)
*C10G 45/04* (2006.01)

(52) U.S. Cl.
USPC ..... 208/251 R; 208/251 H; 208/253; 208/299

(58) Field of Classification Search
USPC ..... 208/251 R, 253, 251 H, 299, 300
See application file for complete search history.

(56) References Cited

U.S. PATENT DOCUMENTS

| | | | | |
|---|---|---|---|---|
| 2,850,435 | A | 9/1958 | Fierce et al. | 196/41 |
| 2,902,429 | A | 9/1959 | Scott | 208/89 |
| 2,921,023 | A | 1/1960 | Holm | 208/263 |
| 3,025,231 | A | 3/1962 | Friedman et al. | 208/213 |
| 3,446,730 | A | 5/1969 | Kerns | 208/254 |
| 3,547,585 | A | 12/1970 | Urban | 23/224 |
| 3,576,737 | A | 4/1971 | Mitchell | 208/251 |
| 3,617,501 | A | 11/1971 | Eng et al. | 208/263 |
| 3,622,495 | A | 11/1971 | Gatsis et al. | 208/59 |
| 3,663,431 | A | 5/1972 | Wagner | 208/143 |

(Continued)

FOREIGN PATENT DOCUMENTS

| | | | |
|---|---|---|---|
| CN | 1393516 | 1/2003 | |
| EP | 0159097 | 10/1985 | C10G 45/04 |

(Continued)

OTHER PUBLICATIONS

Hannan, M.A. et al, "Determination of Oxygen, Nitrogen, and Silicon in Nigerian Fossil Fuels by 14 MeV Neutron Activation Analysis", J. of Radioanalytical and Nuclear Chemistry, vol. 256, No. 1 (2003); pp. 61-65.

(Continued)

*Primary Examiner* — Renee E Robinson

(57) ABSTRACT

Contact of a crude feed with one or more catalysts produces a total product that includes a crude product. The crude product is a liquid mixture at 25° C. and 0.101 MPa. The one or more catalyst may include an uncalcined catalyst. One or more other properties of the crude product may be changed by at least 10% relative to the respective properties of the crude feed.

23 Claims, 16 Drawing Sheets

(56) References Cited

U.S. PATENT DOCUMENTS 3,684,688 A 8/1972 Roselius ..... 208/50
3,696,027 A 10/1972 Bridge ..... 208/210
3,712,861 A 1/1973 Rosinski et al. ..... 208/216
3,730,876 A 5/1973 Sequeira, Jr. ..... 208/59
3,766,054 A 10/1973 Weisz et al. ..... 208/89
3,808,122 A 4/1974 White et al. ..... 208/59
3,824,183 A 7/1974 Chun et al. ..... 208/263
3,846,288 A 11/1974 Chun et al. ..... 208/263
3,876,523 A 4/1975 Rosinski et al. ..... 208/89
3,876,532 A 4/1975 Plundo et al. ..... 208/216
3,891,541 A 6/1975 Oleck et al. ..... 208/89
3,902,991 A 9/1975 Christensen et al. ..... 208/211
3,920,538 A 11/1975 Pronk et al. ..... 208/89
3,928,176 A 12/1975 Hamner et al. ..... 208/97
3,931,052 A 1/1976 Oleck et al. ..... 252/465
3,960,712 A 6/1976 Conway ..... 208/216
4,008,149 A 2/1977 Itoh et al. ..... 208/216
4,016,067 A 4/1977 Fischer et al. ..... 208/89
4,048,060 A 9/1977 Riley ..... 208/211
4,062,757 A 12/1977 Beuther et al. ..... 208/61
4,067,799 A 1/1978 Bearden, Jr. et al. ..... 208/112
4,080,313 A 3/1978 Whittam ..... 252/455
4,102,779 A * 7/1978 Hensley, Jr. ..... 208/211
4,107,087 A 8/1978 Pessimisis ..... 252/455 R
4,191,635 A 3/1980 Quick et al. ..... 208/89
4,191,636 A 3/1980 Fukui et al. ..... 208/110
4,196,102 A 4/1980 Inooka et al. ..... 252/457
4,212,729 A 7/1980 Hensley et al. ..... 208/210
4,297,242 A 10/1981 Hensley, Jr. et al. ..... 252/439
4,306,964 A 12/1981 Angevine ..... 208/210
4,324,645 A 4/1982 Angevine et al. ..... 208/50
4,341,625 A * 7/1982 Tamm
4,357,263 A 11/1982 Heck et al. ..... 252/439
4,358,361 A 11/1982 Peters ..... 208/89
4,367,164 A 1/1983 Shiroto et al. ..... 252/457
4,405,441 A 9/1983 Van Dongen et al. ..... 208/61
4,411,824 A 10/1983 Chen ..... 502/323
4,414,102 A 11/1983 Rankel et al. ..... 208/211
4,422,960 A 12/1983 Shiroto et al. ..... 502/206
4,424,142 A 1/1984 Asaoka et al. ..... 502/84
4,431,525 A 2/1984 Hensley, Jr. et al. ..... 208/210
4,440,631 A 4/1984 Togari et al. ..... 208/112
4,446,244 A 5/1984 Van Nordstrand ..... 502/84
4,447,314 A 5/1984 Banta ..... 208/89
4,450,068 A 5/1984 Kukes ..... 208/257 H
4,456,699 A 6/1984 Hensley, Jr. et al. ..... 502/208
4,457,836 A 7/1984 Seiver et al. ..... 208/254 H
4,498,972 A 2/1985 Toulhoat et al. ..... 208/59
4,499,203 A 2/1985 Toulhoat et al. ..... 205/247
4,520,128 A 5/1985 Morales et al. ..... 502/210
4,525,472 A 6/1985 Morales et al. ..... 502/323
4,530,757 A 7/1985 Rankel et al. ..... 208/251 R
4,548,710 A 10/1985 Simpson ..... 208/216 PP
4,549,957 A 10/1985 Hensley, Jr. et al.
4,560,468 A 12/1985 Kukes et al. ..... 208/110
4,572,778 A 2/1986 Ward ..... 208/89
4,587,012 A 5/1986 Quann ..... 208/251 H
4,588,709 A 5/1986 Morales et al. ..... 502/314
4,592,827 A 6/1986 Galiasso et al. ..... 208/59
4,595,667 A 6/1986 Takase et al. ..... 502/63
4,613,425 A 9/1986 Higashi et al. ..... 208/89
4,670,134 A 6/1987 Kolts et al. ..... 208/251 H
4,687,757 A 8/1987 Parrott et al. ..... 502/220
4,729,826 A 3/1988 Lindsay et al. ..... 208/211
4,738,884 A 4/1988 Algrim et al. ..... 428/57
4,746,419 A 5/1988 Peck et al. ..... 208/213
4,830,736 A 5/1989 Hung et al. ..... 208/251 H
4,844,792 A 7/1989 Abdo et al. ..... 208/111
4,851,107 A 7/1989 Kretschmar et al. ..... 208/108
4,861,746 A 8/1989 Oishi et al. ..... 502/314
4,886,594 A 12/1989 Miller ..... 208/210
4,992,157 A 2/1991 Bricker et al. ..... 208/12
4,992,163 A 2/1991 Aldridge et al. ..... 208/251 H
5,002,919 A 3/1991 Yamazaki et al. ..... 502/315
5,017,535 A 5/1991 Schoonhoven et al. ..... 502/30
5,053,117 A 10/1991 Kyan et al. ..... 208/58
5,089,462 A 2/1992 Wilson et al. ..... 502/309
5,089,463 A 2/1992 Johnson ..... 502/313
5,124,027 A 6/1992 Beaton et al. ..... 208/309
5,164,078 A * 11/1992 Hung et al. ..... 208/251 H
5,190,642 A 3/1993 Wilson et al. ..... 208/254 R
5,200,060 A 4/1993 Sajkowski et al. ..... 208/108
5,215,955 A 6/1993 Threlkel ..... 502/221
5,266,188 A 11/1993 Kukes et al. ..... 208/216 R
5,300,212 A 4/1994 Winter, Jr. ..... 208/67
5,322,617 A 6/1994 de Bruijn et al. ..... 208/108
5,334,307 A 8/1994 Simpson et al. ..... 208/254 H
5,358,634 A 10/1994 Rankel ..... 208/251
5,374,350 A 12/1994 Heck et al. ..... 208/143
5,395,536 A 3/1995 Brown et al. ..... 210/727
5,397,456 A 3/1995 Dai et al. ..... 208/108
5,468,371 A 11/1995 Nelson et al.
5,514,273 A 5/1996 Sherwood, Jr. et al.
5,601,701 A 2/1997 Cameron et al. ..... 208/251 H
5,635,056 A 6/1997 Brons et al. ..... 208/227
5,779,992 A 7/1998 Higashi ..... 422/190
5,827,421 A 10/1998 Sherwood, Jr. ..... 208/112
5,856,609 A 1/1999 Wu et al. ..... 585/489
5,871,626 A 2/1999 Crafts et al. ..... 204/297 R
5,910,242 A 6/1999 Halbert et al. ..... 208/263
5,916,529 A 6/1999 Scheuerman ..... 422/141
5,928,499 A 7/1999 Sherwood, Jr. et al. ..... 208/216
5,942,101 A 8/1999 Greaney ..... 205/688
6,017,441 A 1/2000 Morel et al. ..... 208/96
6,037,300 A 3/2000 Kasztelan et al. ..... 502/204
6,086,749 A 7/2000 Kramer et al. ..... 208/213
6,086,751 A 7/2000 Bienstock et al. ..... 208/263
6,149,799 A 11/2000 Raybaud et al. ..... 208/49
6,162,350 A 12/2000 Soled et al. ..... 208/113
6,203,695 B1 3/2001 Harle et al. ..... 208/143
6,248,230 B1 6/2001 Min et al. ..... 208/213
6,281,158 B1 8/2001 Gabrielov et al. ..... 502/216
6,290,841 B1 * 9/2001 Gabrielov et al. ..... 208/213
6,303,842 B1 10/2001 Bridges et al. ..... 585/648
6,309,537 B1 10/2001 Harle et al. ..... 208/254 H
6,436,280 B1 8/2002 Harle et al. ..... 208/26 R
6,547,957 B1 4/2003 Sudhakar et al. ..... 208/111.01
6,554,994 B1 4/2003 Reynolds et al. ..... 208/211
6,660,897 B1 12/2003 Marchal-George et al. .. 585/482
6,759,364 B2 7/2004 Bhan ..... 508/315
6,783,663 B1 8/2004 Riley et al. ..... 208/213
6,800,193 B2 10/2004 Varadaraj ..... 208/106
6,919,018 B2 7/2005 Bhan ..... 208/251 R
7,402,547 B2 7/2008 Wellington et al. ..... 502/222
7,413,646 B2 8/2008 Wellington et al. ..... 208/108
7,416,653 B2 8/2008 Wellington et al. ..... 208/108
7,419,939 B2 9/2008 Varadaraj ..... 507/260
2001/0045375 A1 11/2001 Thijssen et al. ..... 208/211
2002/0112987 A1 8/2002 Hou et al. ..... 208/108
2002/0125175 A1 9/2002 Collins et al. ..... 208/263
2003/0168383 A1 9/2003 Hoekstra et al. ..... 208/213
2004/0106516 A1 6/2004 Schulz et al. ..... 502/313
2004/0235653 A1 11/2004 Domokos et al. ..... 502/309
2005/0133414 A1 6/2005 Bhan et al. ..... 208/115
2005/0133415 A1 6/2005 Bhan et al. ..... 208/115
2005/0133416 A1 6/2005 Bhan et al. ..... 208/115
2005/0133417 A1 6/2005 Bhan et al. ..... 208/115
2005/0133418 A1 6/2005 Bhan et al. ..... 208/115
2005/0139518 A1 6/2005 Bhan et al. ..... 208/115
2005/0139519 A1 6/2005 Bhan et al. ..... 208/115
2005/0139520 A1 6/2005 Bhan et al. ..... 208/115
2005/0139521 A1 6/2005 Bhan et al. ..... 208/115
2005/0139522 A1 6/2005 Bhan et al. ..... 208/115
2005/0145543 A1 7/2005 Bhan et al. ..... 208/115
2005/0150818 A1 7/2005 Bhan et al. ..... 208/115
2005/0155908 A1 7/2005 Bhan et al. ..... 208/115
2005/0167320 A1 8/2005 Bhan et al. ..... 208/14
2005/0167324 A1 8/2005 Bhan et al. ..... 208/115
2005/0167325 A1 8/2005 Bhan et al. ..... 208/115
2005/0167326 A1 8/2005 Bhan et al. ..... 208/115
2005/0167327 A1 8/2005 Bhan et al. ..... 208/115
2005/0167328 A1 8/2005 Bhan et al. ..... 208/115
2005/0167329 A1 8/2005 Bhan et al. ..... 208/115
2005/0167330 A1 8/2005 Bhan et al. ..... 208/115

(56) References Cited

U.S. PATENT DOCUMENTS

| | | | | |
|---|---|---|---|---|
| 2005/0167331 | A1 | 8/2005 | Bhan et al. | 208/115 |
| 2005/0167332 | A1 | 8/2005 | Bhan et al. | 208/115 |
| 2005/0173301 | A1 | 8/2005 | Bhan et al. | 208/115 |
| 2005/0173302 | A1 | 8/2005 | Bhan et al. | 208/115 |
| 2005/0173303 | A1 | 8/2005 | Bhan et al. | 208/115 |
| 2006/0060510 | A1 | 3/2006 | Bhan | 208/213 |
| 2006/0231456 | A1 | 10/2006 | Bhan | 208/85 |
| 2006/0231457 | A1 | 10/2006 | Bhan | 8/85 |
| 2006/0231465 | A1 | 10/2006 | Bhan | 8/253 |
| 2006/0234876 | A1 | 10/2006 | Bhan | 7/270 |
| 2006/0234877 | A1 | 10/2006 | Bhan | 7/270 |
| 2006/0249430 | A1 | 11/2006 | Mesters | 208/263 |
| 2007/0000808 | A1 | 1/2007 | Bhan et al. | 208/58 |
| 2007/0000810 | A1 | 1/2007 | Bhan et al. | 208/263 |
| 2007/0000811 | A1 | 1/2007 | Bhan et al. | 208/263 |

FOREIGN PATENT DOCUMENTS

| | | | | |
|---|---|---|---|---|
| EP | 0 225 686 | A1 | 6/1987 | C10G 47/12 |
| EP | 0 367 021 | A1 | 5/1990 | C10G 45/04 |
| EP | 0 433 026 | A1 | 6/1991 | C10G 45/04 |
| EP | 0435242 | | 7/1991 | C10G 67/04 |
| EP | 0525259 | | 2/1993 | C10G 45/08 |
| EP | 0 537 500 | A2 | 4/1993 | C10G 1/00 |
| EP | 0 569 092 | A1 | 5/1993 | C10G 65/12 |
| EP | 0567272 | | 10/1993 | C10G 45/08 |
| EP | 0 704 239 | A2 | 9/1995 | B01J 23/85 |
| EP | 0 899 319 | A2 | 3/1999 | C10G 45/02 |
| EP | 1 350 830 | A1 | 10/2003 | C10G 45/06 |
| FR | 2546175 | | 11/1984 | C10G 49/04 |
| GB | 496779 | | 12/1938 | |
| GB | 934907 | | 8/1963 | |
| GB | 1115122 | | 5/1968 | C07C 3/58 |
| GB | 1 232 173 | | 5/1971 | C10G 23/16 |
| GB | 1 236 230 | | 6/1971 | C10G 29/10 |
| GB | 1 364 238 | | 8/1974 | C10G 23/16 |
| GB | 2013236 | | 8/1979 | C10G 37/00 |
| GB | 2112412 | | 7/1983 | C10G 45/16 |
| GB | 2 167 430 | A | 5/1986 | C10G 47/02 |
| WO | WO9302158 | | 2/1993 | C10G 45/04 |
| WO | WO9708274 | | 3/1997 | C10G 45/08 |
| WO | 00/20113 | | 4/2000 | B10J 19/02 |
| WO | WO0044856 | | 8/2000 | C10G 49/04 |
| WO | WO0209870 | | 2/2002 | B01J 23/00 |
| WO | WO0232570 | | 4/2002 | B01J 21/04 |
| WO | WO02053286 | | 7/2002 | B01J 35/10 |
| WO | WO02062925 | | 8/2002 | |
| WO | WO02100985 | | 12/2002 | C10G 65/02 |
| WO | 03/091363 | A1 | 11/2003 | C10G 45/22 |
| WO | WO 2003104359 | | 12/2003 | C10G 65/04 |
| WO | WO2004053028 | | 6/2004 | C10G 49/04 |
| WO | WO2005061666 | | 7/2005 | |
| WO | WO2005063939 | | 7/2005 | C10G 45/00 |
| WO | WO2005066310 | | 7/2005 | |
| WO | WO2005085395 | | 9/2005 | C10G 67/00 |

OTHER PUBLICATIONS

Dehkissia, S. et al, Characterization of Doba-Chad Heavy Crude Oil in Relation With the Feasibility of Pipeline Transportation, Fuel 83 (2004); pp. 2157-2168.

Sadeghi, K. M. et al, "Fractionation of Various Heavy Oils and Bitumen for Characterization Based on Polarity", Fuel, 1989, vol. 68, June; pp. 782-787.

Van Kerkvoort, W. J. and Nieuwstad, J.J. Determination of Dry Sludge Content of Fuel Oils: Development of the Shell Hot Filtration Test (SHFT), Journal of the Inst. of Petroleum, vol. 37, 1951, pp. 596-604.

Amendment and Response Under 37 CFR 1.111, dated May 21, 2007 for U.S. Appl. No. 11/014,335.

Amendment and Response Under 37 CFR 1.111, dated Jul. 2, 2007 for U.S. Appl. No. 11/014,335.

Response Under 37 CFR 1.114, dated Apr. 4, 2008 for U.S. Appl. No. 11/014,335.

Amendment and Response Under 37 CFR 1.111, dated Sep. 7, 2007 for U.S. Appl. No. 11/013,553.

Response Under 37 CFR 1.111, dated Jul. 18, 2007 for U.S. Appl. No. 11/013,554.

Response to Notice of Non-Compliant Amendment dated Jul. 11, 2006 for U.S. Appl. No. 11/013,576.

Amendment and Response Under 37 CFR 1.111 and 1.115, dated Mar. 19, 2008 for U.S. Appl. No. 11/013,576.

Amendment and Response Under 37 CFR 1.111, dated Aug. 20, 2007 for U.S. Appl. No. 11/013,835.

Response Under 37 CFR 1.111, dated Mar. 7, 2008 for U.S. Appl. No. 11/014,362.

Response Under 37 CFR 1.111, dated Nov. 2, 2007 for U.S. Appl. No. 11/014,011.

Amendment and Response Under 37 CFR 1.111, dated Oct. 18, 2007 for U.S. Appl. No. 11/014,275.

Amendment and Response Under 37 CFR 1.111, dated Sep. 10, 2007 for U.S. Appl. No. 11/014,275.

Response Under 37 CFR 1.111, dated Feb. 22, 2008 for U.S. Appl. No. 11/014,272.

Amendment and Response Under 37 CFR 1.111, dated Sep. 7, 2007 for U.S. Appl. No. 11/014,005.

Response Under 37 CFR 1.111, dated Sep. 10, 2007 for U.S. Appl. No. 11/013,545.

Response Under 37 CFR 1.111, dated Mar. 10, 2008 for U.S. Appl. No. 11/014,132.

Response Under 37 CFR 1.111, dated Mar. 7, 2008 for U.S. Appl. No. 11/014,251.

Response Under 37 CFR 1.111, dated Dec. 4, 2006 for U.S. Appl. No. 11/013,632.

Response Under 37 CFR 1.114, dated Mar. 14, 2007 for U.S. Appl. No. 11/013,632.

Response Under 37 CFR 1.111, dated Oct. 18, 2007 for U.S. Appl. No. 11/013,632.

Speight, J.G. "Fuel Science and Technology Handbook, Chapter 3—Composition and Properties", New York, Marcel Dekker, US 1990, p. 115.

Atanasova, P. et al (1997), Effect of Phosphorus Concentration and Method on Preparation on the Structure of the Oxide Form of Phosphorus-nickel-tungsten/alumina Hydrotreating Catalysts, Applied Catalysts A, 161, pp. 105-119.

Giles, H. N. (2003), Significance of Tests for Petroleum Products ($7^{th}$ Ed.)Rand, S. J., ASTM International, 258 pgs.

Gary, J. H. et al (2001) , Petroleum Refining Technology and Economics, 4th Ed., Marce Dekker, 441 pages.

Aboul-Seoud, A-L et al, (1999), "A Generalized Viscosity Correlation for Undefined Petroleum Fraction", Chemical Engineering Journal 72, pp. 253-256.

Tojima, M. et al (1998), "Effect of Heavy Asphaltenes on Stability of Residual Oil", Catalysis Today, 43, p. 347-351.

Pages 210-213 of the handbook titled "Advanced Inorganic Chemistry" by Cotton et al., John Wiley & Sons, 1988.

Pages 1-4 of Wikipedia on Aluminium Oxide on Jan. 20, 2009.

Platts-Methodology and Specifications Guide—Crude Oil, Latest Update Jun. 2007 (McGraw Hill); pp. 1-21.

Preliminary Amendment dated Mar. 15, 2005 (U.S. Appl. No. 11/013,553).

Office Action mailed Mar. 7, 2007 (U.S. Appl. No. 11/013,553).

Amendment and Response Under 37 CFR 1.111 dated Sep. 7, 2007 (U.S. Appl. No. 11/013,553).

Office Action mailed Nov. 21, 2007 (U.S. Appl. No. 11/013,553).

Office Action mailed Aug. 1, 2008 (U.S. Appl. No. 11/013,553).

Amendment and Response Under 37 CFR 1.111 dated May 21, 2008 (U.S. Appl. No. 11/013,553).

Petition to Revive a Patent Application Abandoned Unintentionally Under 37 CFR 1.137 (b), dated Aug. 13, 2008 for U.S. Appl. No. 11/399,162.

Preliminary Amendment dated Feb. 28, 2005 in related U.S. Appl. No. 11/013,554.

First Office Communication dated Feb. 20, 2007 for related U.S. Appl. No. 11/013,554.

Second final office communication dated Nov. 1, 2007 for related U.S. Appl. No. 11/013,554.

(56) References Cited

OTHER PUBLICATIONS

Request for Continued Examination and Response Under 37 CFR §1.114 to the second final office communication dated May 1, 2008 for related U.S. Appl. No. 11/013,554.
Office communication requesting corrected amendments dated May 7, 2008 for related U.S. Appl. No. 11/013,554.
Response Under 37 CFR §1.111 to office communication requesting corrected amendments dated Jun. 5, 2008 for related U.S. Appl. No. 11/013,554.
Third office communication dated Aug. 5, 2008 for related U.S. Appl. No. 11/013,554.
Response Under 37 CFR 1.111, dated Dec. 26, 2007 for U.S. Appl. No. 11/014,365.
Response Under 37 CFR 1.111, dated Jan. 14, 2008 for U.S. Appl. No. 11/014,363.
Response Under 37 CFR 1.111, dated Feb. 11, 2008 for U.S. Appl. No. 11/014,380.
Response Under 37 CFR 1.111, dated Feb. 21, 2008 for U.S. Appl. No. 11/014,060.

* cited by examiner

Table 1

| Property | Crude Feed | Crude Product |
|---|---|---|
| Example | 5 | 5 |
| TAN | 0.8 | 0.09 |
| API Gravity | 24.9 | 28.6 |
| Density at 15.56 °C (60 °F), g/cm$^3$ | 0.9046 | 0.8838 |
| Hydrogen, wt% | 11.68 | 12.54 |
| Carbon, wt% | 85.24 | 86.43 |
| Sulfur, wt% | 2.24 | 0.75 |
| Oxygen, wt% | 0.29 | 0.07 |
| Nitrogen, wt% | 0.19 | 0.16 |
| Total Basic Nitrogen, wt% | 0.05 | 0.05 |
| Nickel, wtppm | 27 | 7.6 |
| Vanadium, wtppm | 59 | 14.8 |
| Micro-Carbon Residue, wt% | 6.6 | 4.4 |
| $C_5$ Asphaltenes, wt% | 5.21 | 2.3 |
| Distillate, wt% | 20.5 | 22.1 |
| VGO, wt% | 31.3 | 31.8 |
| Residue, wt% | 28.3 | 25.5 |
| P-Value | 4.5 | 4.5 |
| Viscosity at 37.8 °C (100 °F), cSt | 17.4 | 14.8 |

FIG. 7

Table 2

| Property | Crude Feed | Crude Product |
|---|---|---|
| Example Number | 6 | 6 |
| TAN | 10.3 | 0.42 |
| API Gravity | 13.2 | 12.5 |
| Density at 15.56 °C (60 °F), g/cm$^3$ | 0.9776 | 0.9824 |
| Hydrogen, wt% | 11.54 | 11.71 |
| Carbon, wt% | 86.89 | 87.28 |
| Sulfur, wt% | 0.31 | 0.23 |
| Oxygen, wt% | 0.90 | 0.34 |
| Nitrogen, wt% | 0.38 | 0.39 |
| Total Basic Nitrogen, wt% | 0.14 | 0.15 |
| Nickel, wtppm | 13.7 | 10.7 |
| Vanadium, wtppm | 3.4 | 2.9 |
| Iron, wtppm | 19 | 2.5 |
| Sodium, wtppm | 37 | 24 |
| Micro-Carbon Residue, wt% | 7.2 | 6.7 |
| $C_5$ Asphaltenes, wt% | 4.8 | 4.8 |
| Distillate wt% | 17.6 | 17.8 |
| VGO wt% | 44.6 | 44.1 |
| Residue, wt% | 37.8 | 37.8 |
| P-Value | 5 | 5 |
| Viscosity at 37.8 °C (100 °F), cSt | 6880 | 3893 |

FIG. 9

Table 3

| Property | Crude Feed | Crude Product |
|---|---|---|
| Example Number | 7 | 7 |
| TAN | 3.7 | 0.16 |
| API Gravity | 15.0 | 16.2 |
| Density at 15.56 °C (60 °F), g/cm$^3$ | 0.9659 | 0.9582 |
| Hydrogen, wt% | 11.4 | 11.6 |
| Carbon, wt% | 87.1 | 87.4 |
| Sulfur, wt% | 0.43 | 0.33 |
| Oxygen, wt% | 0.42 | 0.20 |
| Nitrogen, wt% | 0.52 | 0.50 |
| Total Basic Nitrogen, wt% | 0.16 | 0.18 |
| Nickel, wtppm | 12.4 | 11.0 |
| Vanadium, wtppm | 19.2 | 15 |
| Iron, wtppm | 10.4 | 0.8 |
| Calcium, wtppm | 5.4 | 1.9 |
| Sodium, wtppm | 117 | 6 |
| Zinc, wtppm | 2.5 | 0.6 |
| Potassium, wtppm | 46 | 3 |
| Micro-Carbon Residue, wt% | 8.3 | 7.9 |
| $C_5$ Asphaltenes, wt% | | 6.3 |
| Distillate wt% | 15.6 | 19.4 |
| VGO wt% | 39.6 | 37.6 |
| Residue, wt% | 38.8 | 40.1 |
| Viscosity at 37.8 °C (100 °F), cSt | 1224 | 862 |

FIG. 10

Table 4

| Property | Crude Feed | Crude Product | Crude Product | Crude Product | Crude Product |
|---|---|---|---|---|---|
| Example Number | | 8 | 9 | 10 | 11 |
| TAN | 0.8 | 0.04 | 0.04 | 0.04 | 0.05 |
| API Gravity | 19.6 | 22.3 | 22.95 | 21.7 | 22.9 |
| Density at 15.56 °C (60 °F), g/cm$^3$ | 0.9363 | 0.9198 | 0.9162 | 0.9236 | 0.9165 |
| Hydrogen, wt% | 11.68 | 12.0 | 12.10 | 11.91 | 12.08 |
| Carbon, wt% | 85.24 | 86.10 | 86.2 | 85.90 | 86.25 |
| Sulfur, wt% | 1.91 | 1.6 | 1.3 | 1.8 | 1.3 |
| Oxygen, wt% | 0.9 | 0.15 | 0.14 | 0.15 | 0.14 |
| Nitrogen, wt% | 0.22 | 0.20 | 0.19 | 0.22 | 0.20 |
| Total Basic Nitrogen, wt% | 0.06 | NA | NA | NA | NA |
| Nickel, wtppm | 27 | 18 | 15 | 14 | 14 |
| Vanadium, wtppm | 69 | 41 | 35 | 29 | 33 |
| Micro-Carbon Residue, wt% | 7.5 | 5.8 | 5.9 | 6.5 | 6.0 |
| $C_5$ Asphaltenes, wt% | 6.0 | 4.0 | 4.0 | 3.4 | 3.9 |
| VGO, wt% | 30.0 | 34.6 | 34.6 | 35.1 | 34.8 |
| Residue, wt% | 34.9 | 31.5 | 31.2 | 31.2 | 31.0 |
| P-Value | --- | 3.1 | 3.2 | 4.5 | 3.2 |
| Hydrogen Uptake, Nm$^3$/m$^3$ | --- | 29.3 | 40.3 | 18.9 | 35.3 |
| Viscosity at 100 °F, cSt | 177 | 62.6 | 59.7 | 72.7 | 58.3 |

FIG. 11

TABLE 5

| Property | Crude Feed | Crude Product | Crude Product | Crude Product | Crude Product |
|---|---|---|---|---|---|
| Example No. | | 15 | 16 | 17 | 18 |
| Catalyst (% of total amount of catalyst in all contacting zones ) | ---- | V(25%); Mo(75%) | V(50%); Mo(50%) | V(50%); Mo/V(50%) | Pyrex Beads |
| TAN | 9.3 | 0.9 | 1.4 | 1.4 | 8 |
| API Gravity | 13.8 | 14.2 | 14.1 | 13.8 | 13.5 |
| Density at 15.56 °C (60 °F), g/cm$^3$ | 0.9740 | 0.9712 | 0.9711 | 0.9716 | 0.9758 |
| Hydrogen, wt% | 11.50 | 11.59 | 11.62 | 11.58 | 11.48 |
| Carbon, wt% | 86.83 | 87.23 | 87.26 | 87.28 | 86.80 |
| Sulfur, wt% | 0.34 | 0.29 | 0.31 | 0.32 | 0.34 |
| Oxygen, wt% | 0.90 | 0.43 | 0.30 | 0.41 | 0.72 |
| Nitrogen, wt% | 0.42 | 0.42 | 0.41 | 0.41 | 0.42 |
| Total Basic Nitrogen, wt% | 0.14 | 0.14 | 0.14 | 0.14 | 0.14 |
| Nickel, wtppm | 14 | 14 | 14 | 14 | 14 |
| Vanadium, wtppm | 4 | 4 | 4 | 4 | 4 |
| Iron, wtppm | 32 | 3 | 4 | 4 | 18 |
| Sodium, wtppm | --- | 9 | 10 | 7 | |
| Potassium, wtppm | --- | 84 | 60 | 90 | 147 |
| Calcium, wtppm | --- | 26 | 31 | 30 | 29 |
| Zinc, wtppm | --- | 9 | 4 | 3 | 5 |
| Micro-Carbon Residue, wt% | 7.4 | 7.2 | 7.2 | 7.3 | 7.9 |
| $C_5$ Asphaltenes, wt% | 5.5 | 4.1 | 4.0 | 4.1 | 5.0 |
| VGO, wt% | | 41.7 | 41.3 | 41.3 | 40.8 |
| Residue, wt% | 37.8 | 41.9 | 41.7 | 42.4 | 43.2 |
| P-Value | 5 | 5 | 5 | 5 | 5 |
| Hydrogen Uptake, Nm$^3$/m$^3$ | --- | -1.0 | 1.9 | -2.4 | -8.9 |
| Viscosity at 37.8 °C (100 °F), cSt | 6830 | 4600 | 4240 | 5156 | 7576 |

FIG. 17

Table 6

| Property | Crude Feed | Crude Product | Crude Feed | Crude Product | Crude Product |
|---|---|---|---|---|---|
| Example Number | 6 | 6 | 19 | 19 | 19 |
| LHSV, $h^{-1}$ | ---- | 1 | ---- | 12.3 | 20.7 |
| TAN | 10.3 | 0.42 | 9.3 | 4 | 5.4 |
| API Gravity | 13.2 | 12.5 | 13.8 | 14.5 | 14.3 |
| Density at 15.56 °C (60 °F), $g/cm^3$ | 0.9776 | 0.9824 | 0.9740 | 0.9695 | 0.9709 |
| Hydrogen, wt% | 11.54 | 11.71 | 11.50 | 44.68 | 11.58 |
| Carbon, wt% | 86.89 | 87.28 | 86.83 | 87.28 | 86.99 |
| Sulfur, wt% | 0.31 | 0.23 | 0.34 | 0.28 | 0.30 |
| Oxygen, wt% | 0.90 | 0.34 | --- | 0.42 | 0.72 |
| Nitrogen, wt% | 0.38 | 0.39 | 0.42 | 0.41 | 0.41 |
| Nickel, ppm | 13.7 | 10.7 | 13.5 | 12.8 | 13.2 |
| Vanadium, ppm | 3.4 | 2.9 | 3.7 | 3.3 | 3.5 |
| Sodium, wtppm | 37 | 24 | 37 | 20 | 34 |
| Calcium, wtppm | 72 | --- | 72 | 52 | 50 |
| Zinc, wtppm | 46 | --- | 46 | <0.4 | <0.4 |
| Potassium, wtppm | 320 | --- | 310 | 183 | 203 |
| Micro-Carbon Residue, wt% | 7.2 | 6.7 | 7.4 | 7.1 | 7.2 |
| $C_5$ Asphaltenes, wt% | 4.8 | 4.8 | 5.5 | 4.6 | 4.6 |
| Distillate, wt% | 17.6 | 17.8 | ---- | 18.33 | 17.97 |
| VGO, wt% | 44.6 | 44.1 | ---- | 41.8 | 41.8 |
| Residue, wt% | 37.8 | 37.8 | 37.8 | 38.6 | 39.4 |
| Viscosity at 37.8 °C (100 °F), cSt | 6880 | 3893 | 6830 | 3774 | 4276 |

FIG. 18

Table 7

| Property | Crude Feed | Crude Product | Crude Feed | Crude Product |
|---|---|---|---|---|
| Example Number | 6 | 6 | 20 | 20 |
| TAN | 10.3 | 0.42 | 9.3 | 0.7 |
| API Gravity | 13.2 | 12.5 | 13.8 | 14.7 |
| Density at 15.56 °C (60 °F), g/cm$^3$ | 0.9776 | 0.9824 | 0.9740 | 0.9678 |
| Hydrogen, wt% | 11.54 | 11.71 | 11.50 | 11.68 |
| Carbon, wt% | 86.89 | 87.28 | 86.8 | 87.42 |
| Sulfur, wt% | 0.31 | 0.23 | 0.34 | 0.24 |
| Oxygen, wt% | 0.90 | 0.34 | --- | 0.20 |
| Nitrogen, wt% | 0.38 | 0.39 | 0.42 | 0.40 |
| Nickel, ppm | 13.7 | 10.7 | 13.5 | 10.9 |
| Vanadium, ppm | 3.4 | 2.9 | 3.7 | 3.3 |
| Iron, ppm | 19 | 2.5 | 32 | 13 |
| Sodium, wtppm | 37 | 24 | 37 | 9.8 |
| Potassium, wtppm | 320 | ---- | 310 | 175 |
| Micro-Carbon Residue, wt% | 7.2 | 6.7 | 7.4 | 6.8 |
| $C_5$ Asphaltenes, wt% | 4.8 | 4.8 | 5.5 | 3.9 |
| Distillate, wt% | 17.6 | 17.8 | ---- | 17.8 |
| VGO, wt% | 44.6 | 44.1 | ----- | 42.8 |
| Residue, wt% | 37.8 | 37.8 | 37.8 | 40.1 |
| P-Value | 5 | 5 | 5 | 5 |
| Viscosity at 37.8 °C (100 °F), cSt | 6880 | 3893 | 6830 | 3781 |

FIG. 19

SYSTEMS, METHODS, AND CATALYSTS FOR PRODUCING A CRUDE PRODUCT

PRIORITY CLAIM

This application claims priority to U.S. patent application Ser. No. 11/013,576 entitled "SYSTEMS, METHODS, AND CATALYSTS FOR PRODUCING A CRUDE PRODUCT", filed Dec. 16, 2004, which in turn claims priority to U.S. Provisional Patent Application No. 60/531,506 entitled "METHODS OF PREPARING IMPROVED CRUDE FEED" filed on Dec. 19, 2003, and to U.S. Provisional Patent Application No. 60/618,681 entitled "SYSTEMS, METHODS, AND CATALYSTS FOR PRODUCING A CRUDE PRODUCT" filed on Oct. 14, 2004.

FIELD OF THE INVENTION

The present invention generally relates to systems, methods, and catalysts for treating crude feed, and to compositions that can be produced using such systems, methods, and catalysts. More particularly, certain embodiments described herein relate to systems, methods, and catalysts for conversion of a crude feed to a total product, wherein the total product includes a crude product that is a liquid mixture at 25° C. and 0.101 MPa and has one or more properties that are changed relative to the respective property of the crude feed.

DESCRIPTION OF RELATED ART

Crudes that have one or more unsuitable properties that do not allow the crudes to be economically transported, or processed using conventional facilities, are commonly referred to as "disadvantaged crudes".

Disadvantaged crudes may include acidic components that contribute to the total acid number ("TAN") of the crude feed. Disadvantaged crudes with a relatively high TAN may contribute to corrosion of metal components during transporting and/or processing of the disadvantaged crudes. Removal of acidic components from disadvantaged crudes may involve chemically neutralizing acidic components with various bases. Alternately, corrosion-resistant metals may be used in transportation equipment and/or processing equipment. The use of corrosion-resistant metal often involves significant expense, and thus, the use of corrosion-resistant metal in existing equipment may not be desirable. Another method to inhibit corrosion may involve addition of corrosion inhibitors to disadvantaged crudes before transporting and/or processing of the disadvantaged crudes. The use of corrosion inhibitors may negatively affect equipment used to process the crudes and/or the quality of products produced from the crudes.

Disadvantaged crudes often contain relatively high levels of residue. Such high levels of residue tend to be difficult and expensive to transport and/or process using conventional facilities.

Disadvantaged crudes often contain organically bound heteroatoms (for example, sulfur, oxygen, and nitrogen). Organically bound heteroatoms may, in some situations, have an adverse effect on catalysts.

Disadvantaged crudes may include relatively high amounts of metal contaminants, for example, nickel, vanadium, and/or iron. During processing of such crudes, metal contaminants and/or compounds of metal contaminants, may deposit on a surface of the catalyst or in the void volume of the catalyst. Such deposits may cause a decline in the activity of the catalyst.

Coke may form and/or deposit on catalyst surfaces at a rapid rate during processing of disadvantaged crudes. It may be costly to regenerate the catalytic activity of a catalyst contaminated with coke. High temperatures used during regeneration may also diminish the activity of the catalyst and/or cause the catalyst to deteriorate.

Disadvantaged crudes may include metals in metal salts of organic acids (for example, calcium, potassium and/or sodium). Metals in metal salts of organic acids are not typically separated from disadvantaged crudes by conventional processes, for example, desalting and/or acid washing.

Processes are often encountered in conventional processes when metals in metal salts of organic acids are present. In contrast to nickel and vanadium, which typically deposit near the external surface of the catalyst, metals in metal salts of organic acids may deposit preferentially in void volumes between catalyst particles, particularly at the top of the catalyst bed. The deposit of contaminants, for example, metals in metal salts of organic acids, at the top of the catalyst bed generally results in an increase in pressure drop through the bed and may effectively plug the catalyst bed. Moreover, the metals in metal salts of organic acids may cause rapid deactivation of catalysts.

Disadvantaged crudes may include organic oxygen compounds. Treatment facilities that process disadvantaged crudes with an oxygen content of at least 0.002 grams of oxygen per gram of disadvantaged crude may encounter problems during processing. Organic oxygen compounds, when heated during processing, may form higher oxidation compounds (for example, ketones and/or acids formed by oxidation of alcohols, and/or acids formed by oxidation of ethers) that are difficult to remove from the treated crude and/or may corrode/contaminate equipment during processing and cause plugging in transportation lines.

Disadvantaged crudes may include hydrogen deficient hydrocarbons. When processing of hydrogen deficient hydrocarbons, consistent quantities of hydrogen generally need to be added, particularly if unsaturated fragments resulting from cracking processes are produced. Hydrogenation during processing, which typically involves the use of an active hydrogenation catalyst, may be needed to inhibit unsaturated fragments from forming coke. Hydrogen is costly to produce and/or costly to transport to treatment facilities.

Disadvantaged crudes also tend to exhibit instability during processing in conventional facilities. Crude instability tends to result in phase separation of components during processing and/or formation of undesirable by-products (for example, hydrogen sulfide, water, and carbon dioxide).

Conventional processes often lack the ability to change a selected property in a disadvantaged crude without also significantly changing other properties in the disadvantaged crude. For example, conventional processes often lack the ability to significantly reduce TAN in a disadvantaged crude while, at the same time, only changing by a desired amount the content of certain components (such as sulfur or metal contaminants) in the disadvantaged crude.

Some processes for improving the quality of crude include adding a diluent to disadvantaged crudes to lower the weight percent of components contributing to the disadvantaged properties. Adding diluent, however, generally increases costs of treating disadvantaged crudes due to the costs of diluent and/or increased costs to handle the disadvantaged crudes. Addition of diluent to a disadvantaged crude may, in some situations, decrease stability of such crude.

U.S. Pat. No. 6,547,957 to Sudhakar et al.; U.S. Pat. No. 6,277,269 to Meyers et al.; U.S. Pat. No. 6,063,266 to Grande et al.; U.S. Pat. No. 5,928,502 to Bearden et al.; U.S. Pat. No.

5,914,030 to Bearden et al.; U.S. Pat. No. 5,897,769 to Trachte et al.; U.S. Pat. No. 5,871,636 to Trachte et al.; and U.S. Pat. No. 5,851,381 to Tanaka et al., all of which are incorporated herein by reference, describe various processes, systems, and catalysts for processing crudes. The processes, systems, and catalysts described in these patents, however, have limited applicability because of many of the technical problems set forth above.

In sum, disadvantaged crudes generally have undesirable properties (for example, relatively high TAN, a tendency to become unstable during treatment, and/or a tendency to consume relatively large amounts of hydrogen during treatment). Other undesirable properties include relatively high amounts of undesirable components (for example, residue, organically bound heteroatoms, metal contaminants, metals in metal salts of organic acids, and/or organic oxygen compounds). Such properties tend to cause problems in conventional transportation and/or treatment facilities, including increased corrosion, decreased catalyst life, process plugging, and/or increased usage of hydrogen during treatment. Thus, there is a significant economic and technical need for improved systems, methods, and/or catalysts for conversion of disadvantaged crudes into crude products with more desirable properties. There is also a significant economic and technical need for systems, methods, and/or catalysts that can change selected properties in a disadvantaged crude while only selectively changing other properties in the disadvantaged crude.

SUMMARY OF THE INVENTION

Inventions described herein generally relate to systems, methods, and catalyst for conversion of a crude feed to a total product comprising a crude product and, in some embodiments, non-condensable gas. Inventions described herein also generally relate to compositions that have novel combinations of components therein. Such compositions can be obtained by using the systems and methods described herein.

In some embodiments, the invention provides a method of producing a crude product, comprising: contacting a crude feed with one or more catalysts to produce a total product that includes the crude product, wherein the crude product is a liquid mixture at 25° C. and 0.101 MPa, the crude feed having a TAN of at least 0.3, and at least one of the catalysts having a pore size distribution with a median pore diameter in a range from about 90 Å to about 180 Å, with at least 60% of the total number of pores in the pore size distribution having a pore diameter within about 45 Å of the median pore diameter, wherein pore size distribution is as determined by ASTM Method [D4282] D4284; and controlling contacting conditions such that the crude product has a TAN of at most 90% of the TAN of the crude feed, wherein TAN is as determined by ASTM Method D664.

In some embodiments, the invention provides a method of producing a crude product, comprising: contacting a crude feed with one or more catalysts to produce a total product that includes the crude product, wherein the crude product is a liquid mixture at 25° C. and 0.101 MPa, the crude feed having a TAN of at least 0.3, at least one of the catalysts having a pore size distribution with a median pore diameter of at least 90 Å, as determined by ASTM Method [D4282] D4284, and the catalyst having the pore size distribution having, per gram of catalyst, from about 0.0001 grams to about 0.08 grams of: molybdenum, one or more molybdenum compounds, calculated as weight of molybdenum, or mixtures thereof; and controlling contacting conditions such that the crude product has a TAN of at most 90% of the TAN of the crude feed, wherein TAN is as determined by ASTM Method D664.

In certain embodiments, the invention provides a method of producing a crude product, comprising: contacting a crude feed with one or more catalysts to produce a total product that includes the crude product, wherein the crude product is a liquid mixture at 25° C. and 0.101 MPa, the crude feed having a TAN of at least 0.3, as determined by ASTM D664, at least one of the catalysts having a pore size distribution with a median pore diameter of at least 180 Å, as determined by ASTM Method [D4282] D4284, and the catalyst having the pore size distribution comprising one or more metals from Column 6 of the Periodic Table, one or more compounds of one or more metals from Column 6 of the Periodic Table, or mixtures thereof; and controlling contacting conditions such that the crude product has a TAN of at most 90% of the TAN of the crude feed, wherein TAN is as determined by ASTM Method D664.

In certain embodiments, the invention provides a method of producing a crude product, comprising: contacting a crude feed with one or more catalysts to produce a total product that includes the crude product, wherein the crude product is a liquid mixture at 25° C. and 0.101 MPa, the crude feed having TAN of at least 0.3, as determined by ASTM Method D664, and at least one of the catalysts comprises: (a) one or more metals from Column 6 of the Periodic Table, one or more compounds of one or more metals from Column 6 of the Periodic Table, or mixtures thereof; and (b) one or more metals from Column 10 of the Periodic Table, one or more compounds of one or more metals from Column 10 of the Periodic Table, or mixtures thereof, and wherein a molar ratio of total Column 10 metal to total Column 6 metal is in a range from about 1 to about 10; and controlling contacting conditions such that the crude product has a TAN of at most 90% of the TAN of the crude feed, wherein TAN is as determined by ASTM Method D664.

In some embodiments, the invention provides a method of producing a crude product, comprising: contacting a crude feed with one or more catalysts to produce a total product that includes the crude product, wherein the crude product is a liquid mixture at 25° C. and 0.101 MPa, the crude feed having a TAN of at least 0.3, and the one or more catalysts comprising: (a) a first catalyst, the first catalyst having, per gram of first catalyst, from about 0.0001 to about 0.06 grams of: one or more metals from Column 6 of the Periodic Table, one or more compounds of one or more metals from Column 6 of the Periodic Table, calculated as weight of metal, or mixtures thereof; and (b) a second catalyst, the second catalyst having, per gram of second catalyst, at least 0.02 grams of: one or more metals from Column 6 of the Periodic Table, one or more compounds of one or more metals from Column 6 of the Periodic Table, calculated as weight of metal, or mixtures thereof; and controlling contacting conditions such that the crude product has a TAN of at most 90% of the TAN of the crude feed, wherein TAN is as determined by ASTM Method D664.

In certain embodiments, the invention provides a catalyst composition, comprising: (a) one or more metals from Column 5 of the Periodic Table, one or more compounds of one or more metals from Column 5 of the Periodic Table, or mixtures thereof; (b) a support material having a theta alumina content of at least 0.1 grams of theta alumina per gram of support material, as determined by x-ray diffraction; and wherein the catalyst has a pore size distribution with a median pore diameter of at least 230 Å, as determined by ASTM Method [D4282] D4284.

In certain embodiments, the invention provides a catalyst composition, comprising: (a) one or more metals from Column 6 of the Periodic Table, one or more compounds of one or more metals from Column 6 of the Periodic Table, or mixtures thereof; (b) a support material having a theta alumina content of at least 0.1 grams of theta alumina per gram of support material, as determined by x-ray diffraction; and wherein the catalyst has a pore size distribution with a median pore diameter of at least 230 Å, as determined by ASTM Method [D4282] D4284.

In certain embodiments, the invention provides a catalyst composition, comprising: (a) one or more metals from Column 5 of the Periodic Table, one or more compounds of one or more metals from Column 5 of the Periodic Table, one or more metals from Column 6 of the Periodic Table, one or more compounds of one or more metals from Column 6 of the Periodic Table, or mixtures thereof; (b) a support material having a theta alumina content of at least 0.1 grams of theta alumina per gram of support material, as determined by x-ray diffraction; and wherein the catalyst has a pore size distribution with a median pore diameter of at least 230 Å, as determined by ASTM Method [D4282] D4284.

In some embodiments, the invention provides a method of producing a catalyst, comprising: combining a support with one or more metals to form a support/metal mixture, wherein the support comprises theta alumina, and one or more of the metals comprising one or more metals from Column 5 of the Periodic Table, one or more compounds of one or more metals from Column 5 of the Periodic Table, or mixtures thereof; heat treating the theta alumina support/metal mixture at a temperature of at least 400° C.; and forming the catalyst, wherein the catalyst has a pore size distribution with a median pore diameter of at least 230 Å, as determined by ASTM Method [D4282] D4284.

In some embodiments, the invention provides a method of producing a catalyst, comprising: combining a support with one or more metals to form a support/metal mixture, wherein the support comprises theta alumina, and one or more of the metals comprising one or more metals from Column 6 of the Periodic Table, one or more compounds of one or more metals from Column 6 of the Periodic Table, or mixtures thereof; heat treating the theta alumina support/metal mixture at a temperature of at least 400° C.; and forming the catalyst, wherein the catalyst has a pore size distribution with a median pore diameter of at least 230 Å, as determined by ASTM Method [D4282] D4284.

In certain embodiments, the invention provides a method of producing a crude product, comprising: contacting a crude feed with one or more catalysts to produce a total product that includes the crude product, wherein the crude product is a liquid mixture at 25° C. and 0.101 MPa, the crude feed having a TAN of at least 0.3, at least one of the catalysts having a pore size distribution with a median pore diameter of at least 180 Å, as determined by ASTM Method [D4282] D4284, and the catalyst having the pore size distribution comprising theta alumina and one or more metals from Column 6 of the Periodic Table, one or more compounds of one or more metals from Column 6 of the Periodic Table, or mixtures thereof; and controlling contacting conditions such that the crude product has a TAN of at most 90% of the TAN of the crude feed, wherein TAN is as determined by ASTM Method D664.

In certain embodiments, the invention provides a method of producing a crude product, comprising: contacting a crude feed with one or more catalysts in the presence of a hydrogen source to produce a total product that includes the crude product, wherein the crude product is a liquid mixture at 25° C. and 0.101 MPa, the crude feed having a TAN of at least 0.3, the crude feed having an oxygen content of at least 0.0001 grams of oxygen per gram of crude feed, and at least one of the catalysts having a pore size distribution with a median pore diameter of at least 90 Å, as determined by ASTM Method [D4282] D4284; and controlling contacting conditions to reduce TAN such that the crude product has a TAN of at most 90% of the TAN of the crude feed, and to reduce a content of organic oxygen containing compounds such that the crude product has an oxygen content of at most 90% of the oxygen content of the crude feed, wherein TAN is as determined by ASTM Method D664, and oxygen content is as determined by ASTM Method E385.

In some embodiments, the invention provides a method of producing a crude product, comprising: contacting a crude feed with one or more catalysts to produce a total product that includes the crude product, wherein the crude product is a liquid mixture at 25° C. and 0.101 MPa, the crude feed having a TAN of at least 0.1, and at least one of the catalysts having, per gram of catalyst, at least 0.001 grams of: one or more metals from Column 6 of the Periodic Table, one or more compounds of one or more metals from Column 6 of the Periodic Table, calculated as weight of metal, or mixtures thereof; and controlling contacting conditions such that a liquid hourly space velocity in a contacting zone is over 10 $h^{-1}$, and the crude product has a TAN of at most 90% of the TAN of the crude feed, wherein TAN is as determined by ASTM Method D664.

In certain embodiments, the invention provides a method of producing a crude product, comprising: contacting a crude feed with one or more catalysts in the presence of a hydrogen source to produce a total product that includes the crude product, wherein the crude product is a liquid mixture at 25° C. and 0.101 MPa, the crude feed having a TAN of at least 0.1, the crude feed having a sulfur content of at least 0.0001 grams of sulfur per gram of crude feed, and at least one of the catalysts comprising one or more metals from Column 6 of the Periodic Table, one or more compounds of one or more metals from Column 6 of the Periodic Table, or mixtures thereof; and controlling contacting conditions such that, during contacting, the crude feed uptakes molecular hydrogen at a selected rate to inhibit phase separation of the crude feed during contacting, liquid hourly space velocity in one or more contacting zones is over 10 $h^{-1}$, the crude product having a TAN of at most 90% of the TAN of the crude feed, and the crude product having a sulfur content of about 70-130% of the sulfur content of the crude feed, wherein TAN is as determined by ASTM Method D664, and sulfur content is as determined by ASTM Method D4294.

In some embodiments, the invention provides a method of producing a crude product, comprising: contacting a crude feed with one or more catalysts in the presence of a gaseous hydrogen source to produce a total product that includes the crude product, wherein the crude product is a liquid mixture at 25° C. and 0.101 MPa; and controlling contacting conditions such that the crude feed, during contact, uptakes hydrogen at a selected rate to inhibit phase separation of the crude feed during contact.

In certain embodiments, the invention provides a method of producing a crude product, comprising: contacting a crude feed with hydrogen in the presence of one or more catalysts to produce a total product that includes the crude product, wherein the crude product is a liquid mixture at 25° C. and 0.101 MPA; and controlling contacting conditions such that the crude feed is contacted with hydrogen at a first hydrogen uptake condition and then at a second hydrogen uptake condition, the first hydrogen uptake condition being different from the second hydrogen uptake condition, and net hydrogen uptake in the first hydrogen uptake condition is controlled to inhibit P-value of a crude feed/total product mixture from decreasing below 1.5, and one or more properties of the crude product change by at most 90% relative to the respective one or more properties of the crude feed.

In some embodiments, the invention provides a method of producing a crude product, comprising: contacting a crude feed with one or more catalysts at a first temperature followed by contacting at a second temperature to produce a total product that includes the crude product, wherein the crude product is a liquid mixture at 25° C. at 0.101 MPa, the crude feed having a TAN of at least 0.3; and controlling contacting conditions such that the first contacting temperature is at least 30° C. lower than the second contacting temperature, and the crude product has a TAN of at most 90% relative to the TAN of the crude feed, wherein TAN is as determined by ASTM Method D664.

In some embodiments, the invention provides a method of producing a crude product, comprising: contacting a crude feed with one or more catalysts to produce a total product that includes the crude product, wherein the crude product is a liquid mixture at 25° C. and 0.101 MPa, the crude feed having a TAN of at least 0.3, the crude feed having a sulfur content of at least 0.0001 grams of sulfur per gram of crude feed, and at least one of the catalysts comprising one or more metals from Column 6 of the Periodic Table, one or more compounds of one or more metals from Column 6 of the Periodic Table, or mixtures thereof; and controlling contacting conditions such that the crude product has a TAN of at most 90% of the TAN of the crude feed, and the crude product has a sulfur content of about 70-130% of the sulfur content of the crude feed, wherein TAN is as determined by ASTM Method D664, and sulfur content is as determined by ASTM Method D4294.

In certain embodiments, the invention provides a method of producing a crude product, comprising: contacting a crude feed with one or more catalysts to produce a total product that includes the crude product, wherein the crude product is a liquid mixture at 25° C. and 0.101 MPa, the crude feed having a TAN of at least 0.1, the crude feed having a residue content of at least 0.1 grams of residue per gram of crude feed, and at least one of the catalysts comprising one or more metals from Column 6 of the Periodic Table, one or more compounds of one or more metals from Column 6 of the Periodic Table, or mixtures thereof; and controlling contacting conditions such that the crude product has a TAN of at most 90% of the TAN of the crude feed, the crude product has a residue content of about 70-130% of the residue content of the crude feed, and wherein TAN is as determined by ASTM Method D664, and residue content is as determined by ASTM Method D5307.

In some embodiments, the invention provides a method of producing a crude product, comprising: contacting a crude feed with one or more catalysts to produce a total product that includes the crude product, wherein the crude product is a liquid mixture at 25° C. and 0.101 MPa, the crude feed having a TAN of at least 0.1, the crude feed having a VGO content of at least 0.1 grams of VGO per gram of crude feed, and at least one of the catalysts comprising one or more metals from Column 6 of the Periodic Table, one or more compounds of one or more metals from Column 6 of the Periodic Table, or mixtures thereof; and controlling contacting conditions such that the crude product has a TAN of at most 90% of the TAN of the crude feed, the crude product has a VGO content of about 70-130% of the VGO content of the crude feed, and wherein VGO content is as determined by ASTM Method D5307.

In certain embodiments, the invention provides a method of producing a crude product, comprising: contacting a crude feed with one or more catalysts to produce a total product that includes the crude product, wherein the crude product is a liquid mixture at 25° C. and 0.101 MPa, the crude feed having a TAN of at least 0.3, and at least one of the catalysts is obtainable by: combining a support with one or more metals from Column 6 of the Periodic Table, one or more compounds of one or more metals from Column 6 of the Periodic Table, or mixtures thereof, to produce a catalyst precursor; and forming the catalyst by heating the catalyst precursor in the presence of one or more sulfur containing compounds at a temperature below 500° C.; and controlling contacting conditions such that the crude product has a TAN of at most 90% of the TAN of the crude feed.

In some embodiments, the invention provides a method of producing a crude product, comprising: contacting a crude feed with one or more catalysts to produce a total product that includes the crude product, wherein the crude product is a liquid mixture at 25° C. and 0.101 MPa, the crude feed having a viscosity of at least 10 cSt at 37.8° C. (100° F.), the crude feed having an API gravity of at least 10, and at least one of the catalysts comprising one or more metals from Column 6 of the Periodic Table, one or more compounds of one or more metals from Column 6 of the Periodic Table, or mixtures thereof; and controlling contacting conditions such that the crude product has a viscosity at 37.8° C. of at most 90% of the viscosity of the crude feed at 37.8° C., and the crude product having an API gravity of about 70-130% of the API gravity of the crude feed, wherein API gravity is as determined by ASTM Method D6822, and viscosity is as determined by ASTM Method D2669.

In some embodiments, the invention provides a method of producing a crude product, comprising: contacting a crude feed with one or more catalysts to produce a total product that includes the crude product, wherein the crude product is a liquid mixture at 25° C. and 0.101 MPa, the crude feed having a TAN of at least 0.1, and the one or more catalysts comprising: at least one catalyst comprising vanadium, one or more compounds of vanadium, or mixtures thereof; and an additional catalyst, wherein the additional catalyst comprises one or more Column 6 metals, one or more compounds of one or more Column 6 metals, or combinations thereof; and controlling contacting conditions such that the crude product has a TAN of at most 90% of the TAN of the crude feed, wherein TAN is as determined by ASTM Method D664.

In certain embodiments, the invention provides a method of producing a crude product, comprising: contacting a crude feed with one or more catalysts to produce a total product that includes the crude product, wherein the crude product is a liquid mixture at 25° C. and 0.101 MPa, and the crude feed has a TAN of at least 0.1; generating hydrogen during the contacting; and controlling contacting conditions such that the crude product has a TAN of at most 90% of the TAN of the crude feed, wherein TAN is as determined by ASTM Method D664.

In some embodiments, the invention provides a method of producing a crude product, comprising: contacting a crude feed with one or more catalysts to produce a total product that includes the crude product, wherein the crude product is a liquid mixture at 25° C. and 0.101 MPa, the crude feed having a TAN of at least 0.1, and at least one of the catalysts comprising vanadium, one or more compounds of vanadium, or mixtures thereof; and controlling contacting conditions such that a contacting temperature is at least 200° C., and the crude product has a TAN of at most 90% of the TAN of the crude feed, wherein TAN is as determined by ASTM Method D664.

In certain embodiments, the invention provides a method of producing a crude product, comprising: contacting a crude feed with one or more catalysts to produce a total product that includes the crude product, wherein the crude product is a liquid mixture at 25° C. and 0.101 MPa, the crude feed having a TAN of at least 0.1, and at least one of the catalysts comprising vanadium, one or more compounds of vanadium, or mixtures thereof; providing a gas comprising a hydrogen source during contacting, the gas flow being provided in a direction that is counter to the flow of the crude feed; and controlling contacting conditions such that the crude product has a TAN of at most 90% of the TAN of the crude feed, wherein TAN is as determined by ASTM Method D664.

In some embodiments, the invention provides a method of producing a crude product, comprising: contacting a crude feed with one or more catalysts to produce a total product that includes the crude product, wherein the crude product is a liquid mixture at 25° C. and 0.101 MPa, the crude feed having, per gram of crude feed, a total Ni/V/Fe content of at least 0.00002 grams, at least one of the catalysts comprising vanadium, one or more compounds of vanadium, or mixtures thereof, and the vanadium catalyst having a pore size distribution with a median pore diameter of least 180 Å; and controlling contacting conditions such that the crude product has a total Ni/V/Fe content of at most 90% of the Ni/V/Fe content of the crude feed, wherein Ni/V/Fe content is as determined by ASTM Method D5708.

In certain embodiments, the invention provides a method of producing a crude product, comprising: contacting a crude feed with one or more catalysts to produce a total product that includes the crude product, wherein the crude product is a liquid mixture at 25° C. and 0.101 MPa, at least one of the catalysts comprising vanadium, one or more compounds of vanadium, or mixtures thereof, the crude feed comprising one or more alkali metal salts of one or more organic acids, one or more alkaline-earth metal salts of one or more organic acids, or mixtures thereof, and the crude feed having, per gram of crude feed, a total content of alkali metal, and alkaline-earth metal, in metal salts of organic acids of at least 0.00001 grams; and controlling contacting conditions such that the crude product has a total content of alkali metal, and alkaline-earth metal, in the metal salts of organic acids of at most 90% of the content of alkali metal, and alkaline-earth metal, in metal salts of organic acids in the crude feed, wherein content of alkali metal, and alkaline-earth metal, in metal salts of organic acids is determined by ASTM Method D1318.

In some embodiments, the invention provides a method of producing a crude product, comprising: contacting a crude feed with one or more catalysts to produce a total product that includes the crude product, wherein the crude product is a liquid mixture at 25° C. and 0.101 MPa, the crude feed comprising one or more alkali metal salts of one or more organic acids, one or more alkaline-earth metal salts of one or more organic acids, or mixtures thereof, the crude feed having, per gram of crude feed, a total content of alkali metal, and alkaline-earth metal, in metal salts of organic acids of at least 0.00001 grams, and at least one of the catalysts having a pore size distribution with a median pore diameter in a range from about 90 Å to about 180 Å, with at least 60% of the total number of pores in the pore size distribution having a pore diameter within about 45 Å of the median pore diameter, wherein pore size distribution is as determined by ASTM Method [D4282] D4284; and controlling contacting conditions such that the crude product has a total content of alkali metal, and alkaline-earth metal, in metal salts of organic acids of at most 90% of the content of alkali metal, and alkaline-earth metal, in metal salts of organic acids of the crude feed, wherein content of alkali metal, and alkaline-earth metal, in metal salts of organic acids is as determined by ASTM Method D1318.

In certain embodiments, the invention provides a method of producing a crude product, comprising: contacting a crude feed with one or more catalysts to produce a total product that includes the crude product, wherein the crude product is a liquid mixture at 25° C. and 0.101 MPa, the crude feed having, per gram of crude feed, a total Ni/V/Fe content of at least 0.00002 grams, and at least one of the catalysts having a pore size distribution with a median pore diameter in a range from about 90 Å to about 180 Å, with at least 60% of the total number of pores in the pore size distribution having a pore diameter within about 45 Å of the median pore diameter, wherein pore size distribution is as determined by ASTM Method [D4282] D4284; and controlling contacting conditions such that the crude product has a total Ni/V/Fe content of at most 90% of the Ni/V/Fe content of the crude feed, wherein Ni/V/Fe content is as determined by ASTM Method D5708.

In some embodiments, the invention provides a method of producing a crude product, comprising: contacting a crude feed with one or more catalysts to produce a total product that includes the crude product, wherein the crude product is a liquid mixture at 25° C. and 0.101 MPa, the crude feed having a total content of alkali metals, and alkaline-earth metals, in metal salts of organic acids of at least 0.00001 grams per gram of crude feed, at least one the catalysts having a pore size distribution with a median pore diameter of at least 180 Å, as determined by ASTM Method [D4282] D4284, and the catalyst having the pore size distribution comprising one or more metals from Column 6 of the Periodic Table, one or more compounds of one or more metals from Column 6 of the Periodic Table, or mixtures thereof; and controlling contacting conditions such that the crude product has a total content of alkali metal, and alkaline-earth metal, in metal salts of organic acids of at most 90% of the content of alkali metal, and alkaline-earth metal, in metal salts of organic acids in the crude feed, wherein content of alkali metal, and alkaline-earth metal, in metal salts of organic acids is as determined by ASTM Method D1318.

In some embodiments, the invention provides a method of producing a crude product, comprising: contacting a crude feed with one or more catalysts to produce a total product that includes the crude product, wherein the crude product is a liquid mixture at 25° C. and 0.101 MPa, the crude feed comprising one or more alkali metal salts of one or more organic acids, one or more alkaline-earth metal salts of one or more organic acids, or mixtures thereof, and the crude feed having, per gram of crude feed, a total content of alkali metals, and alkaline-earth metals in metal salts of organic acids of at least 0.00001 grams, at least one of the catalysts having a pore size distribution with a median pore diameter of at least 230 Å, as determined by ASTM Method [D4282] D4284, and the catalyst having a pore size distribution comprising one or more metals from Column 6 of the Periodic Table, one or more compounds of one or more metals from Column 6 of the Periodic Table, or mixtures thereof; and controlling contacting conditions such that the crude product has a total content of alkali metal, and alkaline-earth metal, in metal salts of organic acids of at most 90% of the content of alkali metal, and alkaline-earth metal, in metal salts of organic acids in the crude feed, wherein content of alkali metal, and alkaline-earth metal, in metal salts of organic acids is as determined by ASTM Method D1318.

In certain embodiments, the invention provides a method of producing a crude product, comprising: contacting a crude feed with one or more catalysts to produce a total product that includes the crude product, wherein the crude product is a liquid mixture at 25° C. and 0.101 MPa, the crude feed having a total Ni/V/Fe content of at least 0.00002 grams of Ni/V/Fe per gram of crude feed, at least one of the catalysts having a pore size distribution with a median pore diameter of at least 230 Å, as determined by ASTM Method [D4282] D4284, and the catalyst having a pore size distribution comprising one or more metals from Column 6 of the Periodic Table, one or more compounds of one or more metals from Column 6 of the Periodic Table, or mixtures thereof; and controlling contacting conditions such that the crude product has a total Ni/V/Fe content of at most 90% of the Ni/V/Fe content of the crude feed, wherein Ni/V/Fe content is as determined by ASTM Method D5708.

In some embodiments, the invention provides a method of producing a crude product, comprising: contacting a crude feed with one or more catalysts to produce a total product that includes the crude product, wherein the crude product is a liquid mixture at 25° C. and 0.101 MPa, the crude feed comprising one or more alkali metal salts of one or more organic acids, one or more alkaline-earth metal salts of one or more organic acids, or mixtures thereof, the crude feed having a total content, per gram of crude feed, of alkali metal, and alkaline-earth metal, in metal salts of organic acids of at least 0.00001 grams, at least one of the catalysts having a pore size distribution with a median pore diameter of at least 90 Å, as determined by ASTM Method [D4282] D4284, and the catalyst having the pore size distribution has a total molybdenum content, per gram of catalyst, from about 0.0001 grams to about 0.3 grams of: molybdenum, one or more molybdenum compounds, calculated as weight of molybdenum, or mixtures thereof; and controlling contacting conditions such that the crude product has a total content of alkali metal, and alkaline-earth metal, in metal salts of organic acids of at most 90% of the content of alkali metal, and alkaline-earth metal, in metal salts of organic acids in the crude feed, wherein content of alkali metal, and alkaline-earth metal, in metal salts of organic acids is as determined by ASTM Method D1318.

In certain embodiments, the invention provides a method of producing a crude product, comprising: contacting a crude feed with one or more catalysts to produce a total product that includes the crude product, wherein the crude product is a liquid mixture at 25° C. and 0.101 MPa, the crude feed having TAN of at least 0.3 and the crude feed having, per gram of crude feed, a total Ni/V/Fe content of at least 0.00002 grams, at least one of the catalysts having a pore size distribution with a median pore diameter of at least 90 Å, as determined by ASTM Method [D4282] D4284, and the catalyst having a total molybdenum content, per gram of catalyst, from about 0.0001 grams to about 0.3 grams of: molybdenum, one or more compounds of molybdenum, calculated as weight of molybdenum, or mixtures thereof; and controlling contacting conditions such that the crude product has a TAN of at most 90% of the TAN of the crude feed and the crude product has a total Ni/V/Fe content of at most 90% of the Ni/V/Fe content of the crude feed, wherein Ni/V/Fe content is as determined by ASTM Method D5708, and TAN is as determined by ASTM Method D644.

In some embodiments, the invention provides a method of producing a crude product, comprising: contacting a crude feed with one or more catalysts to produce a total product that includes the crude product, wherein the crude product is a liquid mixture at 25° C. and 0.101 MPa, the crude feed comprising one or more alkali metal salts of one or more organic acids, one or more alkaline-earth metal salts of one or more organic acids, or mixtures thereof, and the crude feed having a total content, per gram of crude feed, of alkali metal, and alkaline-earth metal, in metal salts of organic acids of at least 0.00001 grams, and at least one of the catalysts comprising: (a) one or more metals from Column 6 of the Periodic Table, one or more compounds of one or more metals from Column 6 of the Periodic Table, or mixtures thereof; and (b) one or more metals from Column 10 of the Periodic Table, one or more compounds of one or more metals from Column 10 of the Periodic Table, or mixtures thereof, wherein a molar ratio of total Column 10 metal to total Column 6 metal is in a range from about 1 to about 10; and controlling contacting conditions such that the crude product has a total content of alkali metal, and alkaline-earth metal, in metal salts of organic acids of at most 90% of the content of alkali metal, and alkaline-earth metal, in metal salts of organic acids in the crude feed, wherein content of alkali metal, and alkaline-earth metal, in metal salts of organic acids is as determined by ASTM Method D1318.

In certain embodiments, the invention provides a method of producing a crude product, comprising: contacting a crude feed with one or more catalysts to produce a total product that includes the crude product, wherein the crude product is a liquid mixture at 25° C. and 0.101 MPa, the crude feed having a total Ni/V/Fe content of at least 0.00002 grams of Ni/V/Fe per gram of crude feed, and at least one of the catalysts comprises: (a) one or more metals from Column 6 of the Periodic Table, one or more compounds of one or more metals from Column 6 of the Periodic Table, or mixtures thereof; and (b) one or more metals from Column 10 of the Periodic Table, one or more compounds of one or more metals from Column 10 of the Periodic Table, or mixtures thereof, wherein a molar ratio of total Column 10 metal to total Column 6 metal is in a range from about 1 to about 10; and controlling contacting conditions such that the crude product has a total Ni/V/Fe content of at most 90% of the Ni/V/Fe content of the crude feed, wherein Ni/V/Fe content is as determined by ASTM Method D5708.

In some embodiments, the invention provides a method of producing a crude product, comprising: contacting a crude feed with one or more catalysts to produce a total product that includes the crude product, wherein the crude product is a liquid mixture at 25° C. and 0.101 MPa, the crude feed comprising one or more alkali metal salts of one or more organic acids, one or more alkaline-earth metal salts of one or more organic acids, or mixtures thereof, the crude feed having, per gram of crude feed, a total content of alkali metal, and alkaline-earth metal, in metal salts of organic acids of at least 0.00001 grams, and the one or more catalysts comprising: (a) a first catalyst, the first catalyst having, per gram of first catalyst, from about 0.0001 to about 0.06 grams, of: one or more metals from Column 6 of the Periodic Table, one or more compounds of one or more metals from Column 6 of the Periodic Table, calculated as weight of metal, or mixtures thereof; and (b) a second catalyst, the second catalyst having, per gram of second catalyst, at least 0.02 grams of: one or more metals from Column 6 of the Periodic Table, one or more compounds of one or more metals from Column 6 of the Periodic Table, calculated as weight of metal, or mixtures thereof; and controlling contacting conditions such that the crude product has a total content of alkali metal, and alkaline-earth metal, in metal salts of organic acids of at most 90% of the content of alkali metal, and alkaline-earth metal, in metal salts of organic acids in the crude feed, wherein content of alkali metal, and alkaline-earth metal, in metal salts of organic acids is as determined by ASTM Method D1318.

In some embodiments, the invention provides a method of producing a crude product, comprising: contacting a crude feed with one or more catalysts to produce a total product that includes the crude product, wherein the crude product is a liquid mixture at 25° C. and 0.101 MPa, the crude feed comprising one or more alkali metal salts of one or more organic acids, one or more alkaline-earth metal salts of one or more organic acids, or mixtures thereof, the crude feed having, per gram of crude feed, a total content of alkali metal, and alkaline-earth metal, in metal salts of organic acids of at least 0.00001 grams, and at least one of the catalysts having, per gram of catalyst, at least 0.001 grams of: one or more metals from Column 6 of the Periodic Table, one or more compounds of one or more metals from Column 6 of the Periodic Table, calculated as weight of metal, or mixtures thereof; and controlling contacting conditions such that liquid hourly space velocity in a contacting zone is over 10 $h^{-1}$, and the crude product has a total content of alkali metal, and alkaline-earth metal, in metal salts of organic acids of at most 90% of the content of alkali metal, and alkaline-earth metal, in metal salts of organic acids in the crude feed, wherein content of alkali metal, and alkaline-earth metal, in metal salts of organic acids is as determined by ASTM Method D1318.

In certain embodiments, the invention provides a method of producing a crude product, comprising: contacting a crude feed with one or more catalysts to produce a total product that includes the crude product, wherein the crude product is a liquid mixture at 25° C. and 0.101 MPa, the crude feed having, per gram of crude feed, a total Ni/V/Fe content of at least 0.00002 grams, at least one of the catalysts has, per gram of catalyst, at least 0.001 grams of: one or more metals from Column 6 of the Periodic Table, one or more compounds of one or more metals from Column 6 of the Periodic Table, calculated as weight of metal, or mixtures thereof; and controlling contacting conditions such that liquid hourly space velocity in a contacting zone is over 10 $h^{-1}$, and the crude product has a total Ni/V/Fe content of at most 90% of the Ni/V/Fe content of the crude feed, wherein Ni/V/Fe content is as determined by ASTM Method D5708.

In some embodiments, the invention provides a method of producing a crude product, comprising: contacting a crude feed with one or more catalysts to produce a total product that includes the crude product, wherein the crude product is a liquid mixture at 25° C. and 0.101 MPa, the crude feed having, per gram of crude feed: an oxygen content of at least 0.0001 grams of oxygen, and a sulfur content of at least 0.0001 grams of sulfur, and at least one of the catalysts comprising one or more metals from Column 6 of the Periodic Table, one or more compounds of one or more metals from Column 6 of the Periodic Table, or mixtures thereof; and controlling contacting conditions such that the crude product has an oxygen content of at most 90% of the oxygen content of the crude feed, and the crude product has a sulfur content of about 70-130% of the sulfur content of the crude feed, wherein oxygen content is as determined by ASTM Method E385, and sulfur content is as determined by ASTM Method D4294.

In some embodiments, the invention provides a method of producing a crude product, comprising: contacting a crude feed with one or more catalysts to produce a total product that includes the crude product, wherein the crude product is a liquid mixture at 25° C. and 0.101 MPa, the crude feed having, per gram of crude feed, a total Ni/V/Fe content of at least 0.00002 grams, and a sulfur content of at least 0.0001 grams of sulfur, and at least one of the catalysts comprising one or more metals from Column 6 of the Periodic Table, one or more compounds of one or more metals from Column 6 of the Periodic Table, or mixtures thereof; and controlling contacting conditions such that the crude product has a total Ni/V/Fe content of at most 90% of the Ni/V/Fe content of the crude feed, and the crude product has a sulfur content of about 70-130% of the sulfur content of the crude feed, wherein Ni/V/Fe content is as determined by ASTM Method D5708, and sulfur content is as determined by ASTM Method D4294.

In certain embodiments, the invention provides a method of producing a crude product, comprising: contacting a crude feed with one or more catalysts to produce a total product that includes the crude product, wherein the crude product is a liquid mixture at 25° C. and 0.101 MPa, the crude feed comprising one or more alkali metal salts of one or more organic acids, one or more alkaline-earth metal salts of one or more organic acids, or mixtures thereof, the crude feed having, per gram of crude feed, a total content of alkali metal, and alkaline-earth metal, in metal salts of organic acids of at least 0.00001 grams, and a residue content of at least 0.1 grams of residue, and at least one of the catalysts comprising one or more metals from Column 6 of the Periodic Table, one or more compounds of one or more metals from Column 6 of the Periodic Table, or mixtures thereof; and controlling contacting conditions such that the crude product has a total content of alkali metal, and alkaline-earth metal, in metal salts of organic acids of at most 90% of the content of alkali metal, and alkaline-earth metal, in metal salts of organic acids in the crude feed, the crude product has a residue content of about 70-130% of the residue content of the crude feed, and wherein content of alkali metal, and alkaline-earth metal, in metal salts of organic acids is as determined by ASTM Method D1318, and residue content is as determined by ASTM Method D5307.

In certain embodiments, the invention provides a method of producing a crude product, comprising: contacting a crude feed with one or more catalysts to produce a total product that includes the crude product, wherein the crude product is a liquid mixture at 25° C. and 0.101 MPa, the crude feed having, per gram of crude feed, a residue content of at least 0.1 grams of residue, and a total Ni/V/Fe content of at least 0.00002 grams, and at least one of the catalysts comprising one or more metals from Column 6 of the Periodic Table, one or more compounds of one or more metals from Column 6 of the Periodic Table, or mixtures thereof; and controlling contacting conditions such that the crude product has a total Ni/V/Fe content of at most 90% of the Ni/V/Fe content of the crude feed and the crude product has a residue content of about 70-130% of the residue content of the crude feed, wherein Ni/V/Fe content is as determined by ASTM Method D5708, and residue content is as determined by ASTM Method D5307.

In some embodiments, the invention provides a method of producing a crude product, comprising: contacting a crude feed with one or more catalysts to produce a total product that includes the crude product, wherein the crude product is a liquid mixture at 25° C. and 0.101 MPa, the crude feed comprising one or more alkali metal salts of one or more organic acids, one or more alkaline-earth metal salts of one or more organic acids, or mixtures thereof, the crude feed having, per gram of crude feed, a vacuum gas oil ("VGO") content of at least 0.1 grams, and a total content of alkali metal, and alkaline-earth metal, in metal salts of organic acids of 0.0001 grams, and at least one of the catalysts comprises one or more metals from Column 6 of the Periodic Table, one or more compounds of one or more metals from Column 6 of the Periodic Table, or mixtures thereof; and controlling contacting conditions such that the crude product has a total content of alkali metal, and alkaline-earth metal, in metal salts of organic acids of at most 90% of the content of alkali metal, and alkaline-earth metal, in metal salts of organic acids in the crude feed, and the crude product has a VGO content of about 70-130% of the VGO content of the crude feed, wherein VGO content is as determined by ASTM Method D5307, and content of alkali metal, and alkaline-earth metal, in metal salts of organic acids is as determined by ASTM Method D1318.

In certain embodiments, the invention provides a method of producing a crude product, comprising: contacting a crude feed with one or more catalysts to produce a total product that includes the crude product, wherein the crude product is a liquid mixture at 25° C. and 0.101 MPa, the crude feed having, per gram of crude feed, a total Ni/V/Fe content of at least 0.00002 grams, and a VGO content of at least 0.1 grams, and at least one of the catalysts comprises one or more metals from Column 6 of the Periodic Table, one or more compounds of one or more metals from Column 6 of the Periodic Table, or mixtures thereof; and controlling contacting conditions such that the crude product has a total Ni/V/Fe content of at most 90% of the Ni/V/Fe content of the crude feed, and the crude product has a VGO content of about 70-130% of the VGO content of the crude feed, wherein VGO content is as determined by ASTM Method D5307, and Ni/V/Fe content is as determined by ASTM Method D5708.

In some embodiments, the invention provides a method of producing a crude product, comprising: contacting a crude feed with one or more catalysts to produce a total product that includes the crude product, wherein the crude product is a liquid mixture at 25° C. and 0.101 MPa, the crude feed comprising one or more alkali metal salts of one or more organic acids, one or more alkaline-earth metal salts of one or more organic acids, or mixtures thereof, and the crude feed having, per gram of crude feed, a total content of alkali metal, and alkaline-earth metal, in metal salts of organic acids of at least 0.00001 grams, and at least one of the catalysts is obtainable by: combining a support with one or more metals from Column 6 of the Periodic Table, one or more compounds of one or more metals from Column 6 of the Periodic Table, or mixtures thereof to produce a catalyst precursor, and forming the catalyst by heating a precursor of the catalyst in the presence of one or more sulfur containing compounds at a temperature below 400° C.; and controlling contacting conditions such that the crude product has a total content of alkali metal, and alkaline-earth metal, in metal salts of organic acids of at most 90% of the content of alkali metal, and alkaline-earth metal, in metal salts of organic acids in the crude feed, wherein content of alkali metal, and alkaline-earth metal, in metal salts of organic acids is determined by ASTM Method D1318.

In certain embodiments, the invention provides a method of producing a crude product, comprising: contacting a crude feed with one or more catalysts to produce a total product that includes the crude product, wherein the crude product is a liquid mixture at 25° C. and 0.101 MPa, the crude feed having, per gram of crude feed, a total Ni/V/Fe content of at least 0.00002 grams, and at least one of the catalysts is obtainable by: combining a support with one or more metals from Column 6 of the Periodic Table, one or more compounds of one or more metals from Column 6 of the Periodic Table, or mixtures thereof to produce a catalyst precursor; and forming the catalyst by heating the catalyst precursor in the presence of one or more sulfur containing compounds at a temperature below 400° C.; and controlling contacting conditions such that the crude product has a total Ni/V/Fe content of at most 90% of the Ni/V/Fe content of the crude feed, wherein Ni/V/Fe content is as determined by ASTM Method D5708.

In some embodiments, the invention provides a crude composition having, per gram of crude composition: at least 0.001 grams of hydrocarbons with a boiling range distribution between about 95° C. and about 260° C. at 0.101 MPa; at least 0.001 grams of hydrocarbons with a boiling range distribution between about 260° C. and about 320° C. at 0.101 MPa; at least 0.001 grams of hydrocarbons with a boiling range distribution between about 320° C. and 650° C. at 0.101 MPa; and greater than 0 grams, but less than 0.01 grams of one or more catalysts per gram of crude product.

In certain embodiments, the invention provides a crude composition having, per gram of composition: at least 0.01 grams of sulfur, as determined by ASTM Method D4294; at least 0.2 grams of residue, as determined by ASTM Method D5307, and the composition has a weight ratio of MCR content to $C_5$ asphaltenes content of at least 1.5, wherein MCR content is as determined by ASTM Method D4530, and $C_5$ asphaltenes content is as determined by ASTM Method D2007.

In certain embodiments, the invention provides a method of producing a crude product, comprising: contacting a crude feed with one or more catalysts to produce a total product that includes the crude product, wherein the crude product is condensable at 25° C. and 0.101 MPa, the crude feed a MCR content of at least 0.001 grams per gram of crude feed, and at least one of the catalysts is obtainable by: combining a support with one or more metals from Column 6 of the Periodic Table, one or more compounds of one or more metals from Column 6 of the Periodic Table, or mixtures thereof, to produce a catalyst precursor; and forming the catalyst by heating the catalyst precursor in the presence of one or more sulfur containing compounds at a temperature below 500° C.; and controlling contacting conditions such that the crude product has a MCR content of at most 90% of the MCR content of the crude feed, wherein MCR content is as determined by ASTM Method D4530.

In some embodiments, the invention provides a method of producing a crude product, comprising: contacting a crude feed with one or more catalysts to produce a total product that includes the crude product, wherein the crude product is condensable at 25° C. and 0.101 MPa, the crude feed a MCR content of at least 0.001 grams per gram of crude feed, and at least one of the catalysts having a pore size distribution with a median pore diameter in a range from about 70 Å to about 180 Å, with at least 60% of the total number of pores in the pore size distribution having a pore diameter within about 45 Å of the median pore diameter, wherein pore size distribution is as determined by ASTM Method [D4282] D4284; and controlling contacting conditions such that the crude product has a MCR of at most 90% of the MCR of the crude feed, wherein MCR is as determined by ASTM Method D4530. In some embodiments, the invention provides a crude composition having, per gram of composition: at most 0.004 grams of oxygen, as determined by ASTM Method E385; at most 0.003 grams of sulfur, as determined by ASTM Method D4294; and at least 0.3 grams of residue, as determined by ASTM Method D5307.

In certain embodiments, the invention provides a crude composition having, per gram of composition: at most 0.004 grams of oxygen, as determined by ASTM Method E385; at most 0.003 grams of sulfur, as determined by ASTM Method D4294; at most 0.04 grams of basic nitrogen, as determined by ASTM Method D2896; at least 0.2 grams of residue, as determined by ASTM Method D5307; and the composition has a TAN of at most 0.5, as determined by ASTM Method D664.

In some embodiments, the invention provides a crude composition having, per gram of composition: at least 0.001 grams of sulfur, as determined by ASTM Method D4294; at least 0.2 grams of residue, as determined by ASTM Method D5307; and the composition having a weight ratio of MCR content to $C_5$ asphaltenes content of at least 1.5, and the composition having a TAN of at most 0.5, wherein TAN is as determined by ASTM Method D664, weight of MCR is as determined by ASTM Method D4530, and weight of $C_5$ asphaltenes is as determined by ASTM Method D2007.

In some embodiments, the invention also provides, in combination with one or more of the above embodiments, crude feed that: (a) has not been treated in a refinery, distilled, and/or fractionally distilled; (b) has components having a carbon number above 4, and the crude feed has at least 0.5 grams of such components per gram of crude feed; (c) comprises hydrocarbons, a portion of which have: a boiling range distribution below 100° C. at 0.101 MPa, a boiling range distribution between 100° C. and 200° C. at 0.101 MPa, a boiling range distribution between about 200° C. and about 300° C. at 0.101 MPa, a boiling range distribution between about 300° C. and about 400° C. at 0.101 MPa, and a boiling range distribution between about 400° C. and about 650° C. at 0.101 MPa; (d) has, per gram of crude feed, at least: 0.001 grams of hydrocarbons having a boiling range distribution below 100° C. at 0.101 MPa, 0.001 grams of hydrocarbons having a boiling range distribution between 100° C. and 200° C. at 0.101 MPa, 0.001 grams of hydrocarbons having a boiling range distribution between about 200° C. and about 300° C. at 0.101 MPa, 0.001 grams of hydrocarbons having a boiling range distribution between about 300° C. and about 400° C. at 0.101 MPa, and 0.001 grams of hydrocarbons having a boiling range distribution between about 400° C. and about 650° C. at 0.101 MPa; (e) has a TAN of at least 0.1, at least 0.3, or in a range from about 0.3 to about 20, about 0.4 to about 10, or about 0.5 to about 5; (f) has an initial boiling point of at least 200° C. at 0.101 MPa; (g) comprises nickel, vanadium and iron; (h) has at least 0.00002 grams of total Ni/V/Fe per gram of crude feed; (i) comprises sulfur; (j) has at least 0.0001 grams or about 0.05 grams of sulfur per gram of crude feed; (k) has at least 0.001 grams of VGO per gram of crude feed; (l) has at least 0.1 grams of residue per gram of crude feed; (m) comprises oxygen containing hydrocarbons; (n) comprises one or more alkali metal salts of one or more organic acids, one or more alkaline-earth metal salts of one or more organic acids, or mixtures thereof; (o) comprises at least one zinc salt of an organic acid; and/or (p) comprises at least one arsenic salt of an organic acid.

In some embodiments, the invention also provides, in combination with one or more of the above embodiments, crude feed that is obtainable by removing naphtha and compounds more volatile than naphtha from a crude.

In some embodiments, the invention also provides, in combination with one or more of the above embodiments, a method of contacting a crude feed with one or more catalysts to produce a total product that includes the crude product in which the crude feed and crude product both have a $C_5$ asphaltenes content and a MCR content, and: (a) a sum of a crude feed $C_5$ asphaltenes content and crude feed MCR content is S, a sum of a crude product $C_5$ asphaltenes content and a crude product MCR content is S', and contacting conditions are controlled such that S' is at most 99% of S; and/or (b) the contacting conditions are controlled such that a weight ratio of a MCR content of the crude product to a $C_5$ asphaltenes content of the crude product is in a range from about 1.2 to about 2.0, or about 1.3 to about 1.9.

In some embodiments, the invention also provides, in combination with one or more of the above embodiments, a hydrogen source, in which the hydrogen source is: (a) gaseous; (b) hydrogen gas; (c) methane; (d) light hydrocarbons; (e) inert gas; and/or (f) mixtures thereof.

In some embodiments, the invention also provides, in combination with one or more of the above embodiments, a method of contacting a crude feed with one or more catalysts to produce a total product that includes the crude product wherein the crude feed is contacted in a contacting zone that is on or coupled to an offshore facility.

In some embodiments, the invention also provides, in combination with one or more of the above embodiments, a method that comprises contacting a crude feed with one or more catalysts in the presence of a gas and/or a hydrogen source and controlling contacting conditions such that: (a) a ratio of a gaseous hydrogen source to the crude feed is in a range from about 5-800 normal cubic meters of gaseous hydrogen source per cubic meter of crude feed contacted with one or more of the catalysts; (b) the selected rate of net hydrogen uptake is controlled by varying a partial pressure of the hydrogen source; (c) the rate of hydrogen uptake is such that the crude product has TAN of less than 0.3, but the hydrogen uptake is less than an amount of hydrogen uptake that will cause substantial phase separation between the crude feed and the total product during contact; (d) the selected rate of hydrogen uptake is in a range from about 1-30 or about 1-80 normal cubic meters of the hydrogen source per cubic meter of crude feed; (e) the liquid hourly space velocity of gas and/or the hydrogen source is at least 11 $h^{-1}$, at least 15 $h^{-1}$, or at most 20 $h^{-1}$; (f) a partial pressure of the gas and/or the hydrogen source is controlled during contacting; (g) a contacting temperature is in a range from about 50-500° C., a total liquid hourly space velocity of the gas and/or the hydrogen source is in a range from about 0.1-30 $h^{-1}$, and total pressure of the gas and/or the hydrogen source is in a range from about 1.0-20 MPa; (h) a flow of the gas and/or the hydrogen source is in a direction that is counter to a flow of the crude feed; (i) the crude product has a H/C of about 70-130% of a H/C of the crude feed; (j) hydrogen uptake by the crude feed is at most 80 and/or in a range from about 1-80 or about 1-50 normal cubic meters of hydrogen per cubic meter of crude feed; (k) the crude product has a total Ni/V/Fe content of at most 90%, at most 50%, or at most 10% of the Ni/V/Fe content of the crude feed; (l) the crude product has a sulfur content of about 70-130% or about 80-120% of the sulfur content of the crude feed; (m) the crude product has a VGO content of about 70-130% or 90-110% of the VGO content of the crude feed; (n) the crude product has a residue content of about 70-130% or 90-110% of the residue content of the crude feed; (o) the crude product has an oxygen content of most 90%, at most 70%, at most 50%, at most 40%, or at most 10% of the oxygen content of the crude feed; (p) the crude product has a total content of alkali metal, and alkaline-earth metal, in metal salts of organic acids of at most 90%, at most 50%, or at most 10% of the content of alkali metal, and alkaline-earth metal, in metal salts of organic acids in the crude feed; (q) a P-value of the crude feed, during contacting, is at least 1.5; (r) the crude product has a viscosity at 37.8° C. of at most 90%, at most 50%, or at most 10% of the viscosity of the crude feed at 37.8° C.; (s) the crude product has an API gravity of about 70-130% of an API gravity of the crude feed; and/or (t) the crude product has a TAN of at most 90%, at most 50%, at most 30%, at most 20%, or at most 10%, of the TAN of the crude feed and/or in a range from about 0.001 to about 0.5, about 0.01 to about 0.2, or about 0.05 to about 0.1.

In some embodiments, the invention also provides, in combination with one or more of the above embodiments, a method that comprises contacting a crude feed with one or more catalysts and controlling contacting conditions to reduce a content of organic oxygen containing compounds in which: (a) a content of selected organic oxygen compounds is reduced such that the crude product has an oxygen content of at most 90% of the oxygen content of the crude feed; (b) at least one compound of the organic oxygen containing compounds comprises a metal salt of a carboxylic acid; (c) at least one compound of the organic oxygen containing compounds comprises an alkali metal salt of a carboxylic acid; (d) at least one compound of the organic oxygen containing compounds comprises an alkaline-earth metal salt of a carboxylic acid; (e) at least one compound of the organic oxygen containing compounds comprises a metal salt of a carboxylic acid, wherein the metal comprises one or more metals from Column 12 of the Periodic Table; (f) the crude product has a content of non-carboxylic containing organic compounds of at most 90% of the content of non-carboxylic containing organic compounds in the crude feed; and/or (g) at least one of the oxygen containing compounds in the crude feed originates from naphthenic acid or non-carboxylic containing organic oxygen compounds.

In some embodiments, the invention also provides, in combination with one or more of the above embodiments, a method that comprises contacting a crude feed with one or more catalysts in which: (a) the crude feed is contacted with at least one of the catalysts at a first temperature followed by contacting at a second temperature, and the contacting conditions are controlled such that the first contacting temperature is at least 30° C. lower than the second contacting temperature; (b) the crude feed is contacted with hydrogen at a first hydrogen uptake condition and then at a second hydrogen uptake condition, and the temperature of the first uptake condition is at least 30° C. lower than the temperature of the second uptake condition; (c) the crude feed is contacted with at least one of the catalysts at a first temperature followed by contacting at a second temperature, and the contacting conditions are controlled such that the first contacting temperature is at most 200° C. lower than the second contacting temperature; (d) hydrogen gas is generated during contacting; (e) hydrogen gas is generated during contacting, and the contacting conditions are also controlled such that the crude feed uptakes at least a portion of the generated hydrogen; (f) the crude feed is contacted with a first and second catalyst, and contacting of the crude feed and the first catalyst forms an initial crude product, and wherein the initial crude product has a TAN of at most 90% of the TAN of the crude feed; and contacting of the initial crude product and the second catalyst forms a crude product, and wherein the crude product has a TAN of at most 90% of the TAN of the initial crude product; (g) contacting is performed in a stacked bed reactor; (h) contacting is performed in an ebullating bed reactor; (i) the crude feed is contacted with an additional catalyst subsequent to contact with the one or more catalysts; (j) one or more of the catalysts is a vanadium catalyst and the crude feed is contacted with an additional catalyst in the presence of a hydrogen source subsequent to contact with the vanadium catalyst; (k) hydrogen is generated at a rate in a range from about 1-20 normal cubic meters per cubic meter of crude feed; (l) hydrogen is generated during the contacting, the crude feed is contacted with an additional catalyst in the presence of a gas and at least a portion of the generated hydrogen, and the contacting conditions are also controlled such that a flow of the gas is in a direction that is counter to the flow of the crude feed and a flow of the generated hydrogen; (m) the crude feed is contacted with a vanadium catalyst at a first temperature and subsequently with an additional catalyst at a second temperature, and the contacting conditions are controlled such that the first temperature is at least 30° C. lower than the second temperature; (n) hydrogen gas is generated during contacting, the crude feed is contacted with an additional catalyst, and the contacting conditions are controlled such that the additional catalyst uptakes at least a portion of the generated hydrogen; and/or (o) the crude feed is subsequently contacted with an additional catalyst at a second temperature, and the contacting conditions are controlled such that the second temperature is at least 180° C.

In some embodiments, the invention also provides, in combination with one or more of the above embodiments, a method that comprises contacting a crude feed with one or more catalysts in which: (a) the catalyst is a supported catalyst and the support comprises alumina, silica, silica-alumina, titanium oxide, zirconium oxide, magnesium oxide, or mixtures thereof; (b) the catalyst is a supported catalyst and the support is porous; (c) the method further comprises an additional catalyst that has been heat treated at a temperature above 400° C. prior to sulfurization; (d) a life of at least one of the catalysts is at least 0.5 year; and/or (e) at least one of the catalysts is in a fixed bed or slurried in the crude feed.

In some embodiments, the invention also provides, in combination with one or more of the above embodiments, a method that comprises contacting a crude feed with one or more catalysts, at least one of the catalysts is a supported catalyst or a bulk metal catalyst and the supported catalyst or bulk metal catalyst: (a) comprises one or more metals from Columns 5-10 of the Periodic Table, one or more compounds of one or more metals from Columns 5-10 of the Periodic Table, or mixtures thereof; (b) has, per gram of catalyst, at least 0.0001 grams, from about 0.0001-0.6 grams, or from about 0.001-0.3 grams of: one or more metals from Columns 5-10 of the Periodic Table, one or more compounds of one or more metals from Columns 5-10 of the Periodic Table, or mixtures thereof; (c) comprises one or more metals from Columns 6-10 of the Periodic Table, one or more compounds of one or more metals from Columns 6-10 of the Periodic Table, or mixtures thereof; (d) comprises one or more metals from Columns 7-10 of the Periodic Table, one or more compounds of one or more metals from Columns 7-10 of the Periodic Table, or mixtures thereof; (e) has, per gram of catalyst, from about 0.0001-0.6 grams or about 0.001-0.3 grams of: one or more metals from Columns 7-10 of the Periodic Table, one or more compounds of one or more metals from Columns 7-10 of the Periodic Table, or mixtures thereof; (f) comprises one or more metals from Columns 5-6 of the Periodic Table; one or more compounds of one or more metals from Columns 5-6 of the Periodic Table, or mixtures thereof; (g) comprises one or more metals from Column 5 of the Periodic Table, one or more compounds of one or more metals from Column 5 of the Periodic Table, or mixtures thereof; (h) has, per gram of catalyst, at least 0.0001 grams, from about 0.0001-0.6 grams, about 0.001-0.3 grams, about 0.005-0.1 grams, or about 0.01-0.08 grams of: one or more metals from Column 5 of the Periodic Table, one or more compounds of one or more metals from Column 5 of the Periodic Table, or mixtures thereof; (i) comprises one or more metals from Column 6 of the Periodic Table, one or more compounds of one or more metals from Column 6 of the Periodic Table, or mixtures thereof; (j) has, per gram of catalyst, from about 0.0001-0.6 grams, about 0.001-0.3 grams, about 0.005-0.1 grams, about 0.01-0.08 grams of one or more metals from Column 6 of the Periodic Table, one or more compounds of one or more metals from Column 6 of the Periodic Table, or mixtures thereof; (k) comprises one or more metals from Column 10 of the Periodic Table, one or more compounds of one or more metals from Column 10 of the Periodic Table, or mixtures thereof; (l) has, per gram of catalyst, from about 0.0001-0.6 grams or about 0.001-0.3 grams of: one or more metals from Column 10 of the Periodic Table, one or more compounds of one or more metals from Column 10 of the Periodic Table, or mixtures thereof; (m) comprises vanadium, one or more compounds of vanadium, or mixtures thereof; (n) comprises nickel, one or more compounds of nickel, or mixtures thereof; (o) comprises cobalt, one or more compounds of cobalt, or mixtures thereof; (p) comprises molybdenum, one or more compounds of molybdenum, or mixtures thereof; (q) has, per gram of catalyst, from 0.001-0.3 grams or from about 0.005-0.1 grams of: molybdenum, one or more molybdenum compounds, or mixtures thereof; (r) comprises tungsten, one or more compounds of tungsten, or mixtures thereof; (s) has, per gram of catalyst, from about 0.001-0.3 grams of: tungsten, one or more tungsten compounds, or mixtures thereof; (t) comprises one or more metals from Column 6 of the Periodic Table and one or more metals from Column 10 of the Periodic Table, wherein the molar ratio of the Column 10 metal to the Column 6 metal is from about 1 to about 5; (u) comprises one or more elements from Column 15 of the Periodic Table, one or more compounds of one or more elements from Column 15 of the Periodic Table, or mixtures thereof; (v) has, per gram of catalyst, from about 0.00001-0.06 grams of: one or more elements from Column 15 of the Periodic Table, one or more compounds of one or more elements from Column 15 of the Periodic Table, or mixtures thereof; (w) comprises phosphorus, one or more compounds of phosphorus, or mixtures thereof; (x) has at most 0.1 grams of alpha alumina per gram of catalyst; and/or (y) has at least 0.5 grams of theta alumina per gram of catalyst.

In some embodiments, the invention also provides, in combination with one or more of the above embodiments, a method of forming a catalyst comprising combining a support with one or more metals to form a support/metal mixture, wherein the support comprises theta alumina, and heat treating the theta alumina support/metal mixture at a temperature of at least 400° C., and further comprising: (a) combining the support/metal mixture with water to form a paste, and extruding the paste; (b) obtaining theta alumina by heat treating alumina at a temperature of at least 800° C.; and/or (c) sulfurizing the catalyst.

In some embodiments, the invention also provides, in combination with one or more of the above embodiments, a method that comprises contacting a crude feed with one or more catalysts, in which the pore size distribution of at least one of the catalysts has: (a) a median pore diameter of at least 60 Å, at least 90 Å, at least 180 Å, at least 200 Å, at least 230 Å, at least 300 Å, at most 230 Å, at most 500 Å, or in a range from about 90-180 Å, about 100-140 Å, about 120-130 Å, about 230-250 Å, about 180-500 Å, about 230-500 Å; or about 60-300 Å; (b) at least 60% of the total number of pores have a pore diameter within about 45 Å, about 35 Å, or about 25 Å, of the median pore diameter; (c) a surface area of at least 60 $m^2/g$, at least 90 $m^2/g$, at least 100 $m^2/g$, at least 120 $m^2/g$, at least 150 $m^2/g$, at least 200 $m^2/g$, or at least 220 $m^2/g$; and/or (d) a total volume of all of the pores of at least 0.3 $cm^3/g$, at least 0.4 $cm^3/g$, at least 0.5 $cm^3/g$, or at least 0.7 $cm^3/g$.

In some embodiments, the invention also provides, in combination with one or more of the above embodiments, a method that comprises contacting a crude feed with one or more supported catalysts, in which the support: (a) comprises alumina, silica, silica-alumina, titanium oxide, zirconium oxide, magnesium oxide, or mixtures thereof, and/or zeolite; (b) comprises gamma alumina and/or delta alumina; (c) has, per gram of support, at least 0.5 grams of gamma alumina; (d) has, per gram of support, at least 0.3 grams or at least 0.5 grams of theta alumina; (e) comprises alpha alumina, gamma alumina, delta alumina, theta alumina, or mixture thereof; and/or (f) has at most 0.1 grams of alpha alumina per gram of support.

In some embodiments, the invention also provides, in combination with one or more of the above embodiments, a vanadium catalyst that: (a) has a pore size distribution with a median pore diameter of at least 60 Å; (b) comprises a support, the support comprising theta alumina, and the vanadium catalyst has a pore size distribution with a median pore diameter of at least 60 Å; (c) comprises one or more metals from Column 6 of the Periodic Table, one or more compounds of one or more metals from Column 6 of the Periodic Table, or mixtures thereof; and/or (d) has, per gram of catalyst, at least 0.001 grams of: one or more metals from Column 6 of the Periodic Table, one or more compounds of one or more metals from Column 6 of the Periodic Table, or mixtures thereof.

In some embodiments, the invention also provides, in combination with one or more of the above embodiments, a crude product that has: (a) a TAN of at most 0.1, from about 0.001 to about 0.5, from about 0.01 to about 0.2; or from about 0.05 to 0.1; (b) at most 0.000009 grams of the alkali metal, and alkaline-earth metal, in metal salts of organic acids per gram of crude product; (c) at most 0.00002 grams of Ni/V/Fe per gram of crude product; and/or (d) greater than 0 grams, but less than 0.01 grams, of at least one of the catalysts per gram of crude product.

In some embodiments, the invention also provides, in combination with one or more of the above embodiments, one or more alkali metal salts of one or more organic acids, one or more alkaline-earth metal salts of one or more organic acids, or mixtures thereof in which: (a) at least one of the alkali metals is lithium, sodium, or potassium; and/or (b) at least one of the alkaline-earth metals is magnesium or calcium.

In some embodiments, the invention also provides, in combination with one or more of the above embodiments, a method that comprises contacting a crude feed with one or more catalysts to produce a total product that includes a crude product, the method further comprising: (a) combining the crude product with a crude that is the same or different from the crude feed to form a blend suitable for transporting; (b) combining the crude product with a crude that is the same or different from the crude feed to form a blend suitable for treatment facilities; (c) fractionating the crude product; and/or (d) fractionating the crude product into one or more distillate fractions, and producing transportation fuel from at least one of the distillate fractions.

In some embodiments, the invention also provides, in combination with one or more of the above embodiments, a supported catalyst composition that: (a) has at least 0.3 grams or at least 0.5 grams of theta alumina per gram of support; (b) comprises delta alumina in the support; (c) has at most 0.1 grams of alpha alumina per gram of support; (d) has a pore size distribution with a median pore diameter of at least 230 Å; (e) has a pore volume of the pores of the pore size distribution of at least 0.3 $cm^3/g$ or at least 0.7 $cm^3/g$; (f) has a surface area of at least 60 $m^2/g$ or at least 90 $m^2/g$; (g) comprises one or more metals from Columns 7-10 of the Periodic Table, one or more compounds of one or more metals from Columns 7-10 of the Periodic Table, or mixtures thereof; (h) comprises one or more metals from Column 5 of the Periodic Table, one or more compounds of one or more metals from Column 5 of the Periodic Table, or mixtures thereof; (i) has, per gram of catalyst, from about 0.0001-0.6 grams or from about 0.001-0.3 grams of: one or more Column 5 metals, one or more Column 5 metal compounds, or mixtures thereof; (j) comprises one or more metals from Column 6 of the Periodic Table, one or more compounds of one or more metals from Column 6 of the Periodic Table, or mixtures thereof; (k) has, per gram of catalyst, from about 0.0001-0.6 grams or from about 0.001-0.3 grams of: one or more Column 6 metals, one or more Column 6 metal compounds, or mixtures thereof; (l) comprises vanadium, one or more compounds of vanadium, or mixtures thereof; (m) comprises molybdenum, one or more compounds of molybdenum, or mixtures thereof; (n) comprises tungsten, one or more compounds of tungsten, or mixtures thereof; (o) comprises cobalt, one or more compounds of cobalt, or mixtures thereof; and/or (p) comprises nickel, one or more compounds of nickel, or mixtures thereof.

In some embodiments, the invention also provides, in combination with one or more of the above embodiments, a crude composition that: (a) has a TAN of at most 1, at most 0.5, at most 0.3, or at most 0.1; (b) has, per gram of composition, at least 0.001 grams of hydrocarbons with a boiling range distribution between about 95° C. and about 260° C. at 0.101 MPa; at least 0.001 grams, at least 0.005 grams, or at least 0.01 grams of hydrocarbons with a boiling range distribution between about 260° C. and about 320° C. at 0.101 MPa; and at least 0.001 grams of hydrocarbons with a boiling range distribution between about 320° C. and about 650° C. at 0.101 MPa; (c) has at least 0.0005 grams of basic nitrogen per gram of composition; (d) has, per gram of composition, at least 0.001 grams or at least 0.01 grams of total nitrogen; and/or (e) has at most 0.00005 grams of total nickel and vanadium per gram of composition.

In some embodiments, the invention also provides, in combination with one or more of the above embodiments, a crude composition that includes one or more catalysts, and at least one of the catalysts: (a) has a pore size distribution with the median pore diameter of, at least 180 Å, at most 500 Å, and/or in a range from about 90-180 Å, 100-140 Å, 120-130 Å; (b) has a median pore diameter of at least 90 Å, with greater than 60% of the total number of pores in the pore size distribution having a pore diameter within about 45 Å, about 35 Å, or about 25 Å of the median pore diameter; (c) has a surface area of at least 100 $m^2/g$, at least 120 $m^2/g$, or at least 220 $m^2/g$; (d) comprises a support; and the support comprises alumina, silica, silica-alumina, titanium oxide, zirconium oxide, magnesium oxide, zeolite, and/or mixtures thereof; (e) comprises one or more metals from Columns 5-10 of the Periodic Table, one or more compounds of one or more metals form Columns 5-10 of the Periodic Table, or mixtures thereof; (f) comprises one or more metals from Column 5 of the Periodic Table, one or more compounds of one or more metals from Column 5 of the Periodic Table, or mixtures thereof; (g) has, per gram of catalyst, at least 0.0001 grams of: one or more Column 5 metals, one or more Column 5 metal compounds, or mixtures thereof; (h) comprises one or more metals from Column 6 of the Periodic Table, one or more compounds of one or more metals from Column 6 of the Periodic Table, or mixtures thereof; (i) has, per gram of catalyst, at least 0.0001 grams of: one or more Column 6 metals, one or more Column 6 metal compounds, or mixtures thereof; (j) comprises one or more metals from Column 10 of the Periodic Table, one or more compounds of one or more metals from Column 10 of the Periodic Table, of mixtures thereof; and/or (k) comprises one or more elements from Column 15 of the Periodic Table, one or more compounds of one or more elements from Column 15 of the Periodic Table, or mixtures thereof.

In further embodiments, features from specific embodiments may be combined with features from other embodiments. For example, features from one embodiment may be combined with features from any of the other embodiments.

In further embodiments, crude products are obtainable by any of the methods and systems described herein.

In further embodiments, additional features may be added to the specific embodiments described herein.

BRIEF DESCRIPTION OF THE DRAWINGS

Advantages of the present invention will become apparent to those skilled in the art with the benefit of the following detailed description and upon reference to the accompanying drawings in which:

FIG. 7 is a tabulation of representative properties of crude feed and crude product for an embodiment of contacting the crude feed with three catalysts.

FIG. 9 is a tabulation of representative properties of crude feed and crude product for an embodiment of contacting the crude feed with two catalysts.

FIG. 10 is another tabulation of representative properties of crude feed and crude product for an embodiment of contacting the crude feed with two catalysts.

FIG. 11 is a tabulation of crude feed and crude products for embodiments of contacting crude feeds with four different catalyst systems.

FIG. 17 is a tabulation of representative properties of crude feed and crude products for embodiments of contacting the crude feed with catalyst systems that include various amounts of a molybdenum catalyst and a vanadium catalyst, with a catalyst system that include a vanadium catalyst and a molybdenum/vanadium catalyst, and with glass beads.

FIG. 18 is a tabulation of properties of crude feed and crude products for embodiments of contacting crude feeds with one or more catalysts at various liquid hourly space velocities.

FIG. 19 is a tabulation of properties of crude feeds and crude products for embodiments of contacting crude feeds at various contacting temperatures.

Figure 1:
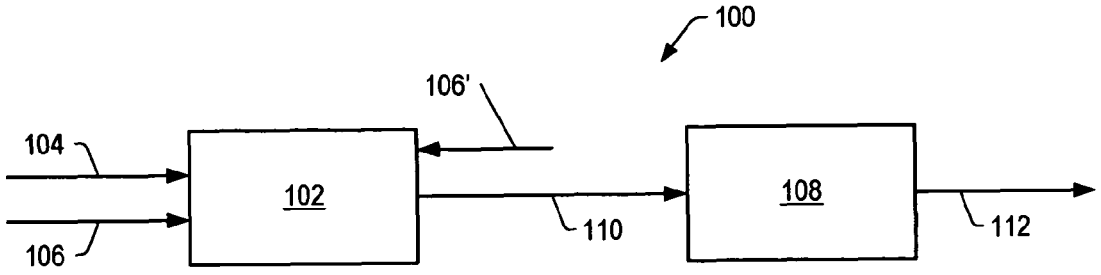
FIG. 1 is a schematic of an embodiment of a contacting system.

While the invention is susceptible to various modifications and alternative forms, specific embodiments thereof are shown by way of example in the drawings. The drawings may not be to scale. It should be understood that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

Certain embodiments of the inventions are described herein in more detail. Terms used herein are defined as follows.

"ASTM" refers to American Standard Testing and Materials.

"API gravity" refers to API gravity at 15.5° C. (60° F.). API gravity is as determined by ASTM Method D6822.

Atomic hydrogen percentage and atomic carbon percentage of the crude feed and the crude product are as determined by ASTM Method D5291.

Boiling range distributions for the crude feed, the total product, and/or the crude product are as determined by ASTM Method D5307 unless otherwise mentioned.

"$C_5$ asphaltenes" refers to asphaltenes that are insoluble in pentane. $C_5$ asphaltenes content is as determined by ASTM Method D2007.

"Column X metal(s)" refers to one or more metals of Column X of the Periodic Table and/or one or more compounds of one or more metals of Column X of the Periodic Table, in which X corresponds to a column number (for example, 1-12) of the Periodic Table. For example, "Column 6 metal(s)" refers to one or more metals from Column 6 of the Periodic Table and/or one or more compounds of one or more metals from Column 6 of the Periodic Table.

"Column X element(s)" refers to one or more elements of Column X of the Periodic Table, and/or one or more compounds of one or more elements of Column X of the Periodic Table, in which X corresponds to a column number (for example, 13-18) of the Periodic Table. For example, "Column 15 element(s)" refers to one or more elements from Column 15 of the Periodic Table and/or one or more compounds of one or more elements from Column 15 of the Periodic Table.

In the scope of this application, weight of a metal from the Periodic Table, weight of a compound of a metal from the Periodic Table, weight of an element from the Periodic Table, or weight of a compound of an element from the Periodic Table is calculated as the weight of metal or the weight of element. For example, if 0.1 grams of $MoO_3$ is used per gram of catalyst, the calculated weight of the molybdenum metal in the catalyst is 0.067 grams per gram of catalyst.

"Content" refers to the weight of a component in a substrate (for example, a crude feed, a total product, or a crude product) expressed as weight fraction or weight percentage based on the total weight of the substrate. "Wtppm" refers to parts per million by weight.

"Crude feed/total product mixture" refers to the mixture that contacts the catalyst during processing.

"Distillate" refers to hydrocarbons with a boiling range distribution between 204° C. (400° F.) and 343° C. (650° F.) at 0.101 MPa. Distillate content is as determined by ASTM Method D5307.

"Heteroatoms" refers to oxygen, nitrogen, and/or sulfur contained in the molecular structure of a hydrocarbon. Heteroatoms content is as determined by ASTM Methods E385 for oxygen, D5762 for total nitrogen, and D4294 for sulfur.

"Total basic nitrogen" refers to nitrogen compounds that have a pKa of less than 40. Basic nitrogen ("bn") is as determined by ASTM Method D2896.

"Hydrogen source" refers to hydrogen, and/or a compound and/or compounds that when in the presence of a crude feed and the catalyst react to provide hydrogen to compound(s) in the crude feed. A hydrogen source may include, but is not limited to, hydrocarbons (for example, $C_1$ to $C_4$ hydrocarbons such as methane, ethane, propane, butane), water, or mixtures thereof. A mass balance may be conducted to assess the net amount of hydrogen provided to the compound(s) in the crude feed.

"Flat plate crush strength" refers to compressive force needed to crush a catalyst. Flat plate crush strength is as determined by ASTM Method D4179.

"LHSV" refers to a volumetric liquid feed rate per total volume of catalyst, and is expressed in hours ($h^{-1}$). Total volume of catalyst is calculated by summation of all catalyst volumes in the contacting zones, as described herein.

"Liquid mixture" refers to a composition that includes one or more compounds that are liquid at standard temperature and pressure (25° C., 0.101 MPa, hereinafter referred to as "STP"), or a composition that includes a combination of one of more compounds that are liquid at STP with one or more compounds that are solids at STP.

"Periodic Table" refers to the Periodic Table as specified by the International Union of Pure and Applied Chemistry (IUPAC), November 2003.

"Metals in metal salts of organic acids" refer to alkali metals, alkaline-earth metals, zinc, arsenic, chromium, or combinations thereof. A content of metals in metal salts of organic acids is as determined by ASTM Method D1318.

"Micro-Carbon Residue" ("MCR") content refers to a quantity of carbon residue remaining after evaporation and pyrolysis of a substrate. MCR content is as determined by ASTM Method D4530.

"Naphtha" refers to hydrocarbon components with a boiling range distribution between 38° C. (100° F.) and 200° C. (392° F.) at 0.101 MPa. Naphtha content is as determined by ASTM Method D5307.

"Ni/V/Fe" refers to nickel, vanadium, iron, or combinations thereof.

"Ni/V/Fe content" refers to the content of nickel, vanadium, iron, or combinations thereof. The Ni/V/Fe content is as determined by ASTM Method D5708.

"$Nm^3/m^3$" refers to normal cubic meters of gas per cubic meter of crude feed.

"Non-carboxylic containing organic oxygen compounds" refers to organic oxygen compounds that do not have a carboxylic (—$CO_2$—) group. Non-carboxylic containing organic oxygen compounds include, but are not limited to, ethers, cyclic ethers, alcohols, aromatic alcohols, ketones, aldehydes, or combinations thereof, which do not have a carboxylic group.

"Non-condensable gas" refers to components and/or mixtures of components that are gases at STP.

"P (peptization) value" or "P-value" refers to a numeral value, which represents the flocculation tendency of asphaltenes in the crude feed. Determination of the P-value is described by J. J. Heithaus in "Measurement and Significance of Asphaltene Peptization", *Journal of Institute of Petroleum*, Vol. 48, Number 458, February 1962, pp. 45-53.

"Pore diameter", "median pore diameter", and "pore volume" refer to pore diameter, median pore diameter, and pore volume, as determined by ASTM Method D4284 (mercury porosimetry at a contact angle equal to 140°). A Micromeritics® A9220 instrument (Micromeritics Inc., Norcross, Ga., U.S.A.) may be used to determine these values.

"Residue" refers to components that have a boiling range distribution above 538° C. (1000° F.), as determined by ASTM Method D5307.

"SCFB" refers to standard cubic feet of gas per barrel of crude feed.

"Surface area" of a catalyst is as determined by ASTM Method D3663.

"TAN" refers to a total acid number expressed as milligrams ("mg") of KOH per gram ("g") of sample. TAN is as determined by ASTM Method D664.

"VGO" refers to hydrocarbons with a boiling range distribution between 343° C. (650° F.) and 538° C. (1000° F.) at 0.101 MPa. VGO content is as determined by ASTM Method D5307.

"Viscosity" refers to kinematic viscosity at 37.8° C. (100° F.). Viscosity is as determined using ASTM Method D445.

All referenced methods are incorporated herein by reference. In the context of this application, it is to be understood that if the value obtained for a property of the substrate tested is outside of limits of the test method, the test method may be modified and/or recalibrated to test for such property.

Crudes may be produced and/or retorted from hydrocarbon containing formations and then stabilized. Crudes are generally solid, semi-solid, and/or liquid. Crudes may include crude oil. Stabilization may include, but is not limited to, removal of non-condensable gases, water, salts, or combinations thereof from the crude to form a stabilized crude. Such stabilization may often occur at, or proximate to, the production and/or retorting site.

Stabilized crudes typically have not been distilled and/or fractionally distilled in a treatment facility to produce multiple components with specific boiling range distributions (for example, naphtha, distillates, VGO, and/or lubricating oils). Distillation includes, but is not limited to, atmospheric distillation methods and/or vacuum distillation methods. Undistilled and/or unfractionated stabilized crudes may include components that have a carbon number above 4 in quantities of at least 0.5 grams of components per gram of crude. Examples of stabilized crudes include whole crudes, topped crudes, desalted crudes, desalted topped crudes, or combinations thereof. "Topped" refers to a crude that has been treated such that at least some of the components that have a boiling point below 35° C. at 0.101 MPa (about 95° F. at 1 atm) have been removed. Typically, topped crudes will have a content of at most 0.1 grams, at most 0.05 grams, or at most 0.02 grams of such components per gram of the topped crude.

Some stabilized crudes have properties that allow the stabilized crudes to be transported to conventional treatment facilities by transportation carriers (for example, pipelines, trucks, or ships). Other crudes have one or more unsuitable properties that render them disadvantaged. Disadvantaged crudes may be unacceptable to a transportation carrier and/or a treatment facility, thus imparting a low economic value to the disadvantaged crude. The economic value may be such that a reservoir that includes the disadvantaged crude that is deemed too costly to produce, transport, and/or treat.

Properties of disadvantaged crudes may include, but are not limited to: a) TAN of at least 0.1, at least 0.3; b) viscosity of at least 10 cSt; c) API gravity at most 19; d) a total Ni/V/Fe content of at least 0.00002 grams or at least 0.0001 grams of Ni/V/Fe per gram of crude; e) a total heteroatoms content of at least 0.005 grams of heteroatoms per gram of crude; f) a residue content of at least 0.01 grams of residue per gram of crude; g) a $C_5$ asphaltenes content of at least 0.04 grams of $C_5$ asphaltenes per gram of crude; h) a MCR content of at least 0.002 grams of MCR per gram of crude; i) a content of metals in metal salts of organic acids of at least 0.00001 grams of metals per gram of crude; or j) combinations thereof. In some embodiments, disadvantaged crude may include, per gram of disadvantaged crude, at least 0.2 grams of residue, at least 0.3 grams of residue, at least 0.5 grams of residue, or at least 0.9 grams of residue. In some embodiments, the disadvantaged crude may have a TAN in a range from about 0.1 or 0.3 to about 20, about 0.3 or 0.5 to about 10, or about 0.4 or 0.5 to about 5. In certain embodiments, disadvantaged crudes, per gram of disadvantaged crude, may have a sulfur content of at least 0.005, at least 0.01, or at least 0.02 grams.

In some embodiments, disadvantaged crudes have properties including, but not limited to: a) TAN of at least 0.5; b) an oxygen content of at least 0.005 grams of oxygen per gram of crude feed; c) a $C_5$ asphaltenes content of at least 0.04 grams of $C_5$ asphaltenes per gram of crude feed; d) a higher than desired viscosity (for example, >10 cSt for a crude feed with API gravity of at least 10; e) a content of metals in metal salts of organic acids of at least 0.00001 grams of metals per gram of crude; or f) combinations thereof.

Disadvantaged crudes may include, per gram of disadvantaged crude: at least 0.001 grams, at least 0.005 grams, or at least 0.01 grams of hydrocarbons with a boiling range distribution between about 95° C. and about 200° C. at 0.101 MPa; at least 0.01 grams, at least 0.005 grams, or at least 0.001 grams of hydrocarbons with a boiling range distribution between about 200° C. and about 300° C. at 0.101 MPa; at least 0.001 grams, at least 0.005 grams, or at least 0.01 grams of hydrocarbons with a boiling range distribution between about 300° C. and about 400° C. at 0.101 MPa; and at least 0.001 grams, at least 0.005 grams, or at least 0.01 grams of hydrocarbons with a boiling range distribution between about 400° C. and 650° C. at 0.101 MPa.

Disadvantaged crudes may include, per gram of disadvantaged crude: at least 0.001 grams, at least 0.005 grams, or at least 0.01 grams of hydrocarbons with a boiling range distribution of at most 100° C. at 0.101 MPa; at least 0.001 grams, at least 0.005 grams, or at least 0.01 grams of hydrocarbons with a boiling range distribution between about 100° C. and about 200° C. at 0.101 MPa; at least 0.001 grams, at least 0.005 grams, or at least 0.01 grams of hydrocarbons with a boiling range distribution between about 200° C. and about 300° C. at 0.101 MPa; at least 0.001 grams, at least 0.005 grams, or at least 0.01 grams of hydrocarbons with a boiling range distribution between about 300° C. and about 400° C. at 0.101 MPa; and at least 0.001 grams, at least 0.005 grams, or at least 0.01 grams of hydrocarbons with a boiling range distribution between about 400° C. and 650° C. at 0.101 MPa.

Some disadvantaged crudes may include, per gram of disadvantaged crude, at least 0.001 grams, at least 0.005 grams, or at least 0.01 grams of hydrocarbons with a boiling range distribution of at most 100° C. at 0.101 MPa, in addition to higher boiling components. Typically, the disadvantaged crude has, per gram of disadvantaged crude, a content of such hydrocarbons of at most 0.2 grams or at most 0.1 grams.

Some disadvantaged crudes may include, per gram of disadvantaged crude, at least 0.001 grams, at least 0.005 grams, or at least 0.01 grams of hydrocarbons with a boiling range distribution of at least 200° C. at 0.101 MPa.

Some disadvantaged crudes may include, per gram of disadvantaged crude, at least 0.001 grams, at least 0.005 grams, or at least 0.01 grams of hydrocarbons with a boiling range distribution of at least 650° C.

Examples of disadvantaged crudes that might be treated using the processes described herein include, but are not limited to, crudes from of the following regions of the world: U.S. Gulf Coast and southern California, Canada Tar sands, Brazilian Santos and Campos basins, Egyptian Gulf of Suez, Chad, United Kingdom North Sea, Angola Offshore, Chinese Bohai Bay, Venezuelan Zulia, Malaysia, and Indonesia Sumatra.

Treatment of disadvantaged crudes may enhance the properties of the disadvantaged crudes such that the crudes are acceptable for transportation and/or treatment.

A crude and/or disadvantaged crude that is to be treated herein is referred to as "crude feed". The crude feed may be topped, as described herein. The crude product resulting from treatment of the crude feed, as described herein, is generally suitable for transporting and/or treatment. Properties of the crude product produced as described herein are closer to the corresponding properties of West Texas Intermediate crude than the crude feed, or closer to the corresponding properties of Brent crude, than the crude feed, thereby enhancing the economic value of the crude feed. Such crude product may be refined with less or no pre-treatment, thereby enhancing refining efficiencies. Pre-treatment may include desulfurization, demetallization and/or atmospheric distillation to remove impurities.

Treatment of a crude feed in accordance with inventions described herein may include contacting the crude feed with the catalyst(s) in a contacting zone and/or combinations of two or more contacting zones. In a contacting zone, at least one property of a crude feed may be changed by contact of the crude feed with one or more catalysts relative to the same property of the crude feed. In some embodiments, contacting is performed in the presence of a hydrogen source. In some embodiments, the hydrogen source is one or more hydrocarbons that under certain contacting conditions react to provide relatively small amounts of hydrogen to compound(s) in the crude feed.

FIG. 1 is a schematic of contacting system 100 that includes an upstream contacting zone 102. The crude feed enters upstream contacting zone 102 via crude feed conduit 104. A contacting zone may be a reactor, a portion of a reactor, multiple portions of a reactor, or combinations thereof. Examples of a contacting zone include a stacked bed reactor, a fixed bed reactor, an ebullating bed reactor, a continuously stirred tank reactor ("CSTR"), a fluidized bed reactor, a spray reactor, and a liquid/liquid contactor. In certain embodiments, the contacting system is on or coupled to an offshore facility. Contact of the crude feed with the catalyst(s) in contacting system 100 may be a continuous process or a batch process.

The contacting zone may include one or more catalysts (for example, two catalysts). In some embodiments, contact of the crude feed with a first catalyst of the two catalysts may reduce TAN of the crude feed. Subsequent contact of the reduced TAN crude feed with the second catalyst decreases heteroatoms content and increases API gravity. In other embodiments, TAN, viscosity, Ni/V/Fe content, heteroatoms content, residue content, API gravity, or combinations of these properties of the crude product change by at least 10% relative to the same properties of the crude feed after contact of the crude feed with one or more catalysts.

In certain embodiments, a volume of catalyst in the contacting zone is in a range from about 10-60 vol %, about 20-50 vol %, or about 30-40 vol % of a total volume of crude feed in the contacting zone. In some embodiments, a slurry of catalyst and crude feed may include from about 0.001-10 grams, about 0.005-5 grams, or about 0.01-3 grams of catalyst per 100 grams of crude feed in the contacting zone.

Contacting conditions in the contacting zone may include, but are not limited to, temperature, pressure, hydrogen source flow, crude feed flow, or combinations thereof. Contacting conditions in some embodiments are controlled to produce a crude product with specific properties. Temperature in the contacting zone may range from about 50-500° C., about 60-440° C., about 70-430° C., or about 80-420° C. Pressure in a contacting zone may range from about 0.1-20 MPa, about 1-12 MPa, about 4-10 MPa, or about 6-8 MPa. LHSV of the crude feed will generally range from about 0.1-30 $h^{-1}$, about 0.5-25 $h^{-1}$, about 1-20 $h^{-1}$, about 1.5-15 $h^{-1}$, or about 2-10 $h^{-1}$. In some embodiments, LHSV is at least 5 $h^{-1}$, at least 11 $h^{-1}$, at least 15 $h^{-1}$, or at least 20 $h^{-1}$.

In embodiments in which the hydrogen source is supplied as a gas (for example, hydrogen gas), a ratio of the gaseous hydrogen source to the crude feed typically ranges from about 0.1-100,000 $Nm^3/m^3$, about 0.5-10,000 $Nm^3/m^3$, about 1-8,000 $Nm^3/m^3$, about 2-5,000 $Nm^3/m^3$, about 5-3,000 $Nm^3/m^3$, or about 10-800 $Nm^3/m^3$ contacted with the catalyst(s). The hydrogen source, in some embodiments, is combined with carrier gas(es) and recirculated through the contacting zone. Carrier gas may be, for example, nitrogen, helium, and/or argon. The carrier gas may facilitate flow of the crude feed and/or flow of the hydrogen source in the contacting zones(s). The carrier gas may also enhance mixing in the contacting zone(s). In some embodiments, a hydrogen source (for example, hydrogen, methane or ethane) may be used as a carrier gas and recirculated through the contacting zone.

The hydrogen source may enter upstream contacting zone 102 co-currently with the crude feed in crude feed conduit 104 or separately via gas conduit 106. In upstream contacting zone 102, contact of the crude feed with a catalyst produces a total product that includes a crude product, and, in some embodiments, gas. In some embodiments, a carrier gas is combined with the crude feed and/or the hydrogen source in conduit 106. The total product may exit upstream contacting zone 102 and enter downstream separation zone 108 via total product conduit 110.

In downstream separation zone 108, the crude product and gas may be separated from the total product using generally known separation techniques, for example, gas-liquid separation. The crude product may exit downstream separation zone 108 via crude product conduit 112, and then be transported to transportation carriers, pipelines, storage vessels, refineries, other processing zones, or a combination thereof. The gas may include gas formed during processing (for example, hydrogen sulfide, carbon dioxide, and/or carbon monoxide), excess gaseous hydrogen source, and/or carrier gas. The excess gas may be recycled to contacting system 100, purified, transported to other processing zones, storage vessels, or combinations thereof.

In some embodiments, contacting the crude feed with the catalyst(s) to produce a total product is performed in two or more contacting zones. The total product may be separated to form the crude product and gas(es).

Figure 2A:
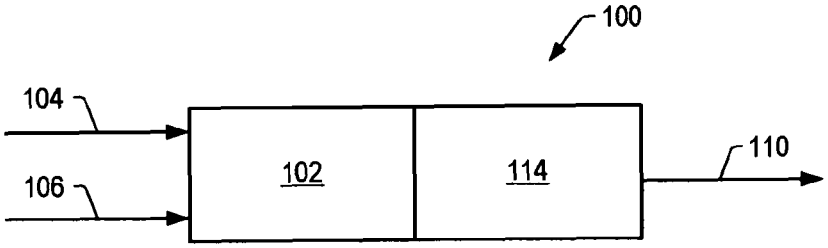
FIGS. 2A and 2B are schematics of embodiments of contacting systems that include two contacting zones.
Figure 2B:
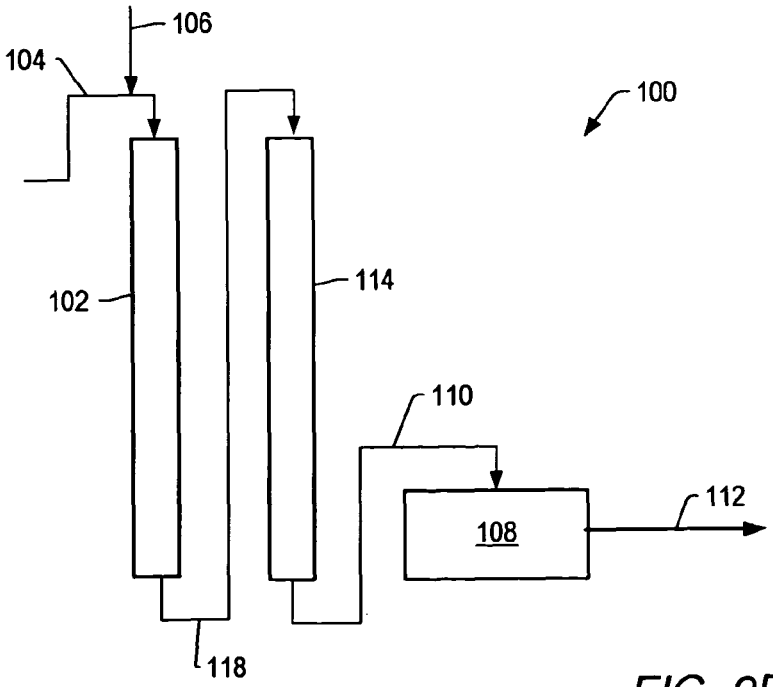
Figure 3A:
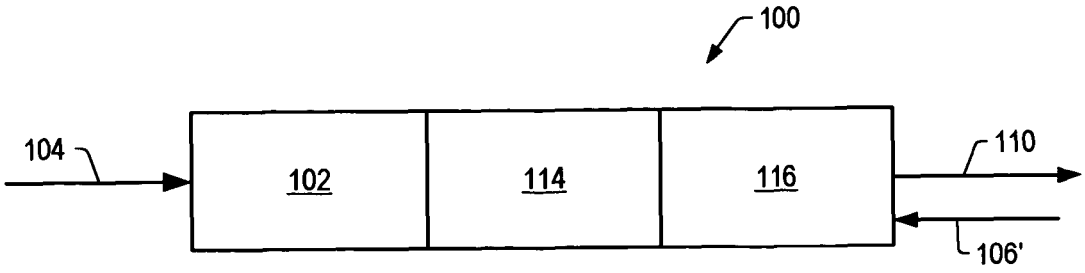
FIGS. 3A and 3B are schematics of embodiments of contacting systems that include three contacting zones.
Figure 3B:
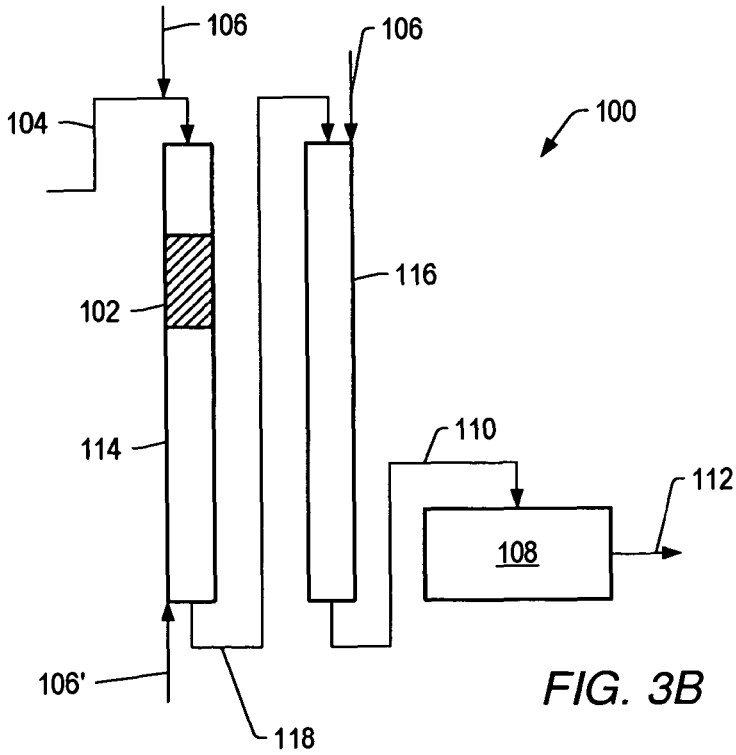

FIGS. 2-3 are schematics of embodiments of contacting system 100 that includes two or three contacting zones. In FIGS. 2A and 2B, contacting system 100 includes upstream contacting zone 102 and downstream contacting zone 114. FIGS. 3A and 3B include contacting zones 102, 114, 116. In FIGS. 2A and 3A, contacting zones 102, 114, 116 are depicted as separate contacting zones in one reactor. The crude feed enters upstream contacting zone 102 via crude feed conduit 104.

In some embodiments, the carrier gas is combined with the hydrogen source in gas conduit 106 and is introduced into the contacting zones as a mixture. In certain embodiments, as shown in FIGS. 3A and 3B, the hydrogen source and/or the carrier gas may enter the one or more contacting zones with the crude feed separately via gas conduit 106 and/or in a direction counter to the flow of the crude feed via, for example, gas conduit 106'. Addition of the hydrogen source and/or the carrier gas counter to the flow of the crude feed may enhance mixing and/or contact of the crude feed with the catalyst.

Contact of the crude feed with catalyst(s) in upstream contacting zone 102 forms a feed stream. The feed stream flows from upstream contacting zone 102 to downstream contacting zone 114. In FIGS. 3A and 3B, the feed stream flows from downstream contacting zone 114 to additional downstream contacting zone 116.

Contacting zones 102, 114, 116 may include one or more catalysts. As shown in FIG. 2B, the feed stream exits upstream contacting zone 102 via feed stream conduit 118 and enters downstream contacting zone 114. As shown in FIG. 3B, the feed stream exits downstream contacting zone 114 via conduit 118 and enters additional downstream contacting zone 116.

The feed stream may be contacted with additional catalyst (s) in downstream contacting zone 114 and/or additional downstream contacting zone 116 to form the total product. The total product exits downstream contacting zone 114 and/or additional downstream contacting zone 116 and enters downstream separation zone 108 via total product conduit 110. The crude product and/or gas is (are) separated from the total product. The crude product exits downstream separation zone 108 via crude product conduit 112.

Figure 4:
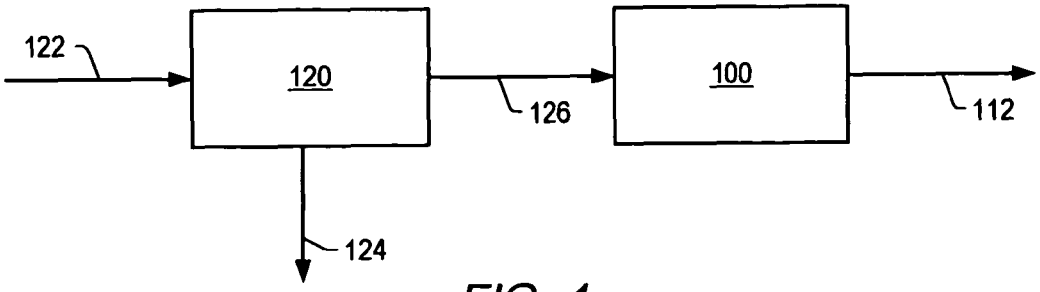
FIG. 4 is a schematic of an embodiment of a separation zone in combination with a contacting system.

FIG. 4 is a schematic of an embodiment of a separation zone upstream of contacting system 100. The disadvantaged crude (either topped or untopped) enters upstream separation zone 120 via crude conduit 122. In upstream separation zone 120, at least a portion of the disadvantaged crude is separated using techniques known in the art (for example, sparging, membrane separation, pressure reduction) to produce the crude feed. For example, water may be at least partially separated from the disadvantaged crude. In another example, components that have a boiling range distribution below 95° C. or below 100° C. may be at least partially separated from the disadvantaged crude to produce the crude feed. In some embodiments, at least a portion of naphtha and compounds more volatile than naphtha are separated from the disadvantaged crude. In some embodiments, at least a portion of the separated components exit upstream separation zone 120 via conduit 124.

The crude feed obtained from upstream separation zone 120, in some embodiments, includes a mixture of components with a boiling range distribution of at least 100° C. or, in some embodiments, a boiling range distribution of at least 120° C. Typically, the separated crude feed includes a mixture of components with a boiling range distribution between about 100-1000° C., about 120-900° C., or about 200-800° C. At least a portion of the crude feed exits upstream separation zone 120 and enters contacting system 100 (see, for example, the contacting zones in FIGS. 1-3) via additional crude feed conduit 126 to be further processed to form a crude product. In some embodiments, upstream separation zone 120 may be positioned upstream or downstream of a desalting unit. After processing, the crude product exits contacting system 100 via crude product conduit 112.

In some embodiments, the crude product is blended with a crude that is the same as or different from the crude feed. For example, the crude product may be combined with a crude having a different viscosity thereby resulting in a blended product having a viscosity that is between the viscosity of the crude product and the viscosity of the crude. In another example, the crude product may be blended with crude having a TAN that is different, thereby producing a product that has a TAN that is between the TAN of the crude product and the crude. The blended product may be suitable for transportation and/or treatment.

Figure 5:
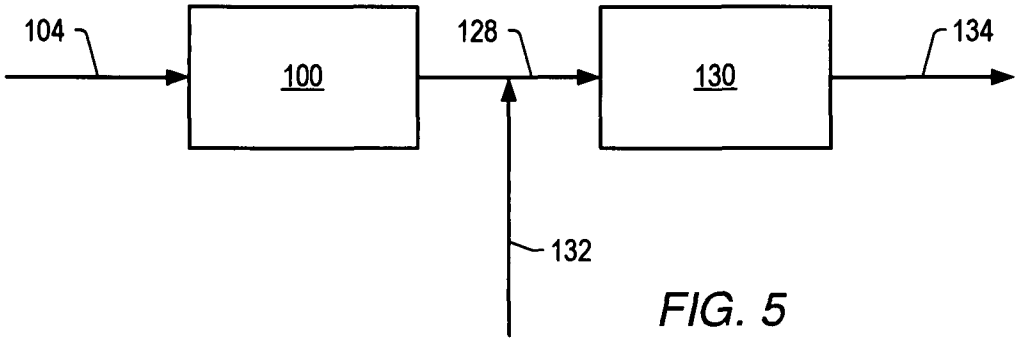
FIG. 5 is a schematic of an embodiment of a blending zone in combination with a contacting system.

As shown in FIG. 5, in certain embodiments, crude feed enters contacting system 100 via crude feed conduit 104, and at least a portion of the crude product exits contacting system 100 via conduit 128 and is introduced into blending zone 130. In blending zone 130, at least a portion of the crude product is combined with one or more process streams (for example, a hydrocarbon stream such as naphtha produced from separation of one or more crude feeds), a crude, a crude feed, or mixtures thereof, to produce a blended product. The process streams, crude feed, crude, or mixtures thereof are introduced directly into blending zone 130 or upstream of such blending zone via stream conduit 132. A mixing system may be located in or near blending zone 130. The blended product may meet product specifications designated by refineries and/or transportation carriers. Product specifications include, but are not limited to, a range of or a limit of API gravity, TAN, viscosity, or combinations thereof. The blended product exits blending zone 130 via blend conduit 134 to be transported or processed.

Figure 6:
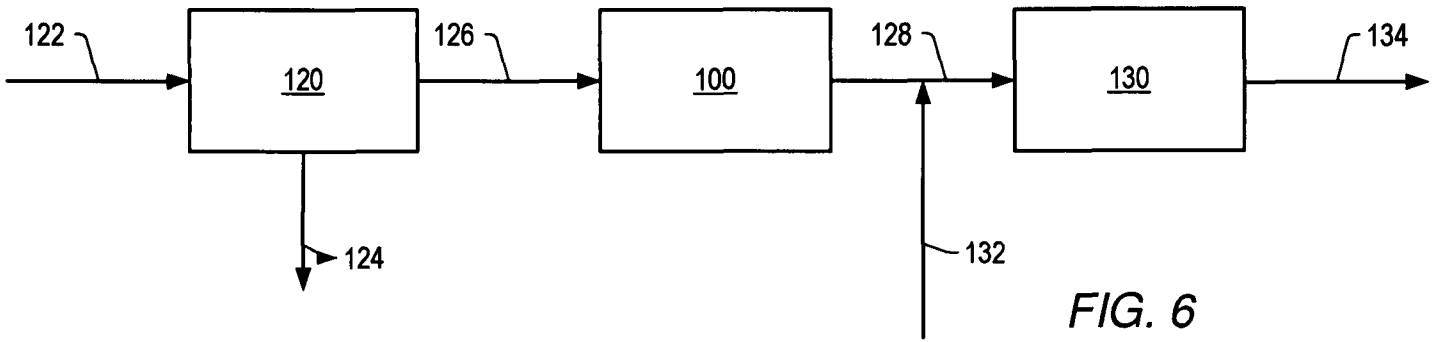
FIG. 6 is a schematic of an embodiment of a combination of a separation zone, a contacting system, and a blending zone.

In FIG. 6, the disadvantaged crude enters upstream separation zone 120 through crude conduit 122, and the disadvantaged crude is separated as previously described to form the crude feed. The crude feed then enters contacting system 100 through additional crude feed conduit 126. At least some components from the disadvantaged crude exit separation zone 120 via conduit 124. At least a portion of the crude product exits contacting system 100 and enters blending zone 130 through crude product conduit 128. Other process streams and/or crudes enter blending zone 130 directly or via stream conduit 132 and are combined with the crude product to form a blended product. The blended product exits blending zone 130 via blend conduit 134.

In some embodiments, the crude product and/or the blended product are transported to a refinery and distilled and/or fractionally distilled to produce one or more distillate fractions. The distillate fractions may be processed to produce commercial products such as transportation fuel, lubricants, or chemicals.

In some embodiments, after contact of the crude feed with the catalyst, the crude product has a TAN of at most 90%, at most 50%, or at most 10% of the TAN of the crude feed. In certain embodiments, the crude product has a TAN of at most 1, at most 0.5, at most 0.3, at most 0.2, at most 0.1, or at most 0.05. TAN of the crude product will frequently be at least 0.0001 and, more frequently, at least 0.001. In some embodiments, TAN of the crude product may be in a range from about 0.001 to about 0.5, about 0.01 to about 0.2, or about 0.05 to about 0.1.

In some embodiments, the crude product has a total Ni/V/Fe content of at most 90%, at most 50%, at most 10%, at most 5%, or at most 3% of the Ni/V/Fe content of the crude feed. In certain embodiments, the crude product has, per gram of crude product a total Ni/V/Fe content in a range from about $1\times10^{-7}$ grams to about $5\times10^{-5}$ grams, about $3\times10^{-7}$ grams to about $2\times10^{-5}$ grams, or about $1\times10^{-6}$ grams to about $1\times10^{-5}$ grams. In certain embodiments, the crude product has at most $2\times10^{-5}$ grams of Ni/V/Fe. In some embodiments, a total Ni/V/Fe content of the crude product is about 70-130%, about 80-120%, or about 90-110% of the Ni/V/Fe content of the crude feed.

In some embodiments, the crude product has a total content of metals in metal salts of organic acids of at most 90%, at most 50%, at most 10%, or at most 5% of the total content of metals in metal salts of organic acids in the crude feed. Organic acids that generally form metal salts include, but are not limited to, carboxylic acids, thiols, imides, sulfonic acids, and sulfonates. Examples of carboxylic acids include, but are not limited to, naphthenic acids, phenanthrenic acids, and benzoic acid. The metal portion of the metal salts may include alkali metals (for example, lithium, sodium, and potassium), alkaline-earth metals (for example, magnesium, calcium, and barium), Column 12 metals (for example, zinc and cadmium), Column 15 metals (for example arsenic), Column 6 metals (for example, chromium), or mixtures thereof.

In certain embodiments, the crude product has a total content of metals in metal salts of organic acids, per gram of crude product, in a range from about 0.0000001 grams to about 0.00005 grams, about 0.0000003 grams to about 0.00002 grams, or about 0.000001 grams to about 0.00001 grams of metals in metal salt of organic acids per gram of crude product. In some embodiments, a total content of metals in metal salts of organic acids of the crude product is about 70-130%, about 80-120%, or about 90-110% of the total content of metals in metal salts of organic acids in the crude feed.

In certain embodiments, API gravity of the crude product produced from contact of the crude feed with catalyst, at the contacting conditions, is about 70-130%, about 80-120%, about 90-110%, or about 100-130% of the API gravity of the crude feed. In certain embodiments, API gravity of the crude product is from about 14-40, about 15-30, or about 16-25.

In certain embodiments, the crude product has a viscosity of at most 90%, at most 80%, or at most 70% of the viscosity of the crude feed. In some embodiments, the viscosity of the crude product is at most 90% of the viscosity of the crude feed while the API gravity of the crude product is about 70-130%, about 80-120%, or about 90-110% of the API gravity the crude feed.

In some embodiments, the crude product has a total heteroatoms content of at most 90%, at most 50%, at most 10%, or at most 5% of the total heteroatoms content of the crude feed. In certain embodiments, the crude product has a total heteroatoms content of at least 1%, at least 30%, at least 80%, or at least 99% of the total heteroatoms content of the crude feed.

In some embodiments, the sulfur content of the crude product may be at most 90%, at most 50%, at most 10%, or at most 5% of the sulfur content of the crude product. In certain embodiments, the crude product has a sulfur content of at least 1%, at least 30%, at least 80%, or at least 99% of the sulfur content of the crude feed. In some embodiments, the sulfur content of the crude product is about 70-130%, about 80-120%, or about 90-110% of the sulfur content of the crude feed.

In some embodiments, total nitrogen content of the crude product may be at most 90%, at most 80%, at most 10%, or at most 5% of a total nitrogen content of the crude feed. In certain embodiments, the crude product has a total nitrogen content of at least 1%, at least 30%, at least 80%, or at least 99% of the total nitrogen content of the crude feed.

In some embodiments, basic nitrogen content of the crude product may at most 95%, at most 90%, at most 50%, at most 10%, or at most 5% of the basic nitrogen content of the crude feed. In certain embodiments, the crude product has a basic nitrogen content of at least 1%, at least 30%, at least 80%, or at least 99% of the basic nitrogen content of the crude feed.

In some embodiments, the oxygen content of the crude product may be at most 90%, at most 50%, at most 30%, at most 10%, or at most 5% of the oxygen content of the crude feed. In certain embodiments, the crude product has a oxygen content of at least 1%, at least 30%, at least 80%, or at least 99% of the oxygen content of the crude feed. In some embodiments, the total content of carboxylic acid compounds of the crude product may be at most 90%, at most 50%, at most 10%, at most 5% of the content of the carboxylic acid compounds in the crude feed. In certain embodiments, the crude product has a total content of carboxylic acid compounds of at least 1%, at least 30%, at least 80%, or at least 99% of the total content of carboxylic acid compounds in the crude feed.

In some embodiments, selected organic oxygen compounds may be reduced in the crude feed. In some embodiments, carboxylic acids and/or metal salts of carboxylic acids may be chemically reduced before non-carboxylic containing organic oxygen compounds. Carboxylic acids and non-carboxylic containing organic oxygen compounds in a crude product may be differentiated through analysis of the crude product using generally known spectroscopic methods (for example, infrared analysis, mass spectrometry, and/or gas chromatography).

The crude product, in certain embodiments, has an oxygen content of at most 90%, at most 80%, at most 70%, or at most 50% of the oxygen content of the crude feed, and TAN of the crude product is at most 90%, at most 70%, at most 50%, or at most 40% of the TAN of the crude feed. In certain embodiments, the crude product has an oxygen content of at least 1%, at least 30%, at least 80%, or at least 99% of the oxygen content of the crude feed, and the crude product has a TAN of at least 1%, at least 30%, at least 80%, or at least 99% of the TAN of the crude feed.

Additionally, the crude product may have a content of carboxylic acids and/or metal salts of carboxylic acids of at most 90%, at most 70%, at most 50%, or at most 40% of the crude feed, and a content of non-carboxylic containing organic oxygen compounds within about 70-130%, about 80-120%, or about 90-110% of the non-carboxylic containing organic oxygen compounds of the crude feed.

In some embodiments, the crude product includes, in its molecular structures, from about 0.05-0.15 grams or from about 0.09-0.13 grams of hydrogen per gram of crude product. The crude product may include, in its molecular structure, from about 0.8-0.9 grams or from about 0.82-0.88 grams of carbon per gram of crude product. A ratio of atomic hydrogen to atomic carbon (H/C) of the crude product may be within about 70-130%, about 80-120%, or about 90-110% of the atomic H/C ratio of the crude feed. A crude product atomic H/C ratio within about 10-30% of the crude feed atomic H/C ratio indicates that uptake and/or consumption of hydrogen in the process is relatively small, and/or that hydrogen is produced in situ.

The crude product includes components with a range of boiling points. In some embodiments, the crude product includes, per gram of the crude product: at least 0.001 grams, or from about 0.001-0.5 grams of hydrocarbons with a boiling range distribution of at most 100° C. at 0.101 MPa; at least 0.001 grams, or from about 0.001-0.5 grams of hydrocarbons with a boiling range distribution between about 100° C. and about 200° C. at 0.101 MPa; at least 0.001 grams, or from about 0.001-0.5 grams of hydrocarbons with a boiling range distribution between about 200° C. and about 300° C. at 0.101 MPa; at least 0.001 grams, or from about 0.001-0.5 grams of hydrocarbons with a boiling range distribution between about 300° C. and about 400° C. at 0.101 MPa; and at least 0.001 grams, or from about 0.001-0.5 grams of hydrocarbons with a boiling range distribution between about 400° C. and about 538° C. at 0.101 MPa.

In some embodiments the crude product includes, per gram of crude product, at least 0.001 grams of hydrocarbons with a boiling range distribution of at most 100° C. at 0.101 MPa and/or at least 0.001 grams of hydrocarbons with a boiling range distribution between about 100° C. and about 200° C. at 0.101 MPa.

In some embodiments, the crude product may have at least 0.001 grams, or at least 0.01 grams of naphtha per gram of crude product. In other embodiments, the crude product may have a naphtha content of at most 0.6 grams, or at most 0.8 grams of naphtha per gram of crude product.

In some embodiments, the crude product has a distillate content of about 70-130%, about 80-120%, or about 90-110% of the distillate content of the crude feed. The distillate content of the crude product may be, per gram of crude product, in a range from about 0.00001-0.5 grams, about 0.001-0.3 grams, or about 0.002-0.2 grams.

In certain embodiments, the crude product has a VGO content of about 70-130%, about 80-120%, or about 90-110% of the VGO content of the crude feed. In some embodiments, the crude product has, per gram of crude product, a VGO content in a range from about 0.00001-0.8 grams, about 0.001-0.5 grams, about 0.002-0.4 grams, or about 0.001-0.3 grams.

In some embodiments, the crude product has a residue content of about 70-130%, about 80-120%, or about 90-110% of the residue content of the crude feed. The crude product may have, per gram of crude product, a residue content in a range from about 0.00001-0.8 grams, about 0.0001-0.5 grams, about 0.0005-0.4 grams, about 0.001-0.3 grams, about 0.005-0.2 grams, or about 0.01-0.1 grams.

In certain embodiments, the crude product has a MCR content of about 70-130%, about 80-120%, or about 90-110% of the MCR content of the crude feed, while the crude product has a $C_5$ asphaltenes content of at most 90%, at most 80%, or at most 50% of the $C_5$ asphaltenes content of the crude feed. In certain embodiments, the $C_5$ asphaltenes content of the crude feed is at least 10%, at least 60%, or at least 70% of the $C_5$ asphaltenes content of the crude feed while the MCR content of the crude product is within 10-30% of the MCR content of the crude feed. In some embodiments, decreasing the $C_5$ asphaltenes content of the crude feed while maintaining a relatively stable MCR content may increase the stability of the crude feed/total product mixture.

In some embodiments, the $C_5$ asphaltenes content and MCR content may be combined to produce a mathematical relationship between the high viscosity components in the crude product relative to the high viscosity components in the crude feed. For example, a sum of a crude feed $C_5$ asphaltenes content and a crude feed MCR content may be represented by S. A sum of a crude product $C_5$ asphaltenes content and a crude product MCR content may be represented by S'. The sums may be compared (S' to S) to assess the net reduction in high viscosity components in the crude feed. S' of the crude product may be in a range from about 1-99%, about 10-90%, or about 20-80% of S. In some embodiments, a ratio of MCR content of the crude product to $C_5$ asphaltenes content is in a range from about 1.0-3.0, about 1.2-2.0, or about 1.3-1.9.

In certain embodiments, the crude product has an MCR content that is at most 90%, at most 80%, at most 50%, or at most 10% of the MCR content of the crude feed. The crude product has, in some embodiments, from about 0.0001-0.1 grams, 0.005-0.08 grams, or 0.01-0.05 grams of MCR per gram of crude product. In some embodiments, the crude product includes from greater than 0 grams, but less than 0.01 grams, about 0.000001-0.001 grams, or about 0.00001-0.0001 grams of total catalyst per gram of crude product. The catalyst may assist in stabilizing the crude product during transportation and/or treatment. The catalyst may inhibit corrosion, inhibit friction, and/or increase water separation abilities of the crude product. Methods described herein may be configured to add one or more catalysts described herein to the crude product during treatment.

The crude product produced from contacting system 100 has properties different than properties of the crude feed. Such properties may include, but are not limited to: a) reduced TAN; b) reduced viscosity; c) reduced total Ni/V/Fe content; d) reduced content of sulfur, oxygen, nitrogen, or combinations thereof; e) reduced residue content; f) reduced $C_5$ asphaltenes content; g) reduced MCR content; h) increased API gravity; i) a reduced content of metals in metal salts of organic acids; or j) combinations thereof. In some embodiments, one or more properties of the crude product, relative to the crude feed, may be selectively changed while other properties are not changed as much, or do not substantially change. For example, it may be desirable to only selectively reduce TAN in a crude feed without also significantly changing the amount of other components (for example, sulfur, residue, Ni/V/Fe, or VGO). In this manner, hydrogen uptake during contacting may be "concentrated" on TAN reduction, and not on reduction of other components. Thus, the TAN of the crude feed can be reduced, while using less hydrogen, since less of such hydrogen is also being used to reduce other components in the crude feed. If, for example, a disadvantaged crude has a high TAN, but a sulfur content that is acceptable to meet treatment and/or transportation specifications, then such crude feed may be more efficiently treated to reduce TAN without also reducing sulfur.

Catalysts used in one or more embodiments of the inventions may include one or more bulk metals and/or one or more metals on a support. The metals may be in elemental form or in the form of a compound of the metal. The catalysts described herein may be introduced into the contacting zone as a precursor, and then become active as a catalyst in the contacting zone (for example, when sulfur and/or a crude feed containing sulfur is contacted with the precursor). The catalyst or combination of catalysts used as described herein may or may not be commercial catalysts. Examples of commercial catalysts that are contemplated to be used as described herein include HDS3; HDS22; HDN60; C234; C311; C344; C411; C424; C344; C444; C447; C454; C448; C524; C534; DN110; DN120; DN130; DN140; DN190; DN200; DN800; DN2118; DN2318; DN3100; DN3110; DN3300; DN3310; RC400; RC410; RN412; RN400; RN420; RN440; RN450; RN650; RN5210; RN5610; RN5650; RM430; RM5030; Z603; Z623; Z673: Z703; Z713; Z723; Z753; and Z763, which are available from CRI International, Inc. (Houston, Tex., U.S.A.).

In some embodiments, catalysts used to change properties of the crude feed include one or more Columns 5-10 metals on a support. Columns 5-10 metal(s) include, but are not limited to, vanadium, chromium, molybdenum, tungsten, manganese, technetium, rhenium, iron, cobalt, nickel, ruthenium, palladium, rhodium, osmium, iridium, platinum, or mixtures thereof. The catalyst may have, per gram of catalyst, a total Columns 5-10 metal(s) content in a range from at least 0.0001 grams, at least 0.001 grams, at least 0.01 grams, or in a range about 0.0001-0.6 grams, about 0.001-0.3 grams, about 0.005-0.1 grams, or about 0.01-0.08 grams. In some embodiments, the catalyst includes Column 15 element(s) in addition to the Columns 5-10 metal(s). Examples of Column 15 elements include phosphorus. The catalyst may have a total Column 15 element content, per gram of catalyst, in range from about 0.000001-0.1 grams, about 0.00001-0.06 grams, about 0.00005-0.03 grams, or about 0.0001-0.001 grams.

In certain embodiments, the catalyst includes Column 6 metal(s). The catalyst may have, per gram of catalyst, a total Column 6 metal(s) content of at least 0.00001, at least 0.01 grams, at least 0.02 grams and/or in a range from about 0.0001-0.6 grams, about 0.001-0.3 grams, about 0.005-0.1 grams, or about 0.01-0.08 grams. In some embodiments, the catalyst includes from about 0.0001-0.06 grams of Column 6 metal(s) per gram of catalyst. In some embodiments, the catalyst includes Column 15 element(s) in addition to the Column 6 metal(s).

In some embodiments, the catalyst includes a combination of Column 6 metal(s) with one or more metals from Column 5 and/or Columns 7-10. A molar ratio of Column 6 metal to Column 5 metal may be in a range from about 0.1-20, about 1-10, or about 2-5. A molar ratio of Column 6 metal to Columns 7-10 metal may be in a range from about 0.1-20, about 1-10, or about 2-5. In some embodiments, the catalyst includes Column 15 element(s) in addition to the combination of Column 6 metal(s) with one or more metals from Columns 5 and/or 7-10. In other embodiments, the catalyst includes Column 6 metal(s) and Column 10 metal(s). A molar ratio of the total Column 10 metal to the total Column 6 metal in the catalyst may be in a range from about 1-10, or from about 2-5. In certain embodiments, the catalyst includes Column 5 metal(s) and Column 10 metal(s). A molar ratio of the total Column 10 metal to the total Column 5 metal in the catalyst may be in a range from about 1-10, or from about 2-5.

In some embodiments, Columns 5-10 metal(s) are incorporated in, or deposited on, a support to form the catalyst. In certain embodiments, Columns 5-10 metal(s) in combination with Column 15 element(s) are incorporated in, or deposited on, the support to form the catalyst. In embodiments in which the metal(s) and/or element(s) are supported, the weight of the catalyst includes all support, all metal(s), and all element (s). The support may be porous and may include refractory oxides, porous carbon based materials, zeolites, or combinations thereof. Refractory oxides may include, but are not limited to, alumina, silica, silica-alumina, titanium oxide, zirconium oxide, magnesium oxide, or mixtures thereof. Supports may be obtained from a commercial manufacturer such as Criterion Catalysts and Technologies LP (Houston, Tex., U.S.A.). Porous carbon based materials include, but are not limited to, activated carbon and/or porous graphite. Examples of zeolites include Y-zeolites, beta zeolites, mordenite zeolites, ZSM-5 zeolites, and ferrierite zeolites. Zeolites may be obtained from a commercial manufacturer such as Zeolyst (Valley Forge, Pa., U.S.A.).

The support, in some embodiments, is prepared such that the support has an average pore diameter of at least 150 Å, at least 170 Å, or at least 180 Å. In certain embodiments, a support is prepared by forming an aqueous paste of the support material. In some embodiments, an acid is added to the paste to assist in extrusion of the paste. The water and dilute acid are added in such amounts and by such methods as required to give the extrudable paste a desired consistency. Examples of acids include, but are not limited to, nitric acid, acetic acid, sulfuric acid, and hydrochloric acid.

The paste may be extruded and cut using generally known catalyst extrusion methods and catalyst cutting methods to form extrudates. The extrudates may be heat treated at a temperature in a range from about 65-260° C. or from about 85-235° C. for a period of time (for example, for about 0.5-8 hours) and/or until the moisture content of the extrudate has reached a desired level. The heat treated extrudate may be further heat treated at a temperature in a range from about 800-1200° C. or about 900-1100° C.) to form the support having an average pore diameter of at least 150 Å.

In certain embodiments, the support includes gamma alumina, theta alumina, delta alumina, alpha alumina, or combinations thereof. The amount of gamma alumina, delta alumina, alpha alumina, or combinations thereof, per gram of catalyst support, may be in a range from about 0.0001-0.99 grams, about 0.001-0.5 grams, about 0.01-0.1 grams, or at most 0.1 grams as determined by x-ray diffraction. In some embodiments, the support has, either alone or in combination with other forms of alumina, a theta alumina content, per gram of support, in a range from about 0.1-0.99 grams, about 0.5-0.9 grams, or about 0.6-0.8 grams, as determined by x-ray diffraction. In some embodiments, the support may have at least 0.1 grams, at least 0.3 grams, at least 0.5 grams, or at least 0.8 grams of theta alumina, as determined by x-ray diffraction.

Supported catalysts may be prepared using generally known catalyst preparation techniques. Examples of catalyst preparations are described in U.S. Pat. No. 6,218,333 to Gabrielov et al.; U.S. Pat. No. 6,290,841 to Gabrielov et al.; and U.S. Pat. No. 5,744,025 to Boon et al., and U.S. Patent Application Publication No. 20030111391 to Bhan, all of which are incorporated herein by reference.

In some embodiments, the support may be impregnated with metal to form a catalyst. In certain embodiments, the support is heat treated at temperatures in a range from about 400-1200° C., about 450-1000° C., or about 600-900° C. prior to impregnation with a metal. In some embodiments, impregnation aids may be used during preparation of the catalyst. Examples of impregnation aids include a citric acid component, ethylenediaminetetraacetic acid (EDTA), ammonia, or mixtures thereof.

In certain embodiments, a catalyst may be formed by adding or incorporating the Columns 5-10 metal(s) to heat treated shaped mixtures of support ("overlaying"). Overlaying a metal on top of the heat treated shaped support having a substantially or relatively uniform concentration of metal often provides beneficial catalytic properties of the catalyst. Heat treating of a shaped support after each overlay of metal tends to improve the catalytic activity of the catalyst. Methods to prepare a catalyst using overlay methods are described in U.S. Patent Application Publication No. 20030111391 to Bhan.

The Columns 5-10 metal(s) and support may be mixed with suitable mixing equipment to form a Columns 5-10 metal(s)/support mixture. The Columns 5-10 metal(s)/support mixture may be mixed using suitable mixing equipment. Examples of suitable mixing equipment include tumblers, stationary shells or troughs, Muller mixers (for example, batch type or continuous type), impact mixers, and any other generally known mixer, or generally known device, that will suitably provide the Columns 5-10 metal(s)/support mixture. In certain embodiments, the materials are mixed until the Columns 5-10 metal(s) is (are) substantially homogeneously dispersed in the support.

In some embodiments, the catalyst is heat treated at temperatures from about 150-750° C., from about 200-740° C., or from about 400-730° C. after combining the support with the metal.

In some embodiments, the catalyst may be heat treated in the presence of hot air and/or oxygen rich air at a temperature in a range between 400° C. and 1000° C. to remove volatile matter such that at least a portion of the Columns 5-10 metals are converted to the corresponding metal oxide.

In other embodiments, however, the catalyst may be heat treated in the presence of air at temperatures in a range from about 35-500° C. for a period of time in a range from 1-3 hours to remove a majority of the volatile components without converting the Columns 5-10 metals to the metal oxide. Catalysts prepared by such a method are generally referred to as "uncalcined" catalysts. When catalysts are prepared in this manner in combination with a sulfiding method, the active metals may be substantially dispersed in the support. Preparations of such catalysts are described in U.S. Pat. No. 6,218,333 to Gabrielov et al., and U.S. Pat. No. 6,290,841 to Gabrielov et al.

In certain embodiments, a theta alumina support may be combined with Columns 5-10 metals to form a theta alumina support/Columns 5-10 metals mixture. The theta alumina support/Columns 5-10 metals mixture may be heat treated at a temperature of at least 400° C. to form the catalyst having a pore size distribution with a median pore diameter of at least 230 Å. Typically, such heat treating is conducted at temperatures of at most 1200° C.

In some embodiments, the support (either a commercial support or a support prepared as described herein) may be combined with a supported catalyst and/or a bulk metal catalyst. In some embodiments, the supported catalyst may include Column 15 metal(s). For example, the supported catalyst and/or the bulk metal catalyst may be crushed into a powder with an average particle size from about 1-50 microns, about 2-45 microns, or about 5-40 microns. The powder may be combined with support to form an embedded metal catalyst. In some embodiments, the powder may be combined with the support and then extruded using standard techniques to form a catalyst having a pore size distribution with a median pore diameter in a range from about 80-200 Å or about 90-180 Å, or about 120-130 Å.

Combining the catalyst with the support allows, in some embodiments, at least a portion of the metal to reside under the surface of the embedded metal catalyst (for example, embedded in the support), leading to less metal on the surface than would otherwise occur in the unembedded metal catalyst. In some embodiments, having less metal on the surface of the catalyst extends the life and/or catalytic activity of the catalyst by allowing at least a portion of the metal to move to the surface of the catalyst during use. The metals may move to the surface of the catalyst through erosion of the surface of the catalyst during contact of the catalyst with a crude feed.

Intercalation and/or mixing of the components of the catalysts changes, in some embodiments, the structured order of the Column 6 metal in the Column 6 oxide crystal structure to a substantially random order of Column 6 metal in the crystal structure of the embedded catalyst. The order of the Column 6 metal may be determined using powder x-ray diffraction methods. The order of elemental metal in the catalyst relative to the order of elemental metal in the metal oxide may be determined by comparing the order of the Column 6 metal peak in an x-ray diffraction spectrum of the Column 6 oxide to the order of the Column 6 metal peak in an x-ray diffraction spectrum of the catalyst. From broadening and/or absence of patterns associated with Column 6 metal in an x-ray diffraction spectrum, it is possible to estimate that the Column 6 metal(s) are substantially randomly ordered in the crystal structure.

For example, molybdenum trioxide and the alumina support having a median pore diameter of at least 180 Å may be combined to form an alumina/molybdenum trioxide mixture. The molybdenum trioxide has a definite pattern (for example, definite $D_{001}$, $D_{002}$ and/or $D_{003}$ peaks). The alumina/Column 6 trioxide mixture may be heat treated at a temperature of at least 538° C. (1000° F.) to produce a catalyst that does not exhibit a pattern for molybdenum dioxide in an x-ray diffraction spectrum (for example, an absence of the $D_{001}$ peak).

In some embodiments, catalysts may be characterized by pore structure. Various pore structure parameters include, but are not limited to, pore diameter, pore volume, surface areas, or combinations thereof. The catalyst may have a distribution of total quantity of pore sizes versus pore diameters. The median pore diameter of the pore size distribution may be in a range from about 30-1000 Å, about 50-500 Å, or about 60-300 Å. In some embodiments, catalysts that include at least 0.5 grams of gamma alumina per gram of catalyst have a pore size distribution with a median pore diameter in a range from about 60-200 Å; about 90-180 Å, about 100-140 Å, or about 120-130 Å. In other embodiments, catalysts that include at least 0.1 grams of theta alumina per gram of catalyst have a pore size distribution with a median pore diameter in a range from about 180-500 Å, about 200-300 Å, or about 230-250 Å. In some embodiments, the median pore diameter of the pore size distribution is at least 120 Å, at least 150 Å, at least 180 Å, at least 200 Å, at least 220 Å, at least 230 Å, or at least 300 Å. Such median pore diameters are typically at most 1000 Å.

The catalyst may have a pore size distribution with a median pore diameter of at least 60 Å or at least 90 Å. In some embodiments, the catalyst has a pore size distribution with a median pore diameter in a range from about 90-180 Å about 100-140 Å, or about 120-130 Å, with at least 60% of a total number of pores in the pore size distribution having a pore diameter within about 45 Å, about 35 Å, or about 25 Å of the median pore diameter. In certain embodiments, the catalyst has a pore size distribution with a median pore diameter in a range from about 70-180 Å, with at least 60% of a total number of pores in the pore size distribution having a pore diameter within about 45 Å, about 35 Å, or about 25 Å of the median pore diameter.

In embodiments in which the median pore diameter of the pore size distribution is at least 180 Å, at least 200 Å, or at least 230 Å, greater that 60% of a total number of pores in the pore size distribution have a pore diameter within about 50 Å, about 70 Å, or about 90 Å of the median pore diameter. In some embodiments, the catalyst has a pore size distribution with a median pore diameter in a range from about 180-500 Å, about 200-400 Å, or about 230-300 Å, with at least 60% of a total number of pores in the pore size distribution having a pore diameter within about 50 Å, about 70 Å, or about 90 Å of the median pore diameter.

In some embodiments, pore volume of pores may be at least 0.3 $cm^3/g$, at least 0.7 $cm^3/g$ or at least 0.9 $cm^3/g$. In certain embodiments, pore volume of pores may range from about 0.3-0.99 $cm^3/g$, about 0.4-0.8 $cm^3/g$, or about 0.5-0.7 $cm^3/g$.

The catalyst having a pore size distribution with a median pore diameter in a range from about 90-180 Å may, in some embodiments, have a surface area of at least 100 $m^2/g$, at least 120 $m^2/g$, at least 170 $m^2/g$, at least 220 or at least 270 $m^2/g$. Such surface area may be in a range from about 100-300 $m^2/g$, about 120-270 $m^2/g$, about 130-250 $m^2/g$, or about 170-220 $m^2/g$.

In certain embodiments, the catalyst having a pore size distribution with a median pore diameter in a range from about 180-300 Å may have a surface area of at least 60 $m^2/g$, at least 90 $m^2/g$, least 100 $m^2/g$, at least 120 $m^2/g$, or at least 270 $m^2/g$. Such surface area may be in a range from about 60-300 $m^2/g$, 90-280 $m^2/g$, about 100-270 $m^2/g$, or about 120-250 $m^2/g$.

In certain embodiments, the catalyst exists in shaped forms, for example, pellets, cylinders, and/or extrudates. The catalyst typically has a flat plate crush strength in a range from about 50-500 N/cm, about 60-400 N/cm, about 100-350 N/cm, about 200-300 N/cm, or about 220-280 N/cm.

In some embodiments, the catalyst and/or the catalyst precursor is sulfided to form metal sulfides (prior to use) using techniques known in the art (for example, ACTICAT™ process, CRI International, Inc.). In some embodiments, the catalyst may be dried then sulfided. Alternatively, the catalyst may be sulfided in situ by contact of the catalyst with a crude feed that includes sulfur-containing compounds. In-situ sulfurization may utilize either gaseous hydrogen sulfide in the presence of hydrogen, or liquid-phase sulfurizing agents such as organosulfur compounds (including alkylsulfides, polysulfides, thiols, and sulfoxides). Ex-situ sulfurization processes are described in U.S. Pat. No. 5,468,372 to Seamans et al., and U.S. Pat. No. 5,688,736 to Seamans et al., both of which are incorporated herein by reference.

In certain embodiments, a first type of catalyst ("first catalyst") includes Columns 5-10 metal(s) in combination with a support, and has a pore size distribution with a median pore diameter in a range from about 150-250 Å. The first catalyst may have a surface area of at least 100 $m^2/g$. The pore volume of the first catalyst may be at least 0.5 $cm^3/g$. The first catalyst may have a gamma alumina content of at least 0.5 grams of gamma alumina, and typically at most 0.9999 grams of gamma alumina, per gram of first catalyst. The first catalyst has, in some embodiments, a total content of Column 6 metal (s), per gram of catalyst, in a range from about 0.0001 to about 0.1 grams. The first catalyst is capable of removing a portion of the Ni/V/Fe from a crude feed, removing a portion of the components that contribute to TAN of a crude feed, removing at least a portion of the $C_5$ asphaltenes from a crude feed, removing at least a portion of the metals in metal salts of organic acids in the crude feed, or combinations thereof. Other properties (for example, sulfur content, VGO content, API gravity, residue content, or combinations thereof) may exhibit relatively small changes when the crude feed is contacted with the first catalyst. Being able to selectively change properties of a crude feed while only changing other properties in relatively small amounts may allow the crude feed to be more efficiently treated. In some embodiments, one or more first catalysts may be used in any order.

In certain embodiments, the second type of catalyst ("second catalyst") includes Columns 5-10 metal(s) in combination with a support, and has a pore size distribution with a median pore diameter in a range from about 90 Å to about 180 Å. At least 60% of the total number of pores in the pore size distribution of the second catalyst have a pore diameter within about 45 Å of the median pore diameter. Contact of the crude feed with the second catalyst under suitable contacting conditions may produce a crude product that has selected properties (for example, TAN) significantly changed relative to the same properties of the crude feed while other properties are only changed by a small amount. A hydrogen source, in some embodiments, may be present during contacting.

The second catalyst may reduce at least a portion of the components that contribute to the TAN of the crude feed, at least a portion of the components that contribute to relatively high viscosities, and reduce at least a portion of the Ni/V/Fe content of the crude product. Additionally, contact of crude feeds with the second catalyst may produce a crude product with a relatively small change in the sulfur content relative to the sulfur content of the crude feed. For example, the crude product may have a sulfur content of about 70%-130% of the sulfur content of the crude feed. The crude product may also exhibit relatively small changes in distillate content, VGO content, and residue content relative to the crude feed.

In some embodiments, the crude feed may have a relatively low content of Ni/V/Fe (for example, at most 50 wtppm), but a relatively high TAN, asphaltenes content, or content of metals in metal salts of organic acids. A relatively high TAN (for example, TAN of at least 0.3) may render the crude feed unacceptable for transportation and/or refining. A disadvantaged crude with a relatively high $C_5$ asphaltenes content may exhibit less stability during processing relative to other crudes with relatively low $C_5$ asphaltenes content. Contact of the crude feed with the second catalysts, may remove acidic components and/or $C_5$ asphaltenes contributing to TAN from the crude feed. In some embodiments, reduction of $C_5$ asphaltenes and/or components contributing to TAN may reduce the viscosity of the crude feed/total product mixture relative to the viscosity of the crude feed. In certain embodiments, one or more combinations of second catalysts may enhance stability of the total product/crude product mixture, increase catalyst life, allow minimal net hydrogen uptake by the crude feed, or combinations thereof, when used to treat crude feed as described herein.

In some embodiments, a third type of catalyst ("third catalyst") may be obtainable by combining a support with Column 6 metal(s) to produce a catalyst precursor. The catalyst precursor may be heated in the presence of one or more sulfur containing compounds at a temperature below 500° C. (for example, below 482° C.) for a relatively short period of time to form the uncalcined third catalyst. Typically, the catalyst precursor is heated to at least 100° C. for about 2 hours. In certain embodiments, the third catalyst may, per gram of catalyst, have a Column 15 element content in a range from about 0.001-0.03 grams, 0.005-0.02 grams, or 0.008-0.01 grams. The third catalyst may exhibit significant activity and stability when used to treat the crude feed as described herein. In some embodiments, the catalyst precursor is heated at temperatures below 500° C. in the presence of one or more sulfur compounds.

The third catalyst may reduce at least a portion of the components that contribute to the TAN of the crude feed, reduce at least a portion of the metals in metal salts of organic acids, reduce a Ni/V/Fe content of the crude product, and reduce the viscosity of the crude product. Additionally, contact of crude feeds with the third catalyst may produce a crude product with a relatively small change in the sulfur content relative to the sulfur content of the crude feed and with relatively minimal net hydrogen uptake by the crude feed. For example, a crude product may have a sulfur content of about 70%-130% of the sulfur content of the crude feed. The crude product produced using the third catalyst may also exhibit relatively small changes in API gravity, distillate content, VGO content, and residue content relative to the crude feed. The ability to reduce the TAN, the metals in metal salts of organic salts, the Ni/V/Fe content, and the viscosity of the crude product while also only changing by a small amount the API gravity, distillate content, VGO content, and residue contents relative to the crude feed, may allow the crude product to be used by a variety of treatment facilities.

The third catalyst, in some embodiments, may reduce at least a portion of the MCR content of the crude feed, while maintaining crude feed/total product stability. In certain embodiments, the third catalyst may have a Column 6 metal (s) content in a range from about 0.0001-0.1 grams, about 0.005-0.05 grams, or about 0.001-0.01 grams and a Column 10 metal(s) content in a range from about 0.0001-0.05 grams, about 0.005-0.03 grams, or about 0.001-0.01 grams per gram of catalyst. A Columns 6 and 10 metal(s) catalyst may facilitate reduction of at least a portion of the components that contribute to MCR in the crude feed at temperatures in a range from about 300-500° C. or about 350-450° C. and pressures in a range from about 0.1-10 MPa, about 1-8 MPa, or about 2-5 MPa.

In certain embodiments, a fourth type of catalyst ("fourth catalyst") includes Column 5 metal(s) in combination with a theta alumina support. The fourth catalyst has a pore size distribution with a median pore diameter of at least 180 Å. In some embodiments, the median pore diameter of the fourth catalyst may be at least 220 Å, at least 230 Å, at least 250 Å, or at least 300 Å. The support may include at least 0.1 grams, at least 0.5 grams, at least 0.8 grams, or at least 0.9 grams of theta alumina per gram of support. The fourth catalyst may include, in some embodiments, at most 0.1 grams of Column 5 metal(s) per gram of catalyst, and at least 0.0001 grams of Column 5 metal(s) per gram of catalyst. In certain embodiments, the Column 5 metal is vanadium.

In some embodiments, the crude feed may be contacted with an additional catalyst subsequent to contact with the fourth catalyst. The additional catalyst may be one or more of the following: the first catalyst, the second catalyst, the third catalyst, the fifth catalyst, the sixth catalyst, the seventh catalyst, commercial catalysts described herein, or combinations thereof.

In some embodiments, hydrogen may be generated during contacting of the crude feed with the fourth catalyst at a temperature in a range from about 300-400° C., about 320-380° C., or about 330-370° C. The crude product produced from such contacting may have a TAN of at most 90%, at most 80%, at most 50%, or at most 10% of the TAN of the crude feed. Hydrogen generation may be in a range from about 1-50 $Nm^3/m^3$, about 10-40 $Nm^3/m^3$, or about 15-25 $Nm^3/m^3$. The crude product may have a total Ni/V/Fe content of at most 90%, at most 80%, at most 70%, at most 50%, at most 10%, or at least 1% of total Ni/V/Fe content of the crude feed.

In certain embodiments, a fifth type of catalyst ("fifth catalyst") includes Column 6 metal(s) in combination with a theta alumina support. The fifth catalyst has a pore size distribution with a median pore diameter of at least 180 Å, at least 220 Å, at least 230 Å, at least 250 Å, at least 300 Å, or at most 500 Å. The support may include at least 0.1 grams, at least 0.5 grams, or at most 0.999 grams of theta alumina per gram of support. In some embodiments, the support has an alpha alumina content of below 0.1 grams of alpha alumina per gram of catalyst. The catalyst includes, in some embodiments, at most 0.1 grams of Column 6 metal(s) per gram of catalyst and at least 0.0001 grams of Column 6 metal(s) per gram of catalyst. In some embodiments, the Column 6 metal(s) are molybdenum and/or tungsten.

In certain embodiments, net hydrogen uptake by the crude feed may be relatively low (for example, from about 0.01-100 $Nm^3/m^3$) when the crude feed is contacted with the fifth catalyst at a temperature in a range from about 310-400° C., from about 320-370° C., or from about 330-360° C. Net hydrogen uptake by the crude feed may be in a range from about 1-20 $Nm^3/m^3$, about 2-15 $Nm^3/m^3$, or about 3-10 $Nm^3/m^3$. The crude product produced from contact of the crude feed with the fifth catalyst may have a TAN of at most 90%, at most 80%, at most 50%, or at most 10% of the TAN of the crude feed. TAN of the crude product may be in a range from about 0.01-0.1, about 0.03-0.05, or about 0.02-0.03.

In certain embodiments, a sixth type of catalyst ("sixth catalyst") includes Column 5 metal(s) and Column 6 metal(s) in combination with the theta alumina support. The sixth catalyst has a pore size distribution with a median pore diameter of at least 180 Å. In some embodiments, the median pore diameter of pore size distribution may be at least 220 Å, at least 230 Å, at least 250 Å, at least 300 Å, or at most 500 Å. The support may include at least 0.1 grams, at least 0.5 grams, at least 0.8 grams, at least 0.9 grams, or at most 0.99 grams of theta alumina per gram of support. The catalyst may include, in some embodiments, a total of Column 5 metal(s) and Column 6 metal(s) of at most 0.1 grams per gram of catalyst, and at least 0.0001 grams of Column 5 metal(s) and Column 6 metal(s) per gram of catalyst. In some embodiments, the molar ratio of total Column 6 metal to total Column 5 metal may be in a range from about 0.1-20, about 1-10, or about 2-5. In certain embodiments, the Column 5 metal is vanadium and the Column 6 metal(s) are molybdenum and/or tungsten.

When the crude feed is contacted with the sixth catalyst at a temperature in a range from about 310-400° C., from about 320-370° C., or from about 330-360° C., net hydrogen uptake by the crude feed may be in a range from about −10 $Nm^3/m^3$ to about 20 $Nm^3/m^3$, about −7 $Nm^3/m^3$ to about 10 $Nm^3/m^3$, or about −5 $Nm^3/m^3$ to about 5 $Nm^3/m^3$. Negative net hydrogen uptake is one indication that hydrogen is being generated in situ. The crude product produced from contact of the crude feed with the sixth catalyst may have a TAN of at most 90%, at most 80%, at most 50%, at most 10%, or at least 1% of the TAN of the crude feed. TAN of the crude product may be in a range from about 0.01-0.1, about 0.02-0.05, or about 0.03-0.04.

Low net hydrogen uptake during contacting of the crude feed with the fourth, fifth, or sixth catalyst reduces the overall requirement of hydrogen during processing while producing a crude product that is acceptable for transportation and/or treatment. Since producing and/or transporting hydrogen is costly, minimizing the usage of hydrogen in a process decreases overall processing costs.

In certain embodiments, a seventh type of catalyst ("seventh catalyst") has a total content of Column 6 metal(s) in a range from about 0.0001-0.06 grams of Column 6 metal(s) per gram of catalyst. The Column 6 metal is molybdenum and/or tungsten. The seventh catalyst is beneficial in producing a crude product that has a TAN of at most 90% of the TAN of the crude feed.

Other embodiments of the first, second, third, fourth, fifth, sixth, and seventh catalysts may also be made and/or used as is otherwise described herein.

Selecting the catalyst(s) of this application and controlling operating conditions may allow a crude product to be produced that has TAN and/or selected properties changed relative to the crude feed while other properties of the crude feed are not significantly changed. The resulting crude product may have enhanced properties relative to the crude feed and, thus, be more acceptable for transportation and/or refining.

Arrangement of two or more catalysts in a selected sequence may control the sequence of property improvements for the crude feed. For example, TAN, API gravity, at least a portion of the $C_5$ asphaltenes, at least a portion of the iron, at least a portion of the nickel, and/or at least a portion of the vanadium in the crude feed can be reduced before at least a portion of heteroatoms in the crude feed are reduced.

Arrangement and/or selection of the catalysts may, in some embodiments, improve lives of the catalysts and/or the stability of the crude feed/total product mixture. Improvement of a catalyst life and/or stability of the crude feed/total product mixture during processing may allow a contacting system to operate for at least 3 months, at least 6 months, or at least 1 year without replacement of the catalyst in the contacting zone.

Combinations of selected catalysts may allow reduction in at least a portion of the Ni/V/Fe, at least a portion of the $C_5$ asphaltenes, at least a portion of the metals in metal salts of organic acids, at least a portion of the components that contribute to TAN, at least a portion of the residue, or combinations thereof, from the crude feed before other properties of the crude feed are changed, while maintaining the stability of the crude feed/total product mixture during processing (for example, maintaining a crude feed P-value of above 1.5).

Alternatively, $C_5$ asphaltenes, TAN and/or API gravity may be incrementally reduced by contact of the crude feed with selected catalysts. The ability to incrementally and/or selectively change properties of the crude feed may allow the stability of the crude feed/total product mixture to be maintained during processing.

In some embodiments, the first catalyst (described above) may be positioned upstream of a series of catalysts. Such positioning of the first catalyst may allow removal of high molecular weight contaminants, metal contaminants, and/or metals in metal salts of organic acids, while maintaining the stability of the crude feed/total product mixture.

The first catalyst allows, in some embodiments, for removal of at least a portion of Ni/V/Fe, removal of acidic components, removal of components that contribute to a decrease in the life of other catalysts in the system, or combinations thereof, from the crude feed. For example, reducing at least a portion of $C_5$ asphaltenes in the crude feed/total product mixture relative to the crude feed inhibits plugging of other catalysts positioned downstream, and thus, increases the length of time the contacting system may be operated without replenishment of catalyst. Removal of at least a portion of the Ni/V/Fe from the crude feed may, in some embodiments, increase a life of one or more catalysts positioned after the first catalyst.

The second catalyst(s) and/or the third catalyst(s) may be positioned downstream of the first catalyst. Further contact of the crude feed/total product mixture with the second catalyst (s) and/or third catalyst(s) may further reduce TAN, reduce the content of Ni/V/Fe, reduce sulfur content, reduce oxygen content, and/or reduce the content of metals in metal salts of organic acids.

In some embodiments, contact of the crude feed with the second catalyst(s) and/or the third catalyst(s) may produce a crude feed/total product mixture that has a reduced TAN, a reduced sulfur content, a reduced oxygen content, a reduced content of metals in metal salts of organic acids, a reduced asphaltenes content, a reduced viscosity, or combinations thereof, relative to the respective properties of the crude feed while maintaining the stability of the crude feed/total product mixture during processing. The second catalyst may be positioned in series, either with the second catalyst being upstream of the third catalyst, or vice versa.

The ability to deliver hydrogen to specified contacting zones tends to minimize hydrogen usage during contacting. Combinations of catalysts that facility generation of hydrogen during contacting, and catalysts that uptake a relatively low amount of hydrogen during contacting, may be used to change selected properties of a crude product relative to the same properties of the crude feed. For example, the fourth catalyst may be used in combination with the first catalyst(s), second catalyst(s), third catalyst(s), fifth catalyst(s), sixth catalyst(s), and/or seventh catalyst(s) to change selected properties of a crude feed, while only changing other properties of the crude feed by selected amounts, and/or while maintaining crude feed/total product stability. The order and/or number of catalysts may be selected to minimize net hydrogen uptake while maintaining the crude feed/total product stability. Minimal net hydrogen uptake allows residue content, VGO content, distillate content, API gravity, or combinations thereof of the crude feed to be maintained within 20% of the respective properties of the crude feed, while the TAN and/or the viscosity of the crude product is at most 90% of the TAN and/or the viscosity of the crude feed.

Reduction in net hydrogen uptake by the crude feed may produce a crude product that has a boiling range distribution similar to the boiling point distribution of the crude feed, and a reduced TAN relative to the TAN of the crude feed. The atomic H/C of the crude product may also only change by relatively small amounts as compared to the atomic H/C of the crude feed.

Hydrogen generation in specific contacting zones may allow selective addition of hydrogen to other contacting zones and/or allow selective reduction of properties of the crude feed. In some embodiments, fourth catalyst(s) may be positioned upstream, downstream, or between additional catalyst(s) described herein. Hydrogen may be generated during contacting of the crude feed with the fourth catalyst(s), and hydrogen may be delivered to the contacting zones that include the additional catalyst(s). The delivery of the hydrogen may be counter to the flow of the crude feed. In some embodiments, the delivery of the hydrogen may be concurrent to the flow of the crude feed.

For example, in a stacked configuration (see, for example, FIG. 2B), hydrogen may be generated during contacting in one contacting zone (for example, contacting zone 102 in FIG. 2B), and hydrogen may be delivered to an additional contacting zone (for example, contacting zone 114 in FIG. 2B) in a direction that is counter to flow of the crude feed. In some embodiments, the hydrogen flow may be concurrent with the flow of the crude feed. Alternatively, in a stacked configuration (see, for example, FIG. 3B), hydrogen may be generated during contacting in one contacting zone (for example, contacting zone 102 in FIG. 3B). A hydrogen source may be delivered to a first additional contacting zone in a direction that is counter to flow of the crude feed (for example, adding hydrogen through conduit 106' to contacting zone 114 in FIG. 3B), and to a second additional contacting zone in a direction that is concurrent to the flow of the crude feed (for example, adding hydrogen through conduit 106' to contacting zone 116 in FIG. 3B).

In some embodiments, the fourth catalyst and the sixth catalyst are used in series, either with the fourth catalyst being upstream of the sixth catalyst, or vice versa. The combination of the fourth catalyst with an additional catalyst(s) may reduce TAN, reduce Ni/V/Fe content, and/or reduce a content of metals in metal salts of organic acids, with low net uptake of hydrogen by the crude feed. Low net hydrogen uptake may allow other properties of the crude product to be only changed by small amounts relative to the same properties of the crude feed.

In some embodiments, two different seventh catalysts may be used in combination. The seventh catalyst used upstream from the downstream seventh catalyst may have a total content of Column 6 metal(s), per gram of catalyst, in a range from about 0.0001-0.06 grams. The downstream seventh catalyst may have a total content of Column 6 metals(s), per gram of downstream seventh catalyst, that is equal to or larger than the total content of Column 6 metal(s) in the upstream seventh catalyst, or at least 0.02 grams of Column 6 metal(s) per gram of catalyst. In some embodiments, the position of the upstream seventh catalyst and the downstream seventh catalyst may be reversed. The ability to use a relatively small amount of catalytic active metal in the downstream seventh catalyst may allow other properties of the crude product to be only changed by small amounts relative to the same properties of the crude feed (for example, a relatively small change in heteroatom content, API gravity, residue content, VGO content, or combinations thereof).

Contact of the crude feed with the upstream and downstream seventh catalysts may produce a crude product that has a TAN of at most 90%, at most 80%, at most 50%, at most 10%, or at least 1% of the TAN of the crude feed. In some embodiments, the TAN of the crude feed may be incrementally reduced by contact with the upstream and downstream seventh catalysts (for example, contact of the crude feed with a catalyst to form an initial crude product with changed properties relative to the crude feed, and then contact of the initial crude product with an additional catalyst to produce the crude product with changed properties relative to the initial crude product). The ability to reduce TAN incrementally may assist in maintaining the stability of the crude feed/total product mixture during processing.

In some embodiments, catalyst selection and/or order of catalysts in combination with controlled contacting conditions (for example, temperature and/or crude feed flow rate) may assist in reducing hydrogen uptake by the crude feed, maintaining crude feed/total product mixture stability during processing, and changing one or more properties of the crude product relative to the respective properties of the crude feed. Stability of the crude feed/total product mixture may be affected by various phases separating from the crude feed/total product mixture. Phase separation may be caused by, for example, insolubility of the crude feed and/or crude product in the crude feed/total product mixture, flocculation of asphaltenes from the crude feed/total product mixture, precipitation of components from the crude feed/total product mixture, or combinations thereof.

At certain times during the contacting period, the concentration of crude feed and/or total product in the crude feed/total product mixture may change. As the concentration of the total product in the crude feed/total product mixture changes due to formation of the crude product, solubility of the components of the crude feed and/or components of the total product in the crude feed/total product mixture tends to change. For example, the crude feed may contain components that are soluble in the crude feed at the beginning of processing. As properties of the crude feed change (for example, TAN, MCR, $C_5$ asphaltenes, P-value, or combinations thereof), the components may tend to become less soluble in the crude feed/total product mixture. In some instances, the crude feed and the total product may form two phases and/or become insoluble in one another. Solubility changes may also result in the crude feed/total product mixture forming two or more phases. Formation of two phases, through flocculation of asphaltenes, change in concentration of crude feed and total product, and/or precipitation of components, tends to reduce the life of one or more of the catalysts. Additionally, the efficiency of the process may be reduced. For example, repeated treatment of the crude feed/total product mixture may be necessary to produce a crude product with desired properties.

During processing, the P-value of the crude feed/total product mixture may be monitored and the stability of the process, crude feed, and/or crude feed/total product mixture may be assessed. Typically, a P-value that is at most 1.5 indicates that flocculation of asphaltenes from the crude feed generally occurs. If the P-value is initially at least 1.5, and such P-value increases or is relatively stable during contacting, then this indicates that the crude feed is relatively stabile during contacting. Crude feed/total product mixture stability, as assessed by P-value, may be controlled by controlling contacting conditions, by selection of catalysts, by selective ordering of catalysts, or combinations thereof. Such controlling of contacting conditions may include controlling LHSV, temperature, pressure, hydrogen uptake, crude feed flow, or combinations thereof.

In some embodiments, contacting temperatures are controlled such that $C_5$ asphaltenes and/or other asphaltenes are removed while maintaining the MCR content of the crude feed. Reduction of the MCR content through hydrogen uptake and/or higher contacting temperatures may result in formation of two phases that may reduce the stability of the crude feed/total product mixture and/or life of one or more of the catalysts. Control of contacting temperature and hydrogen uptake in combination with the catalysts described herein allows the $C_5$ asphaltenes to be reduced while the MCR content of the crude feed only changes by a relatively small amount.

In some embodiments, contacting conditions are controlled such that temperatures in one or more contacting zones may be different. Operating at different temperatures allows for selective change in crude feed properties while maintaining the stability of the crude feed/total product mixture. The crude feed enters a first contacting zone at the start of a process. A first contacting temperature is the temperature in the first contacting zone. Other contacting temperatures (for example, second temperature, third temperature, fourth temperature, et cetera) are the temperatures in contacting zones that are positioned after the first contacting zone. A first contacting temperature may be in a range from about 100-420° C. and a second contacting temperature may be in a range that is about 20-100° C., about 30-90° C., or about 40-60° C. different than the first contacting temperature. In some embodiments, the second contacting temperature is greater than the first contacting temperature. Having different contacting temperatures may reduce TAN and/or $C_5$ asphaltenes content in a crude product relative to the TAN and/or the $C_5$ asphaltenes content of the crude feed to a greater extent than the amount of TAN and/or $C_5$ asphaltene reduction, if any, when the first and second contacting temperatures are the same as or within 10° C. of each other.

For example, a first contacting zone may include a first catalyst(s) and/or a fourth catalyst(s) and a second contacting zone may include other catalyst(s) described herein. The first contacting temperature may be about 350° C. and the second contacting temperature may be about 300° C. Contact of the crude feed in the first contacting zone with the first catalyst and/or fourth catalyst at the higher temperature prior to contact with the other catalyst(s) in the second contacting zone may result in greater than TAN and/or $C_5$ asphaltenes reduction in the crude feed relative to the TAN and/or $C_5$ asphaltenes reduction in the same crude feed when the first and second contacting temperatures are within 10° C.

EXAMPLES

Non-limiting examples of support preparation, catalyst preparations, and systems with selected arrangement of catalysts and controlled contacting conditions are set forth below.

Example 1

Preparation of a Catalyst Support

A support was prepared by mulling 576 grams of alumina (Criterion Catalysts and Technologies LP, Michigan City, Mich., U.S.A.) with 585 grams of water and 8 grams of glacial nitric acid for 35 minutes. The resulting mulled mixture was extruded through a 1.3 Trilobe™ die plate, dried between 90-125° C., and then calcined at 918° C., which resulted in 650 grams of a calcined support with a median pore diameter of 182 Å. The calcined support was placed in a Lindberg furnace. The furnace temperature was raised to about 1000-1100° C. over 1.5 hours, and then held in this range for 2 hours to produce the support. The support included, per gram of support, 0.0003 grams of gamma alumina, 0.0008 grams of alpha alumina, 0.0208 grams of delta alumina, and 0.9781 grams of theta alumina, as determined by x-ray diffraction. The support had a surface area of 110 $m^2/g$ and a total pore volume of 0.821 $cm^3/g$. The support had a pore size distribution with a median pore diameter of 232 Å, with 66.7% of the total number of pores in the pore size distribution having a pore diameter within 85 Å of the median pore diameter.

This example demonstrates how to prepare a support that has a pore size distribution of at least 180 Å and includes at least 0.1 grams of theta alumina.

Example 2

Preparation of a Vanadium Catalyst Having a Pore Size Distribution with a Median Pore Diameter of at Least 230 Å

The vanadium catalyst was prepared in the following manner. The alumina support, prepared by the method described in Example 1, was impregnated with a vanadium impregnation solution prepared by combining 7.69 grams of $VOSO_4$ with 82 grams of deionized water. A pH of the solution was about 2.27.

The alumina support (100 g) was impregnated with the vanadium impregnation solution, aged for 2 hours with occasional agitation, dried at 125° C. for several hours, and then calcined at 480° C. for 2 hours. The resulting catalyst contained 0.04 grams of vanadium, per gram of catalyst, with the balance being support. The vanadium catalyst had a pore size distribution with a median pore diameter of 350 Å, a pore volume of 0.69 $cm^3/g$, and a surface area of 110 $m^2/g$. Additionally, 66.7% of the total number of pores in the pore size distribution of the vanadium catalyst had a pore diameter within 70 Å of the median pore diameter.

This example demonstrates the preparation of a Column 5 catalyst having a pore size distribution with a median pore diameter of at least 230 Å.

Example 3

Preparation of a Molybdenum Catalyst Having a Pore Size Distribution with a Median Pore Diameter of at Least 230 Å

The molybdenum catalyst was prepared in the following manner. The alumina support prepared by the method described in Example 1 was impregnated with a molybdenum impregnation solution. The molybdenum impregnation solution was prepared by combining 4.26 grams of $(NH_4)_2Mo_2O_7$, 6.38 grams of $MoO_3$, 1.12 grams of 30% $H_2O_2$, 0.27 grams of monoethanolamine (MEA), and 6.51 grams of deionized water to form a slurry. The slurry was heated to 65° C. until dissolution of the solids. The heated solution was cooled to room temperature. The pH of the solution was 5.36. The solution volume was adjusted to 82 mL with deionized water.

The alumina support (100 grams) was impregnated with the molybdenum impregnation solution, aged for 2 hours with occasional agitation, dried at 125° C. for several hours, and then calcined at 480° C. for 2 hours. The resulting catalyst contained 0.04 grams of molybdenum per gram of catalyst, with the balance being support. The molybdenum catalyst had a pore size distribution with a median pore diameter of 250 Å, a pore volume of 0.77 $cm^3/g$, and a surface area of 116 $m^2/g$. Additionally, 67.7% of the total number of pores in the pore size distribution of the molybdenum catalyst had a pore diameter within 86 Å of the median pore diameter.

This example demonstrates the preparation of a Column 6 metal catalyst having a pore size distribution with a median pore diameter of at least 230 Å.

Example 4

Preparation of a Molybdenum/Vanadium Catalyst Having a Pore Size Distribution with a Median Pore Diameter of at Least 230 Å

The molybdenum/vanadium catalyst was prepared in the following manner. The alumina support, prepared by the method described in Example 1, was impregnated with a molybdenum/vanadium impregnation solution prepared as follows. A first solution was made by combining 2.14 grams of $(NH_4)_2Mo_2O_7$, 3.21 grams of $MoO_3$, 0.56 grams of 30% hydrogen peroxide ($H_2O_2$), 0.14 grams of monoethanolamine (MEA), and 3.28 grams of deionized water to form a slurry. The slurry was heated to 65° C. until dissolution of the solids. The heated solution was cooled to room temperature.

A second solution was made by combining 3.57 grams of $VOSO_4$ with 40 grams of deionized water. The first solution and second solution were combined and sufficient deionized water was added to bring the combined solution volume up to 82 ml to yield the molybdenum/vanadium impregnation solution. The alumina was impregnated with the molybdenum/vanadium impregnation solution, aged for 2 hours with occasional agitation, dried at 125° C. for several hours, and then calcined at 480° C. for 2 hours. The resulting catalyst contained, per gram of catalyst, 0.02 grams of vanadium and 0.02 grams of molybdenum, with the balance being support. The molybdenum/vanadium catalyst had a pore size distribution with a median pore diameter of 300 Å.

This example demonstrates the preparation of a Column 6 metal and a Column 5 metal catalyst having a pore size distribution with a median pore diameter of at least 230 Å.

Example 5

Contact of a Crude Feed with Three Catalysts

A tubular reactor with a centrally positioned thermowell was equipped with thermocouples to measure temperatures throughout a catalyst bed. The catalyst bed was formed by filling the space between the thermowell and an inner wall of the reactor with catalysts and silicon carbide (20-grid, Stanford Materials; Aliso Viejo, Calif.). Such silicon carbide is believed to have low, if any, catalytic properties under the process conditions described herein. All catalysts were blended with an equal volume amount of silicon carbide before placing the mixture into the contacting zone portions of the reactor.

The crude feed flow to the reactor was from the top of the reactor to the bottom of the reactor. Silicon carbide was positioned at the bottom of the reactor to serve as a bottom support. A bottom catalyst/silicon carbide mixture (42 $cm^3$) was positioned on top of the silicon carbide to form a bottom contacting zone. The bottom catalyst had a pore size distribution with a median pore diameter of 77 Å, with 66.7% of the total number of pores in the pore size distribution having a pore diameter within 20 Å of the median pore diameter. The bottom catalyst contained 0.095 grams of molybdenum and 0.025 grams of nickel per gram of catalyst, with the balance being an alumina support.

A middle catalyst/silicone carbide mixture (56 $cm^3$) was positioned on top of the bottom contacting zone to form a middle contacting zone. The middle catalyst had a pore size distribution with a median pore diameter of 98 Å, with 66.7% of the total number of pores in the pore size distribution having a pore diameter within 24 Å of the median pore diameter. The middle catalyst contained 0.02 grams of nickel and 0.08 grams of molybdenum per gram of catalyst, with the balance being an alumina support.

A top catalyst/silicone carbide mixture (42 $cm^3$) was positioned on top of the middle contacting zone to form a top contacting zone. The top catalyst had a pore size distribution with a median pore diameter of 192 Å and contained 0.04 grams of molybdenum per gram of catalyst, with the balance being primarily a gamma alumina support.

Silicon carbide was positioned on top of the top contacting zone to fill dead space and to serve as a preheat zone. The catalyst bed was loaded into a Lindberg furnace that included five heating zones corresponding to the preheat zone, the top, middle, and bottom contacting zones, and the bottom support.

The catalysts were sulfided by introducing a gaseous mixture of 5 vol % hydrogen sulfide and 95 vol % hydrogen gas into the contacting zones at a rate of about 1.5 liter of gaseous mixture per volume (mL) of total catalyst (silicon carbide was not counted as part of the volume of catalyst). Temperatures of the contacting zones were increased to 204° C. (400° F.) over 1 hour and held at 204° C. for 2 hours. After holding at 204° C., the contacting zones were increased incrementally to 316° C. (600° F.) at a rate of about 10° C. (about 50° F.) per hour. The contacting zones were maintained at 316° C. for an hour, then incrementally raised to 370° C. (700° F.) over 1 hour and held at 370° C. for two hours. The contacting zones were allowed to cool to ambient temperature.

Crude from the Mars platform in the Gulf of Mexico was filtered, then heated in an oven at a temperature of 93° C. (200° F.) for 12-24 hours to form the crude feed having the properties summarized in Table 1, FIG. 7. The crude feed was fed to the top of the reactor. The crude feed flowed through the preheat zone, top contacting zone, middle contacting zone, bottom contacting zone, and bottom support of the reactor. The crude feed was contacted with each of the catalysts in the presence of hydrogen gas. Contacting conditions were as follows: ratio of hydrogen gas to the crude feed provided to the reactor was 328 $Nm^3/m^3$ (2000 SCFB), LHSV was 1 $h^{-1}$, and pressure was 6.9 MPa (1014.7 psi). The three contacting zones were heated to 370° C. (700° F.) and maintained at 370° C. for 500 hours. Temperatures of the three contacting zones were then increased and maintained in the following sequence: 379° C. (715° F.) for 500 hours, and then 388° C. (730° F.) for 500 hours, then 390° C. (734° F.) for 1800 hours, and then 394° C. (742° F.) for about 2400 hours.

The total product (that is, the crude product and gas) exited the catalyst bed. The total product was introduced into a gas-liquid phase separator. In the gas-liquid separator, the total product was separated into the crude product and gas. Gas input to the system was measured by a mass flow controller. Gas exiting the system was measured by a wet test meter. The crude product was periodically analyzed to determine a weight percentage of components of the crude product. The results listed are averages of the determined weight percentages of components. Crude product properties are summarized in Table 1 of FIG. 7.

As shown in Table 1, the crude product had, per gram of crude product, a sulfur content of 0.0075 grams, a residue content of 0.255 grams, an oxygen content of 0.0007 grams. The crude product had a ratio of MCR content to $C_5$ asphaltenes content of 1.9 and a TAN of 0.09. The total of nickel and vanadium was 22.4 wtppm.

Figure 8:
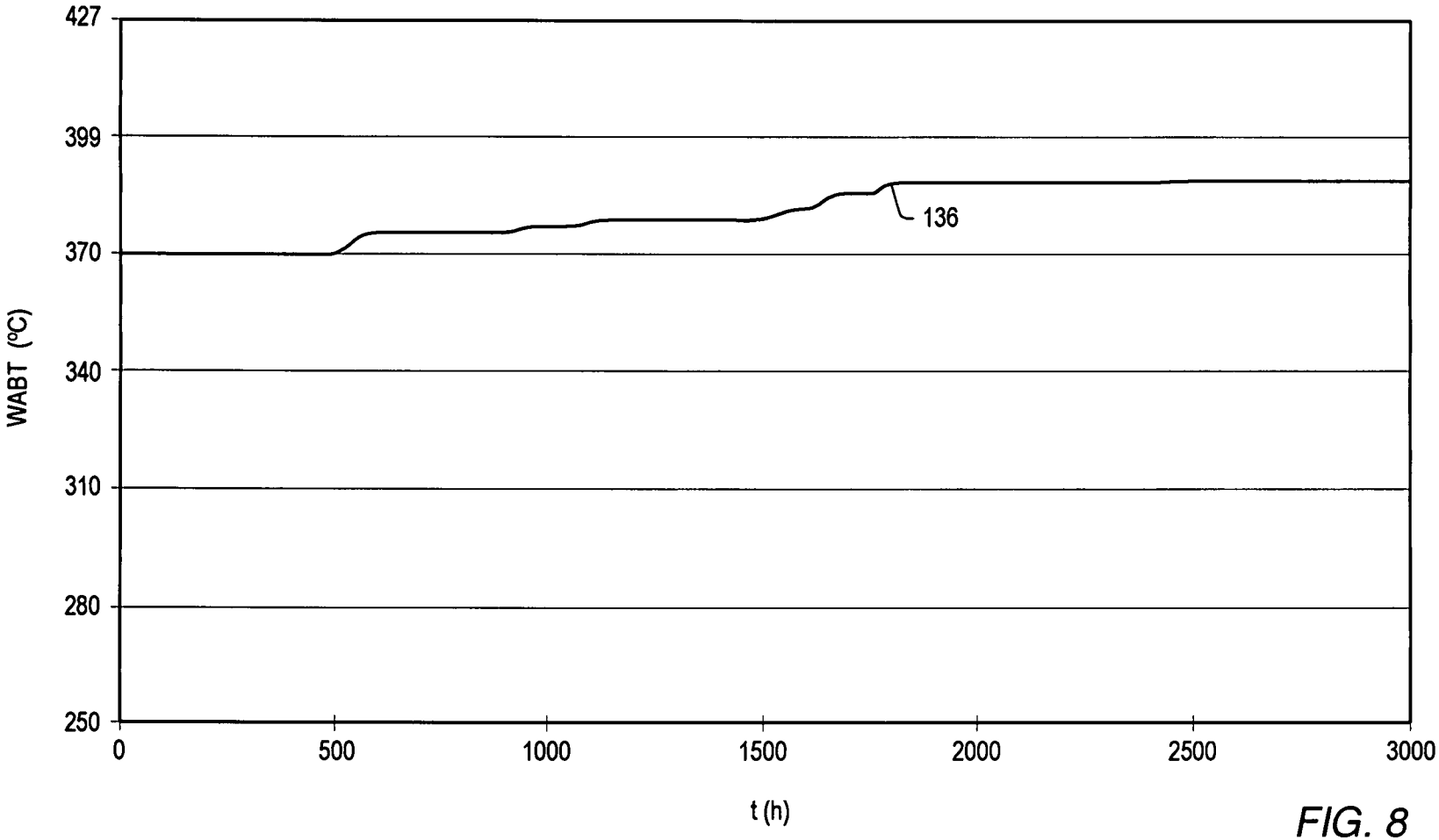
FIG. 8 is a graphical representation of weighted average bed temperature versus length of run for an embodiment of contacting the crude feed with one or more catalysts.

The lives of the catalysts were determined by measuring a weighted average bed temperature ("WABT") versus run length of the crude feed. The catalysts lives may be correlated to the temperature of the catalyst bed. It is believed that as catalyst life decreases, a WABT increases. FIG. 8 is a graphical representation of WABT versus time for improvement of the crude feed in the contacting zones described in this example. Plot 136 represents the average WABT of the three contacting zones versus hours of run time for contacting a crude feed with the top, middle, and bottom catalysts. Over a majority of the run time, the WABT of the contacting zones only changed approximately 20° C. From the relatively stable WABT, it was possible to estimate that the catalytic activity of the catalyst had not been affected. Typically, a pilot unit run time of 3000-3500 hours correlates to about 1 year of commercial operation.

This example demonstrates that contacting the crude feed with one catalyst having a pore size distribution with a median pore diameter of at least 180 Å and additional catalysts having a pore size distribution with a median pore diameter in a range between 90-180 Å, with at least 60% of the total number of pores in the pore size distribution having a pore diameter within 45 Å of the median pore diameter, with controlled contacting conditions, produced a total product that included the crude product. As measured by P-value, crude feed/total product mixture stability was maintained. The crude product had reduced TAN, reduced Ni/V/Fe content, reduced sulfur content, and reduced oxygen content relative to the crude feed, while the residue content and the VGO content of the crude product was 90%-110% of those properties of the crude feed.

Example 6

Contact of a Crude Feed with Two Catalysts that Have a Pore Size Distribution with a Median Pore Diameter in a Range Between 90-180 Å

The reactor apparatus (except for the number and content of contacting zones), catalyst sulfiding method, method of separating the total product and method of analyzing the crude product were the same as described in Example 5. Each catalyst was mixed with an equal volume of silicon carbide.

The crude feed flow to the reactor was from the top of the reactor to the bottom of the reactor. The reactor was filled from bottom to top in the following manner. Silicon carbide was positioned at the bottom of the reactor to serve as a bottom support. A bottom catalyst/silicon carbide mixture (80 $cm^3$) was positioned on top of the silicon carbide to form a bottom contacting zone. The bottom catalyst had a pore size distribution with a median pore diameter of 127 Å, with 66.7% of the total number pores in the pore size distribution having a pore diameter within 32 Å of the median pore diameter. The bottom catalyst included 0.11 grams of molybdenum and 0.02 grams of nickel per gram of catalyst, with the balance being support.

A top catalyst/silicone carbide mixture (80 $cm^3$) was positioned on top of the bottom contacting zone to form the top contacting zone. The top catalyst had a pore size distribution with a median pore diameter of 100 Å, with 66.7% of the total number of pores in the pore size distribution having a pore diameter within 20 Å of the median pore diameter. The top catalyst included 0.03 grams of nickel and 0.12 grams of molybdenum per gram of catalyst, with the balance being alumina. Silicon carbide was positioned on top of the first contacting zone to fill dead space and to serve as a preheat zone. The catalyst bed was loaded into a Lindberg furnace that included four heating zones corresponding to the preheat zone, the two contacting zones, and the bottom support.

BS-4 crude (Venezuela) having the properties summarized in Table 2, FIG. 9, was fed to the top of the reactor. The crude feed flowed through the preheat zone, top contacting zone, bottom contacting zone, and bottom support of the reactor. The crude feed was contacted with each of the catalysts in the presence of hydrogen gas. The contacting conditions were as follows: ratio of hydrogen gas to the crude feed provided to the reactor was 160 $Nm^3/m^3$ (1000 SCFB), LHSV was 1 $h^{-1}$, and pressure was 6.9 MPa (1014.7 psi). The two contacting zones were heated to 260° C. (500° F.) and maintained at 260° C. (500° F.) for 287 hours. Temperatures of the two contacting zones were then increased and maintained in the following sequence: 270° C. (525° F.) for 190 hours, then 288° C. (550° F.) for 216 hours, then 315° C. (600° F.) for 360 hours, and then 343° C. (650° F.) for 120 hours for a total run time of 1173 hours.

The total product exited the reactor and was separated as described in Example 5. The crude product had an average TAN of 0.42 and an average API gravity of 12.5 during processing. The crude product had, per gram of crude product, 0.0023 grams of sulfur, 0.0034 grams of oxygen, 0.441 grams of VGO, and 0.378 grams of residue. Additional properties of the crude product are listed in TABLE 2 in FIG. 9.

This example demonstrates that contacting the crude feed with the catalysts having pore size distributions with a median pore diameter in a range between 90-180 Å produced a crude product that had a reduced TAN, a reduced Ni/V/Fe content, and a reduced oxygen content, relative to the properties of the crude feed, while residue content and VGO content of the crude product were about 99% and 100% of the respective properties of the crude feed.

Example 7

Contact of a Crude Feed with Two Catalysts

The reactor apparatus (except for number and content of contacting zones), catalysts, the total product separation method, crude product analysis, and catalyst sulfiding method were the same as described in Example 6.

A crude feed (BC-10 crude) having the properties summarized in Table 3, FIG. 10, was fed to the top of the reactor. The crude feed flowed through the preheat zone, top contacting zone, bottom contacting zone, and bottom support of the reactor. The contacting conditions were as follows: ratio of hydrogen gas to the crude feed provided to the reactor was 80 $Nm^3/m^3$ (500 SCFB), LHSV was 2 $h^{-1}$, and pressure was 6.9 MPa (about 1014.7 psi). The two contacting zones were heated incrementally to 343° C. (650° F.). A total run time was 1007 hours.

The crude product had an average TAN of 0.16 and an average API gravity of 16.2 during processing. The crude product had 1.9 wtppm of calcium, 6 wtppm of sodium, 0.6 wtppm of zinc, and 3 wtppm of potassium. The crude product had, per gram of crude product, 0.0033 grams of sulfur, 0.002 grams of oxygen, 0.376 grams of VGO, and 0.401 grams of residue. Additional properties of the crude product are listed in Table 3 in FIG. 10.

This example demonstrates that contacting of the crude feed with the selected catalysts with pore size distributions in a range of 90-180 Å produced a crude product that had a reduced TAN, a reduced total calcium, sodium, zinc, and potassium content while sulfur content, VGO content, and residue content of the crude product were about 76%, 94%, and 103% of the respective properties of the crude feed.

Examples 8-11

Contact of a Crude Feed with Four Catalyst Systems and at Various Contacting Conditions Each reactor apparatus (except for the number and content of contacting zones), each catalyst sulfiding method, each total product separation method, and each crude product analysis were the same as described in Example 5. All catalysts were mixed with silicon carbide in a volume ratio of 2 parts silicon carbide to 1 part catalyst unless otherwise indicated. The crude feed flow through each reactor was from the top of the reactor to the bottom of the reactor. Silicon carbide was positioned at the bottom of each reactor to serve as a bottom support. Each reactor had a bottom contacting zone and a top contacting zone. After the catalyst/silicone carbide mixtures were placed in the contacting zones of each reactor, silicone carbide was positioned on top of the top contacting zone to fill dead space and to serve as a preheat zone in each reactor. Each reactor was loaded into a Lindberg furnace that included four heating zones corresponding to the preheat zone, the two contacting zones, and the bottom support.

In Example 8, an uncalcined molybdenum/nickel catalyst/silicon carbide mixture (48 $cm^3$) was positioned in the bottom contacting zone. The catalyst included, per gram of catalyst, 0.146 grams of molybdenum, 0.047 grams of nickel, and 0.021 grams of phosphorus, with the balance being alumina support.

A molybdenum catalyst/silicon carbide mixture (12 $cm^3$) with the catalyst having a pore size distribution with a median pore diameter of 180 Å was positioned in the top contacting zone. The molybdenum catalyst had a total content of 0.04 grams of molybdenum per gram of catalyst, with the balance being support that included at least 0.50 grams of gamma alumina per gram of support.

In Example 9, an uncalcined molybdenum/cobalt catalyst/silicon carbide mixture (48 $cm^3$) was positioned in the both contacting zones. The uncalcined molybdenum/cobalt catalyst included 0.143 grams of molybdenum, 0.043 grams of cobalt, and about 0.021 grams of phosphorus with the balance being alumina support.

A molybdenum catalyst/silicon carbide mixture (12 $cm^3$) was positioned in the top contacting zone. The molybdenum catalyst was the same as in the top contacting zone of Example 8.

In Example 10, the molybdenum catalyst as described in the top contacting zone of Example 8 was mixed with silicon carbide and positioned in the both contacting zones (60 $cm^3$).

In Example 11, an uncalcined molybdenum/nickel catalyst/silicone carbide mixture (48 $cm^3$) was positioned in the bottom contacting zone. The uncalcined molybdenum/nickel catalyst included, per gram of catalyst, about 0.09 grams of molybdenum, about 0.025 grams of nickel, and about 0.01 grams of phosphorus, with the balance being alumina support.

A molybdenum catalyst/silicon carbide mixture (12 $cm^3$) was positioned in the top contacting zone. The molybdenum catalyst was the same as in the top contacting zone of Example 8.

Crude from the Mars platform (Gulf of Mexico) was filtered, then heated in an oven at a temperature of 93° C. (200° F.) for 12-24 hours to form the crude feed for Examples 8-11 having the properties summarized in Table 4, FIG. 11. The crude feed was fed to the top of the reactor in these examples. The crude feed flowed through the preheat zone, top contacting zone, bottom contacting zone, and bottom support of the reactor. The crude feed was contacted with each of the catalysts in the presence of hydrogen gas. Contacting conditions for each example were as follows: ratio of hydrogen gas to crude feed during contacting was 160 $Nm^3/m^3$ (1000 SCFB), and the total pressure of each system was 6.9 MPa (1014.7 psi). LHSV was 2.0 $h^{-1}$ during the first 200 hours of contacting, and then lowered to 1.0 $h^1$ for the remaining contacting times. Temperatures in all contacting zones were 343° C. (650° F.) for 500 hours of contacting. After 500 hours, the temperatures in all contacting zones were controlled as follows: the temperature in the contacting zones were raised to 354° C. (670° F.), held at 354° C. for 200 hours; raised to 366° C. (690° F.), held at 366° C. for 200 hours; raised to 371° C. (700° F.), held at 371° C. for 1000 hours; raised to 385° C. (725° C.), held at about 385° C. for 200 hours; then raised to a final temperature of 399° C. (750° C.) and held at 399° C. for 200 hours, for a total contacting time of 2300 hours.

The crude products were periodically analyzed to determine TAN, hydrogen uptake by the crude feed, P-value, VGO content, residue content, and oxygen content. Average values for properties of the crude products produced in Examples 8-11 are listed in Table 5 in FIG. 11.

Figure 12:
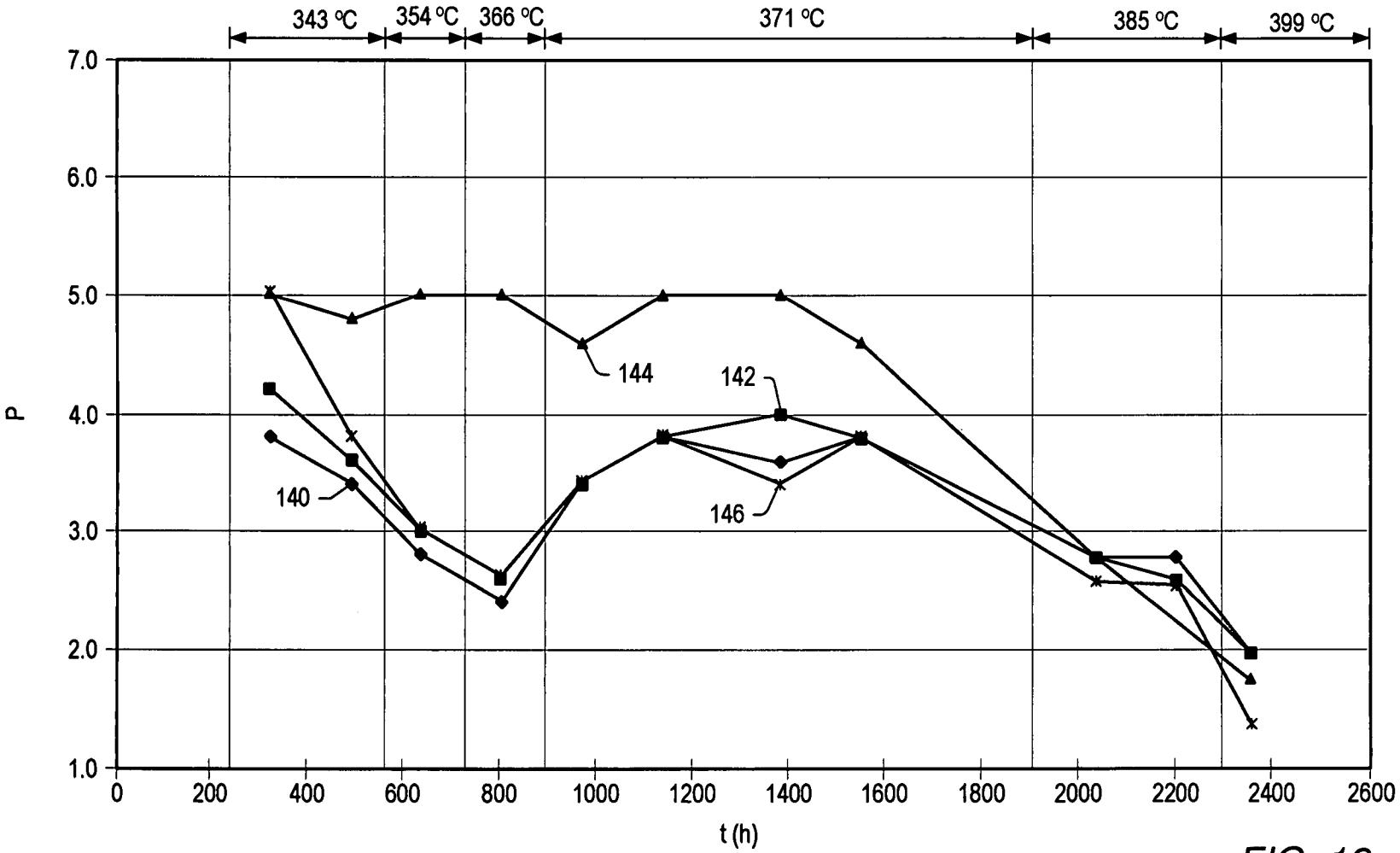
FIG. 12 is a graphical representation of P-value of crude products versus run time for embodiments of contacting crude feeds with four different catalyst systems.

FIG. 12 is a graphical representation of P-value of the crude product versus run time for each of the catalyst systems of Examples 8-11. The crude feed had a P-value of at least 1.5. Plots 140, 142, 144, and 146 represent the P-value of the crude product obtained by contacting the crude feed with the four catalyst systems of Examples 8-11 respectively. For 2300 hours, the P-value of the crude product remained of at least 1.5 for catalyst systems of Examples 8-10. In Example 11, the P-value was above 1.5 for most of the run time. At the end of the run (2300 hours) for Example 11, the P-value was about 1.4. From the P-value of the crude product for each trial, it may be inferred that the crude feed in each trial remained relatively stable during contacting (for example, the crude feed did not phase separate). As shown in FIG. 12, the P-value of the crude product remained relatively constant during significant portions of each trial, except in Example 10, in which the P-value increased.

Figure 13:
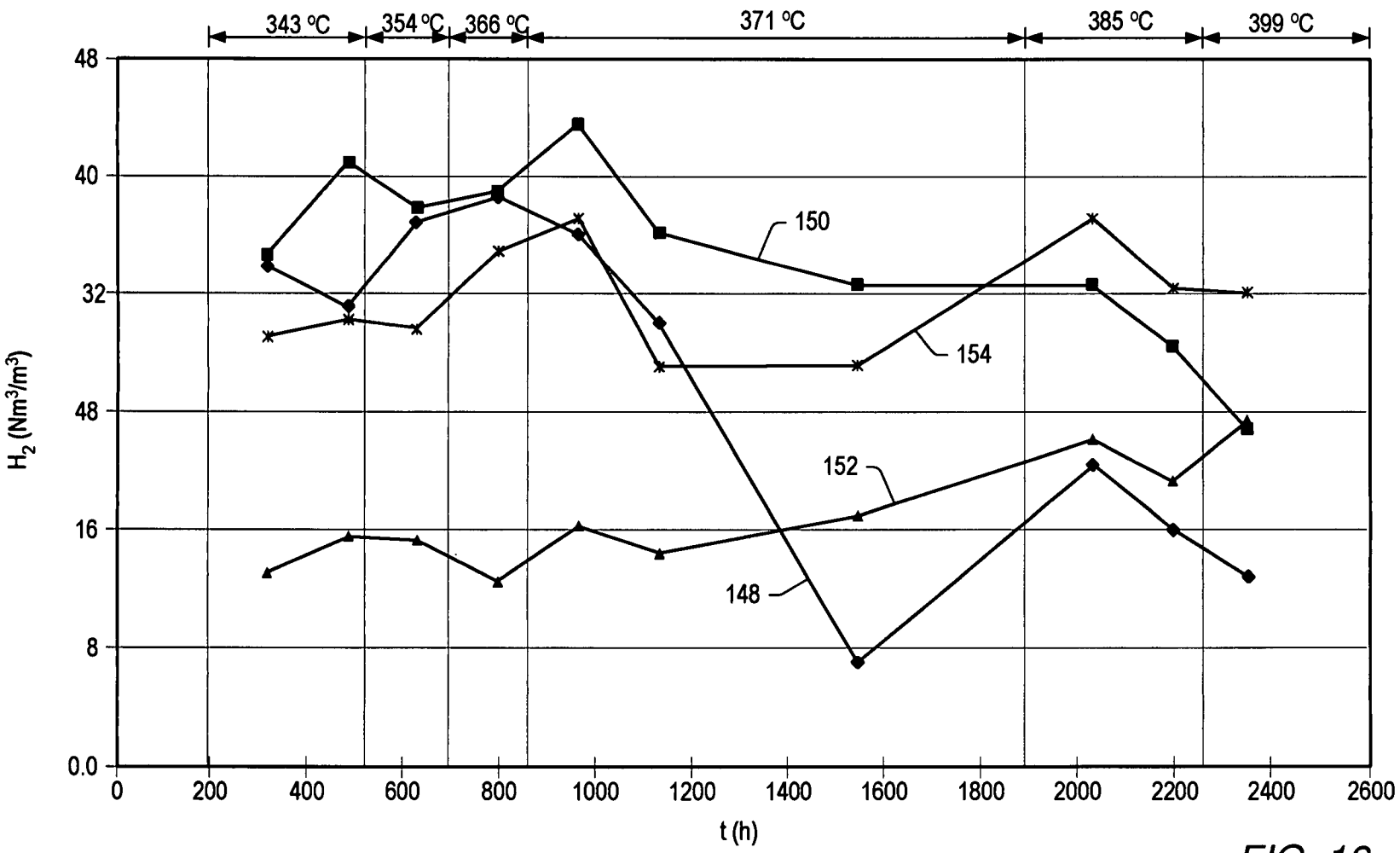
FIG. 13 is a graphical representation of net hydrogen uptake by crude feeds versus run time for embodiments of contacting crude feeds with four different catalyst systems.

FIG. 13 is a graphical representation of net hydrogen uptake by crude feed versus run time for four catalyst systems in the presence of hydrogen gas. Plots 148, 150 152, 154 represent net hydrogen uptake obtained by contacting the crude feed with each of the catalyst systems of Examples 8-11, respectively. Net hydrogen uptake by a crude feed over a run time period of 2300 hours was in a range between about 7-48 $Nm^3/m^3$ (43.8-300 SCFB). As shown in FIG. 13, the net hydrogen uptake of the crude feed was relatively constant during each trial.

Figure 14:
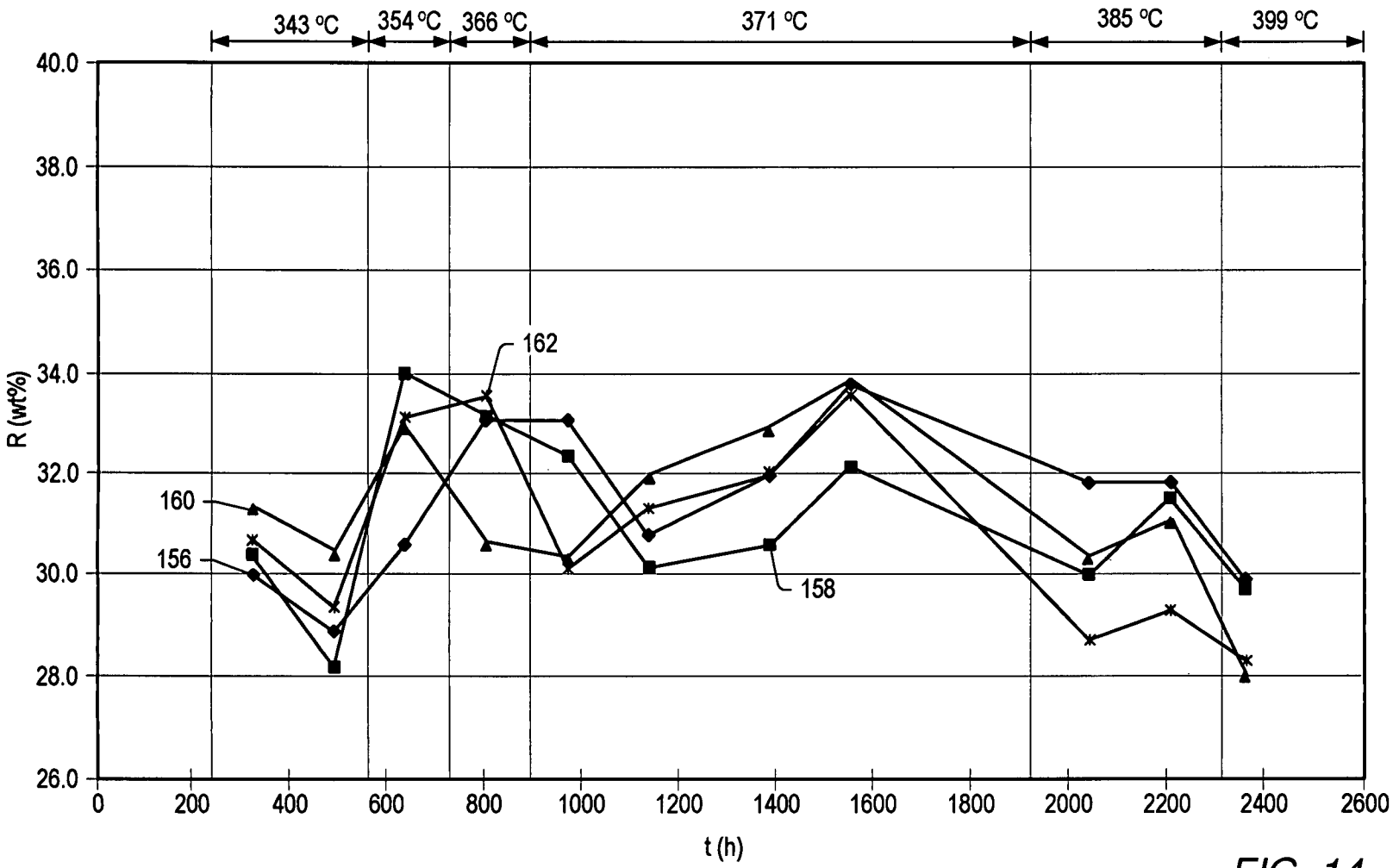
FIG. 14 is a graphical representation of residue content, expressed in weight percentage, of crude products versus run time for embodiments of contacting crude feeds with four different catalyst systems.

FIG. 14 is a graphical representation of residue content, expressed in weight percentage, of crude product versus run time for each of the catalyst systems of Examples 8-11. In each of the four trials, the crude product had a residue content of 88-90% of the residue content of the crude feed. Plots 156, 158, 160, 162 represent residue content of the crude product obtained by contacting the crude feed with the catalyst systems of Examples 8-11, respectively. As shown in FIG. 14, the residue content of the crude product remained relatively constant during significant portions of each trial.

Figure 15:
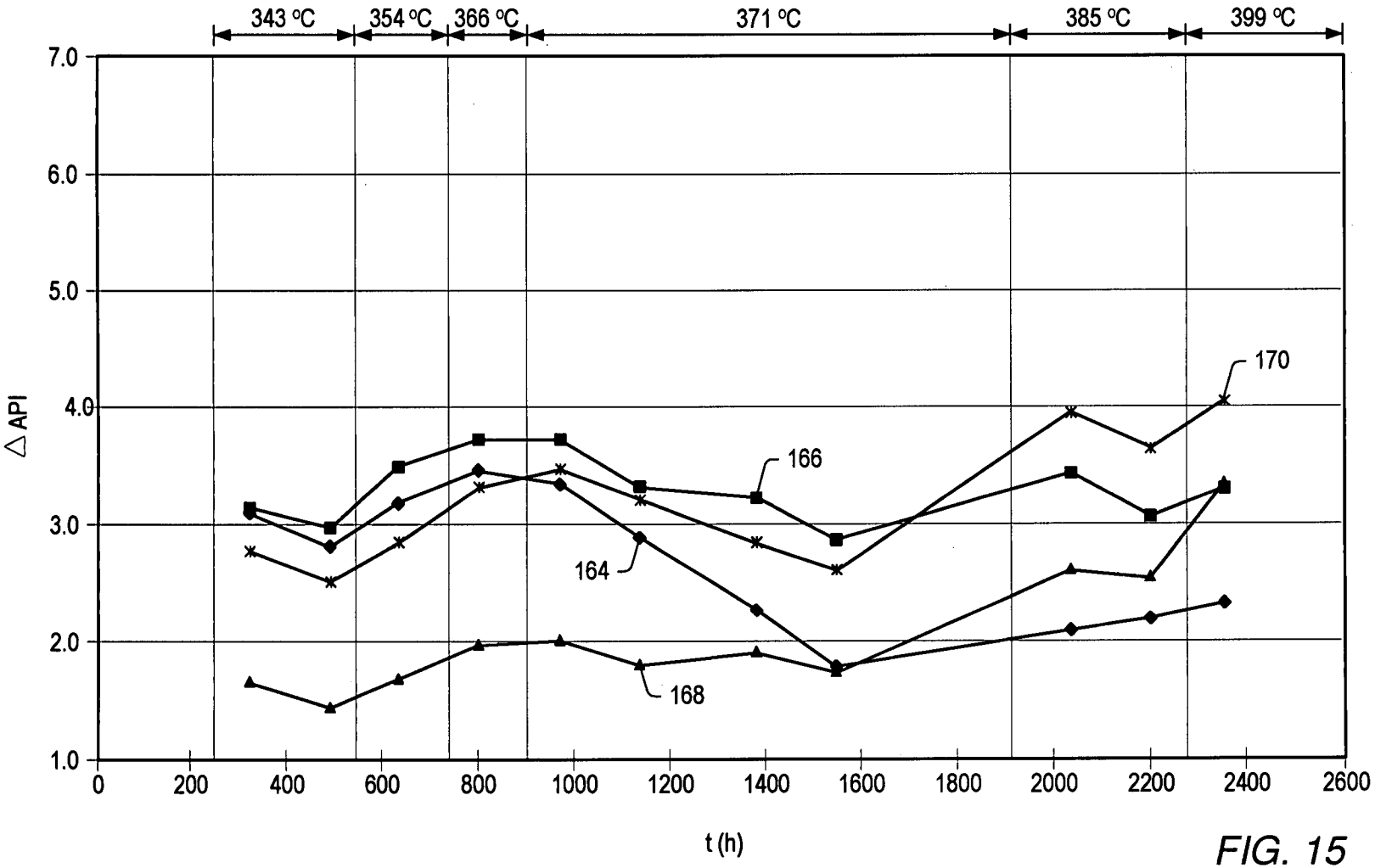
FIG. 15 is a graphical representation of change in API gravity of crude products versus run time for embodiments of contacting the crude feed with four different catalyst systems.

FIG. 15 is a graphical representation of change in API gravity of the crude product versus run time for each of the catalyst systems of Examples 8-11. Plots 164, 166, 168, 170 represent API gravity of the crude product obtained by contacting the crude feed with the catalyst systems of Examples 8-11, respectively. In each of the four trials, each crude product had a viscosity in a range from 58.3-72.7 cSt. The API gravity of each crude products increased by 1.5 to 4.1 degrees. The increased API gravity corresponds to an API gravity of the crude products in a range from 21.7-22.95. API gravity in this range is 110-117% of the API gravity of the crude feed.

Figure 16:
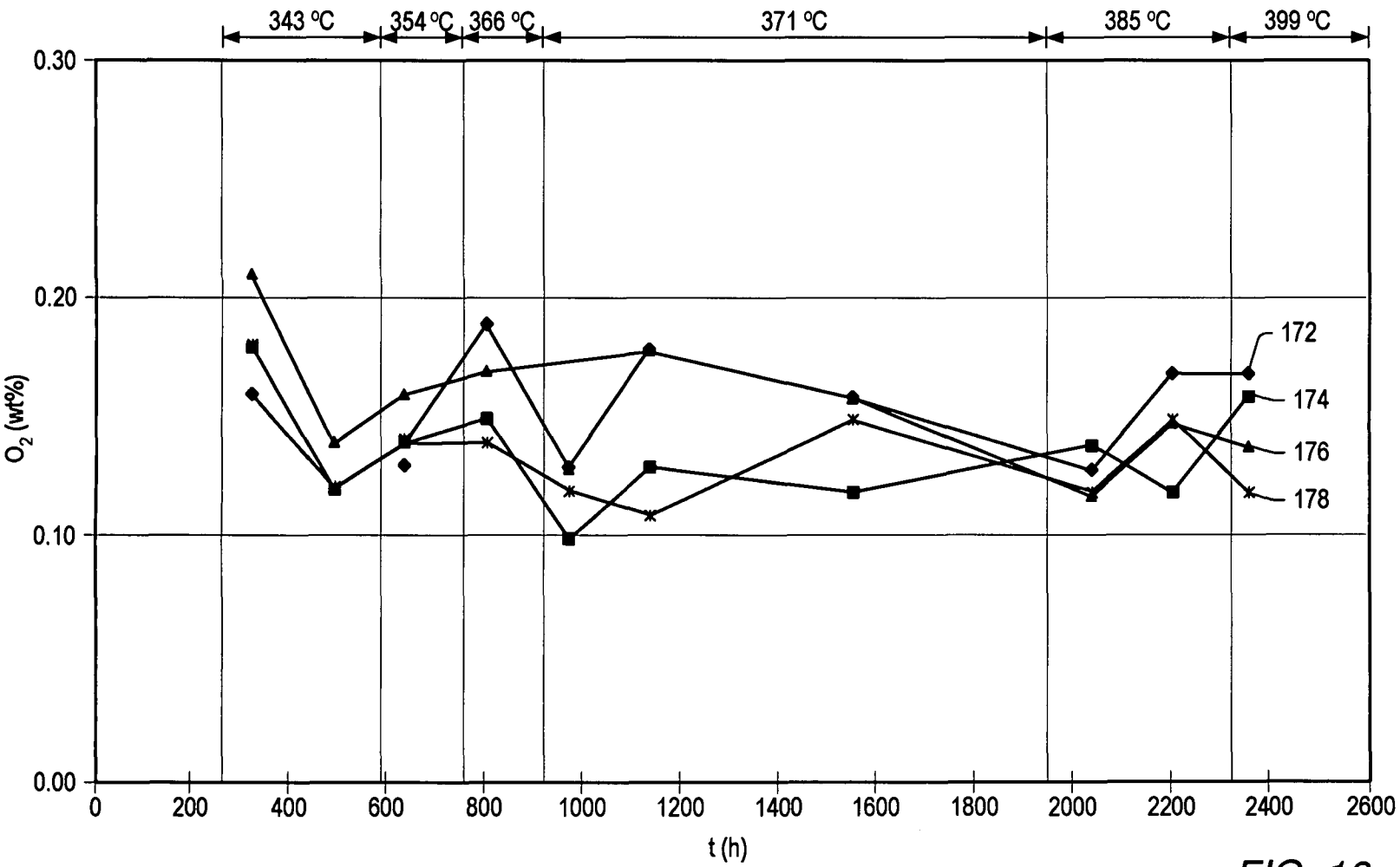
FIG. 16 is a graphical representation of oxygen content, expressed in weight percentage, of crude products versus run time for embodiments of contacting crude feeds with four different catalyst systems.

FIG. 16 is a graphical representation of oxygen content, expressed in weight percentage, of the crude product versus run time for each of the catalyst systems of Examples 8-11. Plots 172, 174, 176, 178 represent oxygen content of the crude product obtained by contacting the crude feed with the catalyst systems of Examples 8-11, respectively. Each crude product had an oxygen content of at most 16% of the crude feed. Each crude product had an oxygen content in a range from 0.0014-0.0015 grams per gram of crude product during each trial. As shown in FIG. 16, the oxygen content of the crude product remained relatively constant after 200 hours of contacting time. The relatively constant oxygen content of the crude product demonstrates that selected organic oxygen compounds are reduced during the contacting. Since TAN was also reduced in these examples, it may be inferred that at least a portion of the carboxylic containing organic oxygen compounds are reduced selectively over the non-carboxylic containing organic oxygen compounds.

In Example 11, at reaction conditions of: 371° C. (700° F.), a pressure of 6.9 MPa (1014.7 psi), and a ratio of hydrogen to crude feed of about 160 $Nm^3/m^3$ (1000 SCFB), the reduction of crude feed MCR content was 17.5 wt %, based on the weight of the crude feed. At a temperature of 399° C. (750° F.), at the same pressure and ratio of hydrogen to crude feed, the reduction of crude feed MCR content was 25.4 wt %, based on the weight of the crude feed.

In Example 9, at reaction conditions of: 371° C. (700° F.), a pressure of 6.9 MPa (1014.7 psi), and a ratio of hydrogen to crude feed of about 160 $Nm^3/m^3$ (1000 SCFB), the reduction of crude feed MCR content was 17.5 wt %, based on the weight of the crude feed. At a temperature of 399° C. (750° F.), at the same pressure and ratio of hydrogen to crude feed, the reduction of crude feed MCR content was 19 wt %, based on the weight of the crude feed.

This increased reduction in crude feed MCR content demonstrates that the uncalcined Columns 6 and 10 metals catalyst facilitates MCR content reduction at higher temperatures than the uncalcined Columns 6 and 9 metals catalyst.

These examples demonstrate that contact of a crude feed with a relatively high TAN (TAN of 0.8) with one or more catalysts produces the crude product, while maintaining the crude feed/total product mixture stability and with relatively small net hydrogen uptake. Selected crude product properties were at most 70% of the same properties of the crude feed, while selected properties of the crude product were within 20-30% of the same properties of the crude feed.

Specifically, as shown in Table 4, each of the crude products was produced with a net hydrogen uptake by the crude feeds of at most 44 $Nm^3/m^3$ (275 SCFB). Such products had an average TAN of at most 4% of the crude feed, and an average total Ni/V content of at most 61% of the total Ni/V content of the crude feed, while maintaining a P-value for the crude feed of above 3. The average residue content of each crude product was 88-90% of the residue content of the crude feed. The average VGO content of each crude product was 115-117% of the VGO content of the crude feed. The average API gravity of each crude product was 110-117% of the API gravity of the crude feed, while the viscosity of each crude product was at most 45% of the viscosity of the crude feed.

Examples 12-14

Contact of a Crude Feed with Catalysts Having a Pore Size Distribution with a Median Pore Diameter of at Least 180 Å with Minimal Hydrogen Consumption In Examples 12-14, each reactor apparatus (except for number and content of contacting zones), each catalyst sulfiding method, each total product separation method and each crude product analysis were the same as described in Example 5. All catalysts were mixed with an equal volume of silicon carbide. The crude feed flow to each reactor was from the top of the reactor to the bottom of the reactor. Silicon carbide was positioned at the bottom of each reactor to serve as a bottom support. Each reactor contained one contacting zone. After the catalyst/silicone carbide mixtures were placed in the contacting zone of each reactor, silicone carbide was positioned on top of the top contacting zone to fill dead space and to serve as a preheat zone in each reactor. Each reactor was loaded into a Lindberg furnace that included three heating zones corresponding to the preheat zone, the contacting zone, and the bottom support. The crude feed was contacted with each of the catalysts in the presence of hydrogen gas.

A catalyst/silicon carbide mixture (40 $cm^3$) was positioned on top of the silicon carbide to form the contacting zone. For Example 12, the catalyst was the vanadium catalyst as prepared in Example 2. For Example 13, the catalyst was the molybdenum catalyst as prepared in Example 3. For Example 14, the catalyst was the molybdenum/vanadium catalyst as prepared in Example 4.

The contacting conditions for Examples 12-14 were as follows: ratio of hydrogen to the crude feed provided to the reactor was about 160 $Nm^3/m^3$ (1000 SCFB), LHSV was 1 $h^{-1}$, and pressure was 6.9 MPa (about 1014.7 psi). The contacting zones were heated incrementally to 343° C. (650° F.) over a period of time and maintained at 343° C. for 120 hours for a total run time of 360 hours.

Total products exited the contacting zones and were separated as described in Example 5. Net hydrogen uptake during contacting was determined for each catalyst system. In Example 12, net hydrogen uptake was about −10.7 $Nm^3/m^3$ (−65 SCFB), and the crude product had a TAN of 6.75. In Example 13, net hydrogen uptake was in a range from about 2.2-3.0 $Nm^3/m^3$ (13.9-18.7 SCFB), and the crude product had a TAN in a range from 0.3-0.5. In Example 14, during contacting of the crude feed with the molybdenum/vanadium catalyst, net hydrogen uptake was in a range from about −0.05 $Nm^3/m^3$ to about 0.6 $Nm^3/m^3$ (−0.36 SCFB to 4.0 SCFB), and the crude product had a TAN in a range from 0.2-0.5.

From the net hydrogen uptake values during contacting, it was estimated that hydrogen was generated at the rate of about 10.7 $Nm^3/m^3$ (65 SCFB) during contacting of the crude feed and the vanadium catalyst. Generation of hydrogen during contacting allows less hydrogen to be used in the process relative to an amount of hydrogen used in conventional processes to improve properties of disadvantaged crudes. The requirement for less hydrogen during contacting tends to decrease the costs of processing a crude.

Additionally, contact of the crude feed with the molybdenum/vanadium catalyst produced a crude product with a TAN that was lower than the TAN of the crude product produced from the individual molybdenum catalyst.

Examples 15-18

Contact of a Crude Feed with a Vanadium Catalyst and an Additional Catalyst

Each reactor apparatus (except for number and content of contacting zones), each catalyst sulfiding method, each total product separation method, and each crude product analysis were the same as described in Example 5. All catalysts were mixed with silicon carbide in a volume ratio of 2 parts silicon carbide to 1 part catalyst unless otherwise indicated. The crude feed flow to each reactor was from the top of the reactor to the bottom of the reactor. Silicon carbide was positioned at the bottom of each reactor to serve as a bottom support. Each reactor had a bottom contacting zone and a top contacting zone. After the catalyst/silicone carbide mixtures were placed in the contacting zones of each reactor, silicone carbide was positioned on top of the top contacting zone to fill dead space and to serve as a preheat zone in each reactor. Each reactor was loaded into a Lindberg furnace that included four heating zones corresponding to the preheat zone, the two contacting zones, and the bottom support.

In each example, the vanadium catalyst was prepared as described in Example 2 and used with the additional catalyst.

In Example 15, an additional catalyst/silicon carbide mixture (45 $cm^3$) was positioned in the bottom contacting zone, with the additional catalyst being the molybdenum catalyst prepared by the method described in Example 3. The vanadium catalyst/silicone carbide mixture (15 $cm^3$) was positioned in the top contacting zone.

In Example 16, an additional catalyst/silicon carbide mixture (30 $cm^3$) was positioned in the bottom contacting zone, with the additional catalyst being the molybdenum catalyst prepared by the method described in Example 3. The vanadium catalyst/silicon carbide mixture (30 $cm^3$) was positioned in the top contacting zone.

In Example 17, an additional catalyst/silicone mixture (30 $cm^3$) was positioned in the bottom contacting zone, with the additional catalyst being the molybdenum/vanadium catalyst as prepared in Example 4. The vanadium catalyst/silicon carbide mixture (30 $cm^3$) was positioned in the top contacting zone.

In Example 18, Pyrex® (Glass Works Corporation, New York, U.S.A.) beads (30 $cm^3$) were positioned in each contacting zone.

Crude (Santos Basin, Brazil) for Examples 15-18 having the properties summarized in Table 5, FIG. 17 was fed to the top of the reactor. The crude feed flowed through the preheat zone, top contacting zone, bottom contacting zone, and bottom support of the reactor. The crude feed was contacted with each of the catalysts in the presence of hydrogen gas. Contacting conditions for each example were as follows: ratio of hydrogen gas to the crude feed provided to the reactor was about 160 $Nm^3/m^3$ (1000 SCFB) for the first 86 hours and about 80 $Nm^3/m^3$ (500 SCFB) for the remaining time period, LHSV was 1 $h^{-1}$, and pressure was 6.9 MPa (about 1014.7 psi). The contacting zones were heated incrementally to about 343° C. (650° F.) over a period of time and maintained at 343° C. for a total run time of about 1400 hours.

These examples demonstrate that contact of a crude feed with a Column 5 metal catalyst having a pore size distribution with a median pore diameter of 350 Å in combination with an additional catalyst having a pore size distribution with a median pore diameter in a range from 250-300 Å, in the presence of a hydrogen source, produces a crude product with properties that are changed relative to the same properties of crude feed, while only changing by small amounts other properties of the crude product relative to the same properties of the crude feed. Additionally, during processing, relatively small hydrogen uptake by the crude feed was observed.

Specifically, as shown in Table 5, FIG. 17, the crude product has a TAN of at most 15% of the TAN of the crude feed for Examples 15-17. The crude products produced in Examples 15-17 each had a total Ni/V/Fe content of at most 44%, an oxygen content of at most 50%, and viscosity of at most 75% relative to the same properties of the crude feed. Additionally, the crude products produced in Examples 15-17 each had an API gravity of 100-103% of the API gravity of the crude feed.

In contrast, the crude product produced under non-catalytic conditions (Example 18) produced a product with increased viscosity and decreased API gravity relative to the viscosity and API gravity of the crude feed. From the increased viscosity and decreased API gravity, it may be possible to infer that coking and/or polymerization of the crude feed was initiated.

Examples 19

Contact of a Crude Feed at Various LHSV

The contacting systems and the catalysts were the same as described in Example 6. The properties of the crude feeds are listed in Table 6 in FIG. 18. The contacting conditions were as follows: a ratio of hydrogen gas to the crude feed provided to the reactor was about 160 $Nm^3/m^3$ (1000 SCFB), pressure was 6.9 MPa (about 1014.7 psi), and temperature of the contacting zones was 371° C. (about 700° F.) for the total run time. In Example 19, the LHSV during contacting was increased over a period of time from 1 $h^{-1}$ to 12 $h^{-1}$, maintained at 12 $h^{-1}$ for 48 hours, and then the LHSV was increased to 20.7 $h^{-1}$ and maintained at about 20.7 $h^{-1}$ for 96 hours.

In Example 19, the crude product was analyzed to determine TAN, viscosity, density, VGO content, residue content, heteroatoms content, and content of metals in metal salts of organic acids during the time periods that the LHSV was at 12 $h^{-1}$ and at 20.7 $h^{-1}$. Average values for the properties of the crude products are shown in Table 6, FIG. 18.

As shown in Table 6, FIG. 18, the crude product for Example 19 had a reduced TAN and a reduced viscosity relative to the TAN and the viscosity of the crude feed, while the API gravity of the crude product was 104-110% of the API gravity of the crude feed. A weight ratio of MCR content to $C_5$ asphaltenes content was at least 1.5. The sum of the MCR content and $C_5$ asphaltenes content was reduced relative to the sum of the MCR content and $C_5$ asphaltenes content of the crude feed. From the weight ratio of MCR content to $C_5$ asphaltenes content and the reduced sum of the MCR content and the $C_5$ asphaltenes, it may be inferred that asphaltenes rather than components that have a tendency to form coke are being reduced. The crude product also had total content of potassium, sodium, zinc, and calcium of at most 60% of the total content of the same metals of the crude feed. The sulfur content of the crude product was 80-90% of the sulfur content of the crude feed.

Examples 6 and 19 demonstrate that contacting conditions can be controlled such that a LHSV through the contacting zone is greater than 10 $h^{-1}$, as compared to a process that has a LHSV of 1 $h^{-1}$, to produce crude products with similar properties. The ability to selectively change a property of a crude feed at liquid hourly space velocities greater than 10 $h^{-1}$ allows the contacting process to be performed in vessels of reduced size relative to commercially available vessels. A smaller vessel size may allow the treatment of disadvantaged crudes to be performed at production sites that have size constraints (for example, offshore facilities).

Example 20

Contact of a Crude Feed at Various Contacting Temperatures

The contacting systems and the catalysts were the same as described in Example 6. The crude feed having the properties listed in Table 7 in FIG. 19 was added to the top of the reactor and contacted with the two catalysts in the two contacting zones in the presence of hydrogen to produce a crude product. The two contacting zones were operated at different temperatures.

Contacting conditions in the top contacting zone were as follows: LHSV was about 1 $h^{-1}$; temperature in the top contacting zone was 260° C. (500° F.); a ratio of hydrogen to crude feed was about 160 $Nm^3/m^3$ (1000 SCFB); and pressure was 6.9 MPa (1014.7 psi).

Contacting conditions in the bottom contacting zone were as follows: LHSV was about 1 $h^{-1}$; temperature in the bottom contacting zone was 315° C. (600° F.); a ratio of hydrogen to crude feed was 160 $Nm^3/m^3$ (1000 SCFB); and pressure was 6.9 MPa (1014.7 psi).

The total product exited the bottom contacting zone and was introduced into the gas-liquid phase separator. In the gas-liquid phase separator, the total product was separated into the crude product and gas. The crude product was periodically analyzed to determine TAN and $C_5$ asphaltenes content.

Average values for the properties of crude product obtained during the run are listed in Table 7, FIG. 19. The crude feed had a TAN of about 9.3 and a $C_5$ asphaltenes content of about 0.055 grams of $C_5$ asphaltenes per gram of crude feed. The crude product had an average TAN of 0.7 and an average $C_5$ asphaltenes content of about 0.039 grams of $C_5$ asphaltenes per gram of crude product. The $C_5$ asphaltenes content of the crude product was at most 71% of the $C_5$ asphaltenes content of the crude product.

The total content of potassium and sodium in the crude product was at most 53% of the total content of the same metals in the crude feed. The TAN of the crude product was at most 10% of the TAN of the crude feed. A P-value of about 1.5 or higher was maintained during contacting.

As demonstrated in Examples 6 and 20, having a first (in this case, top) contacting temperature that is 50° C. lower than the contacting temperature of the second (in this case, bottom) zone tends to enhance the reduction of $C_5$ asphaltenes content in the crude product relative to the $C_5$ asphaltenes content of the crude feed. Additionally, reduction of the content of metals in metal salts of organic acids was enhanced using controlled temperature differentials. For example, reduction in the total potassium and sodium content of the crude product from Example 20 was enhanced relative to the reduction of the total potassium and sodium content of the crude product from Example 6 with a relatively constant crude feed/total product mixture stability for each example, as measured by P-value.

Using a lower temperature of a first contacting zone allows removal of the high molecular weight compounds (for example, $C_5$ asphaltenes and/or metals salts of organic acids) that have a tendency to form polymers and/or compounds having physical properties of softness and/or stickiness (for example, gums and/or tars). Removal of these compounds at lower temperature allow such compounds to be removed before they plug and coat the catalysts, thereby increasing the life of the catalysts operating at higher temperatures that are positioned after the first contacting zone.

Example 21

Contact of a Crude Feed and a Catalyst as a Slurry

A bulk metal catalyst and/or a catalyst of the application (0.0001-5 grams or about 0.02-4 grams of catalyst per 100 grams of the crude feed) may, in some embodiments, be slurried with the crude feed and reacted under the following conditions: temperature in a range from about 85-425° C.

(about 185-797° F.), pressure in a range from about 0.5-10 MPa, and ratio of hydrogen source to crude feed of about 16-1600 $Nm^3/m^3$ for a period of time. After sufficient reaction time to produce the crude product, the crude product is separated from the catalyst and/or residual crude feed using a separation apparatus, such as a filter and/or centrifuge. The crude product may have a changed TAN, iron, nickel, and/or vanadium content and a reduced $C_5$ asphaltenes content relative to the crude feed.

In this patent, certain U.S. patents have been incorporated by reference. The text of such U.S. patents is, however, only incorporated by reference to the extent that no conflict exists between such text and the other statements and drawings set forth herein. In the event of such conflict, then any such conflicting text in such incorporated by reference U.S. patents is specifically not incorporated by reference in this patent.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as examples of embodiments. Elements and materials may be substituted for those illustrated and described herein, parts and processes may be reversed and certain features of the invention may be utilized independently, all as would be apparent to one skilled in the art after having the benefit of this description of the invention. Changes may be made in the elements described herein without departing from the spirit and scope of the invention as described in the following claims.

We claim:

1. A method of producing a crude product, comprising:

contacting a crude feed with a catalyst to produce a total product that includes the crude product, wherein the crude product is a liquid mixture at 25° C. and 0.101 MPa, the crude feed comprising one or more alkali metal salts of one or more organic acids and one or more alkaline-earth metal salts of one or more organic acids, and the crude feed has, per gram of crude feed, a total content of at least 0.00001 grams of alkali metal and alkaline-earth metal in metal salts of organic acids, where the catalyst is obtainable by:

combining a support with one or more metals from Column 6 of the Periodic Table, one or more compounds of one or more metals from Column 6 of the Periodic Table, or mixtures thereof to produce a catalyst precursor; and producing the catalyst by heating the catalyst precursor in the presence of one or more sulfur containing compounds at a temperature below 500° C. without converting the one or more Column 6 metals to oxides; and controlling contacting conditions of the crude feed with the catalyst such that the crude product has a total content of alkali metal and alkaline-earth metal in metal salts of organic acids of at most 50% of the content of alkali metal and alkaline-earth metal in metal salts of organic acids in the crude feed.

2. The method of claim 1 wherein the total content of alkali metal and alkaline-earth metal in metal salts of organic acids in the crude product is at most 10% of the content of alkali metal and alkaline-earth metal in metal salts of organic acids in the crude feed.

3. The method of claim 1 wherein the total content of alkali metal and alkaline-earth metal in metal salts of organic acids in the crude product is in a range from about 1% to about 80% of the content of alkali metal and alkaline-earth metal in metal salts of organic acids in the crude feed.

4. The method of claim 1 wherein the crude product has from about 0.0000001 grams to about 0.00005 grams of alkali metal and alkaline-earth metal in metal salts of organic acids per gram of crude product.

5. The method of claim 1 wherein at least one of the Column 6 metals is molybdenum.

6. The method of claim 1 wherein at least one of the Column 6 metals is tungsten.

7. The method of claim 1 wherein the support is combined in addition with one or more metals from Columns 7-10 of the Periodic Table, one or more compounds of one or more metals from Columns 7-10 of the Periodic Table, or mixtures thereof.

8. The method of claim 7 wherein at least one of the Columns 7-10 metals is nickel.

9. The method of claim 8 wherein at least one of the Columns 7-10 metals is cobalt.

10. The method of claim 1 wherein the support is combined in addition with one or more elements from Column 15 of the Periodic Table, one or more compounds of one or more elements from Column 15 of the Periodic Table, or mixtures thereof.

11. The method of claim 1 wherein the support is combined in addition with:

one or more metals from Columns 7-10 of the Periodic Table, one or more compounds of one or more metals from Columns 7-10 of the Periodic Table, or mixtures thereof; and one or more elements from Column 15 of the Periodic Table, one or more compounds of one or more elements from Column 15 of the Periodic Table, or mixtures thereof.

12. The method of claim 1 wherein the support is porous.

13. The method of claim 1 further comprising contacting the crude feed with an additional catalyst that has been heat treated at a temperature above 500° C.

14. The method of claim 1 further comprising contacting the crude feed with an additional catalyst, the additional catalyst having a pore size distribution with a median pore diameter of at least 60 Å.

15. The method of claim 1 further comprising contacting the crude feed with an additional catalyst, the additional catalyst having a pore size distribution with a median pore diameter of at least 180 Å.

16. The method of claim 1 further comprising contacting the crude feed with an additional catalyst, where the additional catalyst comprises one or more metals from Columns 5-10 of the Periodic Table, one or more compounds of one or more metals from Columns 5-10 of the Periodic Table, or mixtures thereof.

17. The method of claim 1 wherein the crude feed is contacted in a contacting zone that is on or coupled to an offshore facility.

18. The method of claim 1 wherein contacting comprises contacting the crude feed in the presence of a hydrogen source.

19. The method of claim 1 wherein the method further comprises heating the catalyst precursor in the presence of one or more sulfur containing compounds for about 1 to about 3 hours.

20. The method of claim 1 wherein the method further comprises combining the crude product with a crude that is the same as or different from the crude feed to form a blend suitable for transportation and/or treatment facilities.

21. The method of claim 1 wherein the method further comprises processing the crude product to produce transportation fuel.

22. The method of claim 21 wherein the processing comprises distilling the crude product into one or more distillate fractions.

23. The method of claim 21 wherein the processing comprises hydrotreating.

* * * * *